US007318463B2

(12) United States Patent
Tanaka et al.

(10) Patent No.: US 7,318,463 B2
(45) Date of Patent: Jan. 15, 2008

(54) SELF-PROPELLING CRUSHER

(75) Inventors: Masamichi Tanaka, Tsuchiura (JP); Yoshimi Shiba, Shimotsuma (JP); Tadashi Shiohata, Ibaraki-ken (JP); Kentaro Hashimoto, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 203 days.

(21) Appl. No.: 10/513,858

(22) PCT Filed: Dec. 10, 2003

(86) PCT No.: PCT/JP03/15774

§ 371 (c)(1),
(2), (4) Date: Nov. 9, 2004

(87) PCT Pub. No.: WO2004/052544

PCT Pub. Date: Jun. 24, 2004

(65) Prior Publication Data

US 2005/0173570 A1 Aug. 11, 2005

(30) Foreign Application Priority Data

Dec. 11, 2002 (JP) ..... 2002-359862

(51) Int. Cl.
*B27C 9/00* (2006.01)

(52) U.S. Cl. ..... 144/36; 241/101.74

(58) Field of Classification Search ..... 241/36, 241/101.74; 60/445–452
See application file for complete search history.

(56) References Cited

U.S. PATENT DOCUMENTS 4,027,738 A * 6/1977 Lundin ..... 180/14.3
5,155,996 A * 10/1992 Tatsumi et al. ..... 60/431
5,641,261 A * 6/1997 Talbert et al. ..... 414/544
5,803,376 A * 9/1998 Koyanagi et al. ..... 241/36

FOREIGN PATENT DOCUMENTS

JP 11-226444 8/1999
JP 2000-136739 5/2000
JP 2000-325824 11/2000

OTHER PUBLICATIONS

PTO 07-2363, English translation of JP 2000-136739.*

* cited by examiner

*Primary Examiner*—Bena Miller
(74) *Attorney, Agent, or Firm*—Mattingly, Stanger, Malur & Brundidge, PC

(57) ABSTRACT

A self-propelled crushing machine comprises a crushing device 20; a hydraulic drive system including a crushing device hydraulic motor 21 for driving the crushing device 20, a first hydraulic pump 62 for driving the crushing device hydraulic motor 21, and an engine 61 for driving the first hydraulic pump 62; a pressure sensor 151 for detecting a load condition of the crushing device 20; and a controller 84" for executing control to increase a revolution speed of the engine 61 in accordance with a detected signal from the pressure sensor 151. Accordingly, even when a heavy load is imposed on the crushing device, a reduction of crushing efficiency can be prevented.

7 Claims, 25 Drawing Sheets

SELF-PROPELLING CRUSHER

TECHNICAL FIELD

The present invention relates to a self-propelled crushing machine equipped with a crushing device for crushing target materials to be crushed, such as a jaw crusher, a roll crusher, a shredder, and a wood chipper.

BACKGROUND ART

Usually, crushing machines are employed to crush target materials to be crushed, e.g., rocks and construction wastes of various sizes generated in construction sites, into a predetermined size for the purposes of reuse of the wastes, smoother progress of work, a cost reduction, etc.

As one example of those crushing machines, a mobile crusher generally comprises a travel body having left and right crawler belts, a crushing device for crushing target materials loaded through a hopper into a predetermined size, a feeder for guiding the target materials loaded through the hopper to the crushing device, a discharge conveyor for carrying the materials having been crushed into small fragments by the crushing device to the outside of the machine, and auxiliaries for performing work related to crushing work performed by the crushing device, such as a magnetic separating device disposed above the discharge conveyor for magnetically attracting and removing magnetic substances included in the crushed materials under carrying on the discharge conveyor.

As disclosed in JP,A 11-226444, for example, a typical hydraulic system for such a self-propelled crushing machine comprises variable displacement hydraulic pumps (i.e., a hydraulic pump for the crushing device and a hydraulic pump for the auxiliaries) driven by a prime mover (engine), a crushing device hydraulic motor and auxiliary hydraulic actuators (such as a feeder hydraulic motor, a discharge conveyor hydraulic motor, and a magnetic separating device hydraulic motor) driven by hydraulic fluids delivered from the hydraulic pumps, a plurality of control valves for controlling the directions and flow rates of the hydraulic fluids supplied from the hydraulic pumps to those hydraulic motors, control means for controlling respective delivery rates of the hydraulic pumps, and so on.

In the known hydraulic drive system, however, when a heavy load is imposed on the crushing device during the crushing work due to, e.g., excessive supply of the target materials (materials to be crushed), a corresponding load is also imposed on the crushing device hydraulic motor and hence the rotational speed of the crushing device hydraulic motor is reduced. This has resulted in problems that crushing efficiency of the crushing device reduces and productivity of crushed products lowers.

DISCLOSURE OF INVENTION

In view of the above-mentioned problems in the state of the art, an object of the present invention is to provide a self-propelled crushing machine capable of preventing a reduction of crushing efficiency even when a heavy load is imposed on a crushing device.

(1) To achieve the above object, the present invention provides a self-propelled crushing machine for crushing target materials to be crushed, wherein the machine comprises a crushing device; a hydraulic drive system including a crushing device hydraulic motor for driving the crushing device, at least one hydraulic pump for driving the crushing device hydraulic motor, and a prime mover for driving the hydraulic pump; crushing device load detecting means for detecting a load condition of the crushing device; and control means for executing control to increase a revolution speed of the prime mover in accordance with a detected signal from the crushing device load detecting means.

With the present invention, when a heavy load is imposed on the crushing device and the load pressure of the crushing device hydraulic motor is increased during the crushing work due to, e.g., excessive supply of the target materials (materials to be crushed), the crushing device load detecting means detects such an overload condition, and the control means increases the revolution speed of the prime mover, thereby increasing the horsepower of the prime mover. In other words, as compared with the known structure having a possibility that the rotational speed of the crushing device hydraulic motor lowers and productivity of crushed products reduces in the overload condition where the load pressure of the crushing device hydraulic motor is increased and the engine revolution speed lowers, the present invention is able to prevent a reduction of the crushing efficiency, which is caused by a lowering of the rotational speed of the crushing device hydraulic motor, by increasing the horsepower of the prime mover in the overload condition of the crushing device as described above.

(2) To achieve the above object, the present invention also provides a self-propelled crushing machine for crushing target materials to be crushed, wherein the machine comprises a crushing device; at least one auxiliary for performing work related to crushing work performed by the crushing device; a hydraulic drive system including a crushing device hydraulic motor for driving the crushing device, an auxiliary hydraulic actuator for driving the auxiliary, a first hydraulic pump for driving the crushing device hydraulic motor, a second hydraulic pump for driving the auxiliary hydraulic actuator, and a prime mover for driving the first hydraulic pump and the second hydraulic pump; first delivery pressure detecting means for detecting a delivery pressure of the first hydraulic pump; second delivery pressure detecting means for detecting a delivery pressure of the second hydraulic pump; and control means for controlling delivery rates of the first hydraulic pump and the second hydraulic pump in accordance with a detected signal from the first delivery pressure detecting means and a detected signal from the second delivery pressure detecting means such that a total of input torques of the first hydraulic pump and the second hydraulic pump is held not larger than an output torque of the prime mover, and for executing control to increase a revolution speed of the prime mover in accordance with the detected signals from the first delivery pressure detecting means and the second delivery pressure detecting means.

With the present invention, the so-called total horsepower control is performed such that the delivery rates of the first hydraulic pump and the second hydraulic pump are controlled depending on the delivery pressure of the first hydraulic pump for supplying a hydraulic fluid to the crushing device hydraulic motor and on the delivery pressure of the second hydraulic pump for supplying a hydraulic fluid to the auxiliary hydraulic actuator, and that a total of the torques of the first hydraulic pump and the second hydraulic pump is controlled to be held smaller than the horsepower of the prime mover. As a result, the horsepower of the prime mover is effectively distributed to the first and second hydraulic pumps depending on the difference between their loads, and hence the horsepower of the prime mover can be effectively utilized.

(3) In above (2), preferably, the first hydraulic pump comprises two variable displacement hydraulic pumps performing tilting control in sync with each other.

BEST MODE FOR CARRYING OUT THE INVENTION

One embodiment of a self-propelled crushing machine of the present invention will be described below with reference to the drawings.

First, one embodiment of the self-propelled crushing machine of the present invention will be described with reference to FIGS. 1 to 16.

Figure 1:
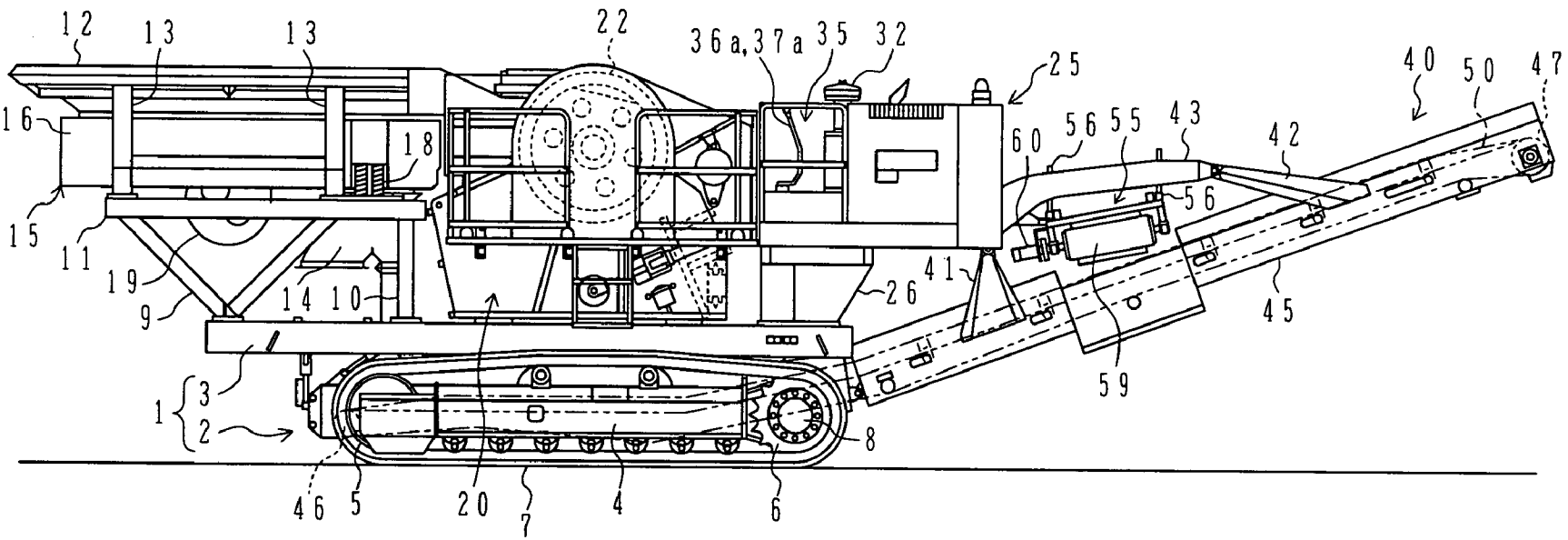
FIG. 1 is a side view showing an overall structure of one embodiment of a self-propelled crushing machine of the present invention.
Figure 2:
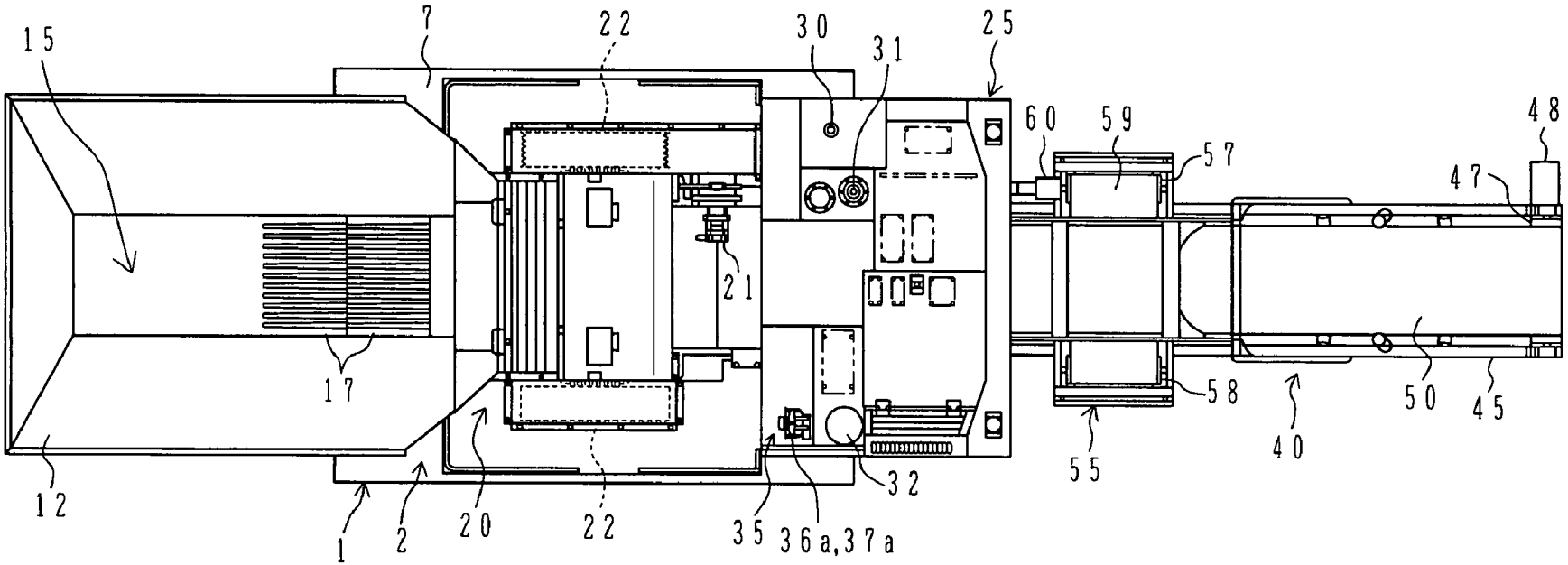
FIG. 2 is a plan view showing the overall structure of one embodiment of the self-propelled crushing machine of the present invention.
Figure 3:
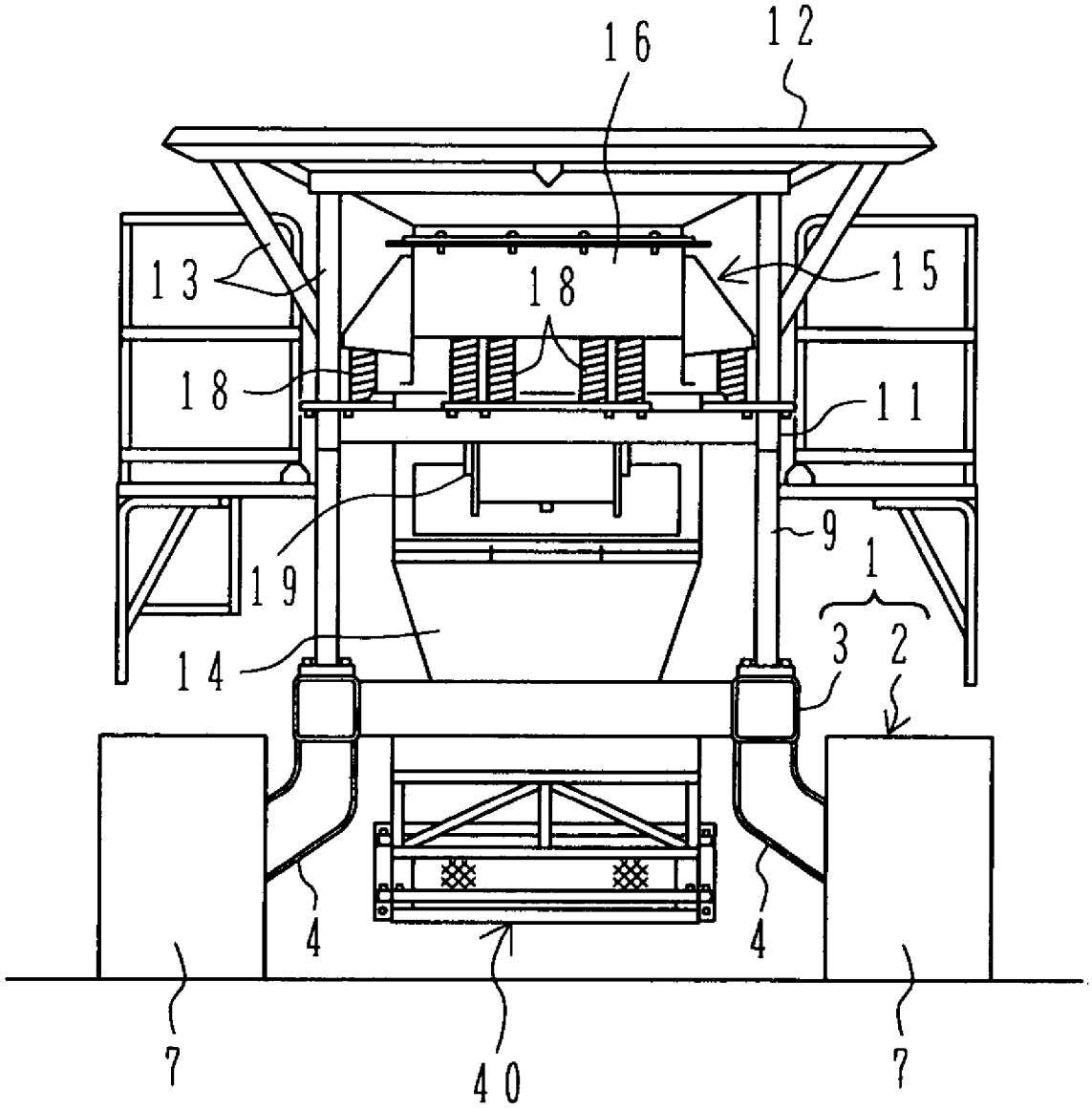
FIG. 3 is a front view showing the overall structure of one embodiment of the self-propelled crushing machine of the present invention.

FIG. 1 is a side view showing an overall structure of one embodiment of the self-propelled crushing machine of the present invention, FIG. 2 is a plan view thereof, and FIG. 3 is a front view looking from the left side in FIG. 1.

In FIGS. 1 to 3, numeral 1 denotes a travel body. The travel body 1 comprises a travel structure 2 and a body frame 3 substantially horizontally extending on the travel structure 2. Numeral 4 denotes a track frame of the travel structure 2. The track frame 4 is connected to the underside of the body frame 3. Numerals 5, 6 denote respectively a driven wheel (idler) and a drive wheel which are disposed at opposite ends of the track frame 4, and 7 denotes a crawler belt (caterpillar belt) entrained over the driven wheel 5 and the drive wheel 6. Numeral 8 denotes a travel hydraulic motor directly coupled to the drive wheel 6. The travel hydraulic motor 8 comprises a left travel hydraulic motor 8L disposed on the left side of the self-propelled crushing machine and a right travel hydraulic motor 8R disposed on the right side thereof (see FIG. 4 described later). Numerals 9, 10 denote support posts vertically disposed on one side (left side as viewed in FIG. 1) of the body frame 3 in the longitudinal direction thereof, and 11 denotes a support bar supported by the support posts 9, 10.

Numeral 12 denotes a hopper for receiving materials to be crushed, i.e., target materials. The hopper 12 is formed so as to have a shape with a size gradually decreasing downward and is supported on the support bar 11 through a plurality of support members 13. The self-propelled crushing machine of this embodiment is intended to receive and crush the target materials, such as construction wastes of various sizes generated in construction sites, including concrete masses carried out during dismantling of buildings and asphalt masses coming out during repair of roads, industrial wastes, or natural rocks and rocks extracted from rock-drilling sites and pit faces.

Numeral 15 denotes a feeder (grizzly feeder) positioned substantially right under the hopper 12. The feeder 15 serves to carry and supply the target materials, which have been received in the hopper 12, to a crushing device 20 described later, and it is supported by the support bar 11 independently of the hopper 12. Numeral 16 denotes a body of the feeder 15. In the feeder body 16, a plurality (two in this embodiment) of comb-like plates 17 each having an end portion (right end portion as viewed in FIG. 2) in the form of comb teeth are fixed in a stepped arrangement and are vibratingly supported on the support bar 11 through a plurality of springs 18. Numeral 19 denotes a feeder hydraulic motor. The feeder hydraulic motor 19 vibrates the feeder 15 such that the loaded target materials on the comb-tooth plates 17 are fed reward (to the right as viewed in FIG. 1). The structure of the feeder hydraulic motor 19 is not limited to particular one, and it may be, for example, a vibration motor of the type rotating an eccentric shaft. Numeral 14 denotes a chute disposed substantially right under the comb teeth portions of the comb-like plates 17. The chute 14 serves to guide small particles (so-called accompanying debris), which are contained in the target materials and dropped through gaps between the comb teeth of the comb-like plates 17, onto a discharge conveyor 40 described later.

Numeral 20 denotes a jaw crusher (hereinafter referred to also as a "crushing device 20") serving as the crushing device that crushes the target materials. As shown in FIG. 1, the jaw crusher 20 is mounted at a position on the rear side (right side as viewed in FIG. 1) of the hopper 12 and the feeder 15, but near the center of the body frame 3 in the longitudinal direction thereof (i.e., in the left-and-right direction as viewed in FIG. 1). Also, the jaw crusher 20 is of the known structure and includes therein a pair of moving teeth and fixed teeth (both not shown) which are opposed to each other with a space between them gradually decreasing downward. Numeral 21 denotes a crushing device hydraulic motor (see FIG. 2). The crushing device hydraulic motor 21 rotates a flywheel 22, and the rotation of the flywheel 22 is converted into swing motion of the moving teeth (not shown) through a well-known conversion mechanism. In other words, the moving teeth are caused to swing relative to the standstill fixed teeth substantially in the back-and-forth direction (i.e., in the left-and-right direction as viewed in FIG. 1). While this embodiment employs a belt (not shown) as a structure for transmitting torque from the crushing device hydraulic motor 21 to the flywheel 22, the torque transmitting structure is not limited to one using a belt. Any other suitable structure employing a chain, for example, may also be used.

Numeral 25 denotes a motive power device (power unit) incorporating therein a motive power source for various operating devices. As shown in FIG. 1, the power unit 25 is positioned on the rear side (right side as viewed in FIG. 1) of the crushing device 20, and is supported through a support member 26 at an opposite end (right end as viewed in FIG. 1) of the body frame 3 in the longitudinal direction thereof. Also, the power unit 25 includes a later-described engine (prime mover) 61 serving as the motive power source, later-described hydraulic pumps 62, 63 driven by the engine 61, etc. (details of the power unit being described later). Numerals 30, 31 denote oil supply ports for a fuel reservoir and a hydraulic fluid reservoir (both not shown) which are incorporated in the power unit 25. Those oil supply ports 30, 31 are disposed at the top of the power unit 25. Numeral 32 denotes a pre-cleaner. The pre-cleaner 32 captures dust mixed in intake air introduced to the engine 61 at a position upstream of an air cleaner (not shown) in the power unit 25. Numeral 35 denotes a cab in which an operator operates the machine. The cab 35 is disposed in a section on the front side (left side as viewed in FIG. 1) of the power unit 25. Numerals 36*a*, 37*a* denote left and right travel control levers for operating respectively the left and right travel hydraulic motors 8L, 8R.

Numeral 40 denotes a discharge conveyor for carrying and discharging crushed materials that are generated by crushing the target materials, the above-mentioned accompanying debris, etc. to the outside of the machine. The discharge conveyor 40 is suspended from an arm member 43, which is mounted to the power unit 25, through support members 41, 42 such that its portion on the discharge side (the right side as viewed in FIG. 1 in this embodiment) rises obliquely. Also, a portion of the discharge conveyor 40 on the side (the left side as viewed in FIG. 1) opposed to the discharge side is supported while being suspended from the body frame 3 substantially in a horizontal state. Numeral 45 denotes a conveyor frame for the discharge conveyor 40, and 46, 47 denote respectively a driven wheel (idler) and a drive wheel disposed at opposite ends of the conveyor frame 45. Numeral 48 denotes a discharge conveyor hydraulic motor (see FIG. 2) directly coupled to the drive wheel 47. Numeral 50 denotes a conveying belt entrained over the driven wheel 46 and the drive wheel 47. The conveying belt 50 is driven to run in a circulating manner with the drive wheel 47 rotated by the discharge conveyor hydraulic motor 48.

Numeral 55 denotes a magnetic separating device for removing foreign matters (magnetic substances), such as iron reinforcing rods contained in the crushed materials under carrying for discharge. The magnetic separating device 55 is suspended from the arm member 43 through a support member 56. The magnetic separating device 55 has a magnetic separating device belt 59 that is entrained over a drive wheel 57 and a driven wheel 58 and that is disposed in a close and substantially perpendicular relation to a conveying surface of the conveying belt 50 of the discharge conveyor 40. Numeral 60 is a magnetic separating device hydraulic motor directly coupled to the drive wheel 57. A magnetic force generating means (not shown) is disposed inside a circulating path of the magnetic separating device belt 59. The foreign matters, such as iron reinforcing rods, on the conveying belt 50 are attracted to the magnetic separating device belt 59 by magnetic forces generated from the magnetic force generating means and acting through the magnetic separating device belt 59, and they are dropped after being carried laterally of the discharge conveyor 40.

Figure 4:
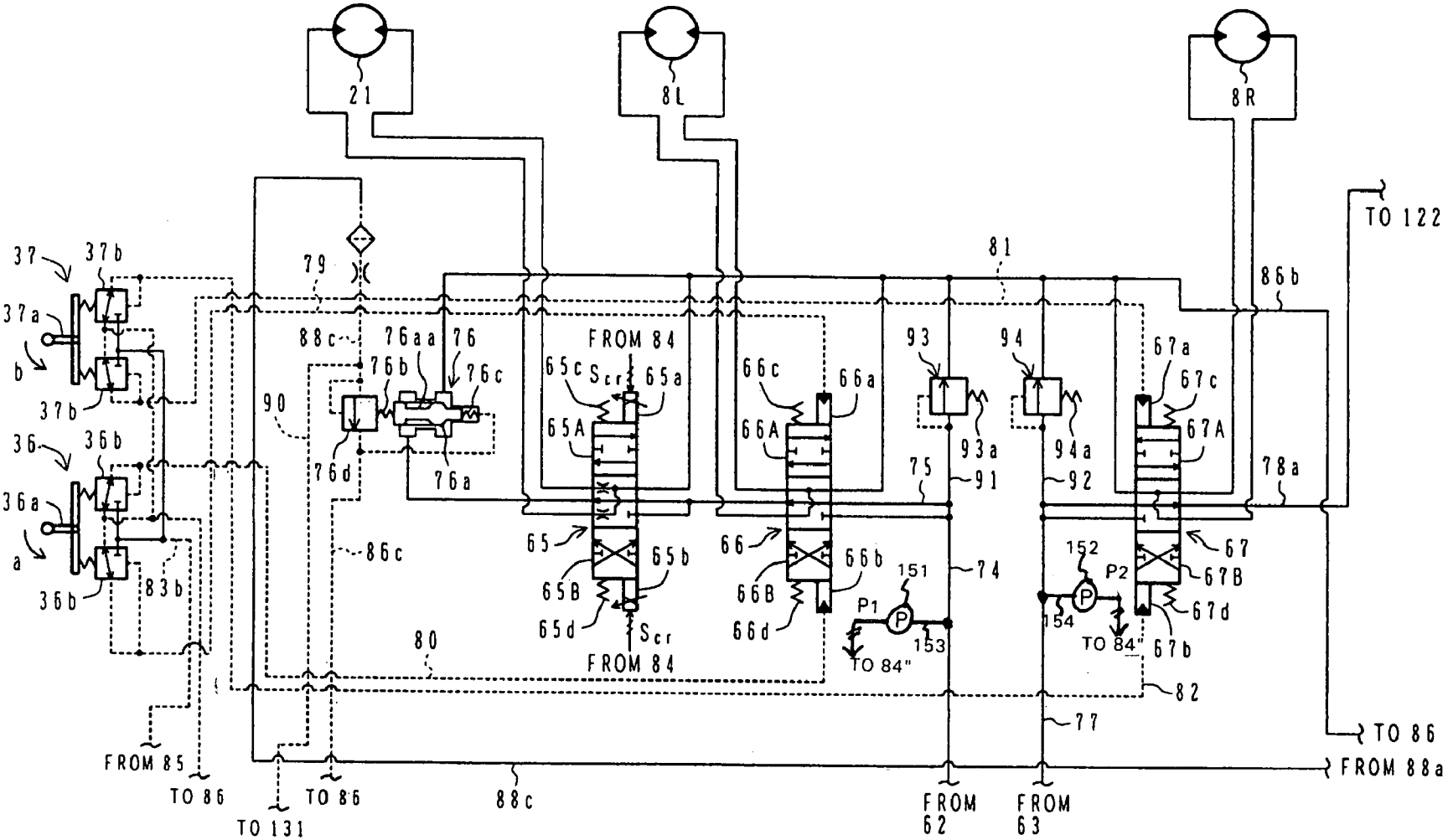
FIG. 4 is a hydraulic circuit diagram showing an overall arrangement of a hydraulic drive system provided in one embodiment of the self-propelled crushing machine of the present invention.
Figure 5:
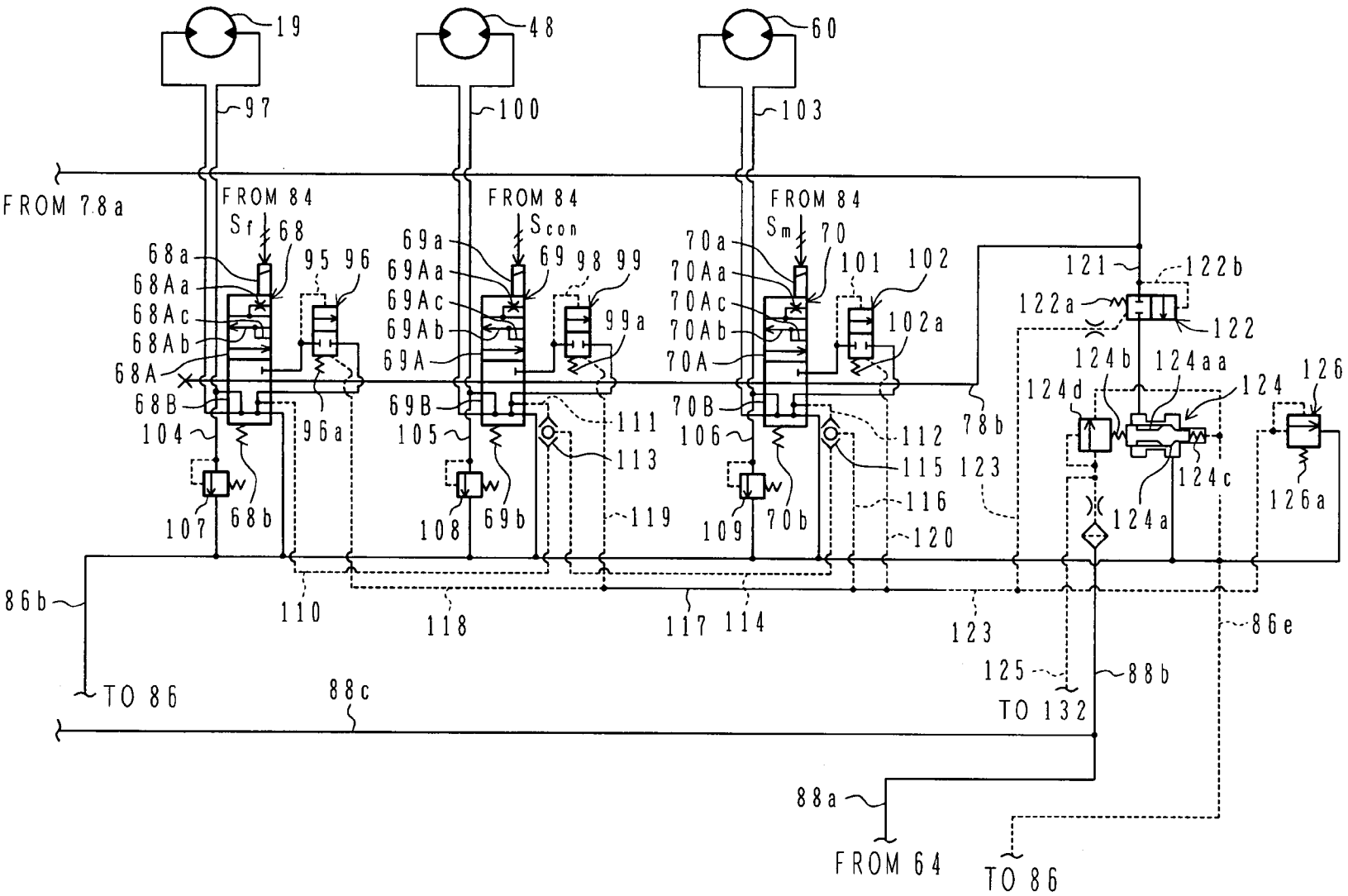
FIG. 5 is a hydraulic circuit diagram showing the overall arrangement of the hydraulic drive system provided in one embodiment of the self-propelled crushing machine of the present invention.
Figure 6:
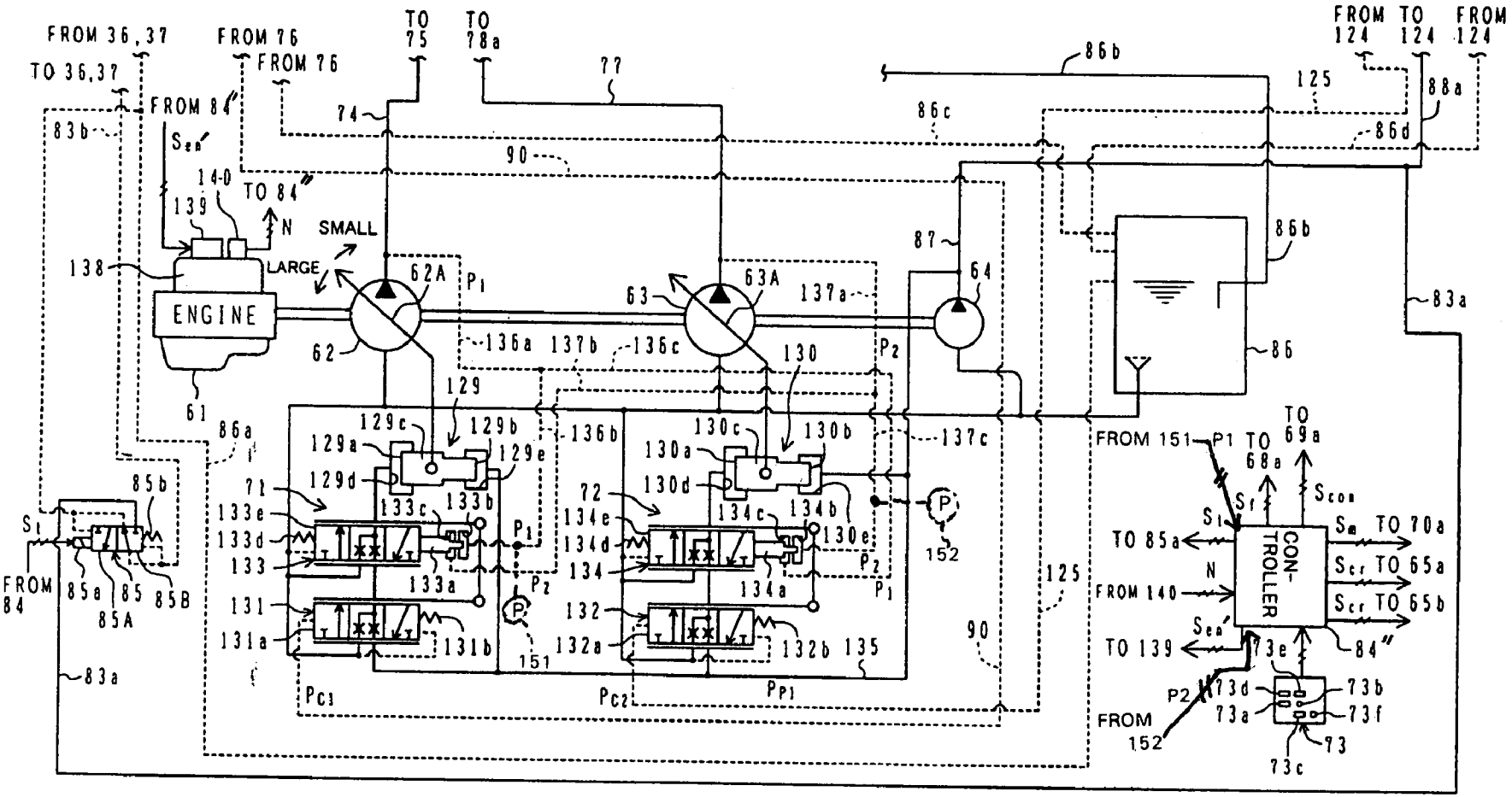
FIG. 6 is a hydraulic circuit diagram showing the overall arrangement of the hydraulic drive system provided in one embodiment of the self-propelled crushing machine of the present invention.

Here, the travel body 1, the feeder 15, the crushing device 20, the discharge conveyor 40, and the magnetic separating device 55 constitute driven members that are driven by a hydraulic drive system provided in the self-propelled crushing machine. FIGS. 4 to 6 are each a hydraulic circuit diagram showing an overall arrangement of the hydraulic drive system provided in the self-propelled crushing machine of this embodiment.

In FIGS. 4 to 6, the hydraulic drive system comprises an engine 61; first and second variable displacement hydraulic pumps 62, 63 driven by the engine 61; a fixed displacement pilot pump 64 similarly driven by the engine 61; left and right travel hydraulic motors 8L, 8R, a feeder hydraulic motor 19, a crushing device hydraulic motor 21, a discharge conveyor hydraulic motor 48, and a magnetic separating device hydraulic motor 60 which are supplied with hydraulic fluids delivered from the first and second hydraulic pumps 62, 63; six control valves 65, 66, 67, 68, 69 and 70 for controlling respective flows (directions and flow rates or only flow rates) of the hydraulic fluids supplied from the first and second hydraulic pumps 62, 63 to those hydraulic motors 8L, 8R, 19, 21, 48 and 60; left and right control levers 36*a*, 37*a* disposed in the cab 35 and shifting the left and right travel control valves 66, 67 (described later in detail); control means, e.g., regulator units 71, 72, for adjusting delivery rates Q1, Q2 (see FIG. 8 described later) of the first and second hydraulic pumps 62, 63; and a control panel 73 that is disposed in, e.g., the cab 35 and is manipulated by an operator to enter instructions for, by way of example, starting and stopping the crushing device 20, the feeder 15, the discharge conveyor 40, and the magnetic separating device 55.

The six control valves 65 to 70 are each a two or three-position selector valve and are constituted as a crushing device control valve 65 connected to the crushing device hydraulic motor 21, a left travel control valve 66 connected to the left travel hydraulic motor 8L, a right travel control valve 67 connected to the right travel hydraulic motor 8R, a feeder control valve 68 connected to the feeder hydraulic motor 19, a discharge conveyor control valve 69 connected to the discharge conveyor hydraulic motor 48, and a magnetic separating device control valve 70 connected to the magnetic separating device hydraulic motor 60.

Of the first and second hydraulic pumps 62, 63, the first hydraulic pump 62 delivers the hydraulic fluid supplied to the left travel hydraulic motor 8L and the crushing device hydraulic motor 21 through the left travel control valve 66 and the crushing device control valve 65, respectively. These control valves 65, 66 are three-position selector valves capable of controlling respective directions and flow rates of the hydraulic fluid supplied to the corresponding hydraulic motors 21, 8L. In a center bypass line 75 connected to a delivery line 74 of the first hydraulic pump 62, the left travel control valve 66 and the crushing device control valve 65 are disposed in this order from the upstream side. Additionally, a pump control valve 76 (described later in detail) is disposed at the most downstream of the center bypass line 75.

On the other hand, the second hydraulic pump 63 delivers the hydraulic fluid supplied to the right travel hydraulic motor 8R, the feeder hydraulic motor 19, the discharge conveyor hydraulic motor 48, and the magnetic separating device hydraulic motor 60 through the right travel control valve 67, the feeder control valve 68, the discharge conveyor control valve 69, and the magnetic separating device control valve 70, respectively. Of these control valves, the right travel control valve 67 is a three-position selector valve capable of controlling a flow of the hydraulic fluid supplied to the corresponding right travel hydraulic motor 8R. The other control valves 68, 69 and 70 are two-position selector valves capable of controlling respective flow rates of the hydraulic fluid supplied to the corresponding hydraulic motors 19, 48 and 60. In a center bypass line 78*a* connected to a delivery line 77 of the second hydraulic pump 63 and a center line 78*b* connected downstream of the center bypass line 78*a*, the right travel control valve 67, the magnetic separating device control valve 70, the discharge conveyor control valve 69, and the feeder control valve 68 are disposed in this order from the upstream side. Additionally, the center line 78*b* is closed downstream of the feeder control valve 68 disposed at the most downstream thereof.

Of the control valves 65 to 70, the left and right travel control valves 66, 67 are each center bypass pilot-operated valve that is operated by utilizing a pilot pressure generated from the pilot pump 64. Stated another way, the left and right travel control valves 66, 67 are operated by respective pilot pressures that are generated from the pilot pump 64 and then reduced to predetermined pressures by control lever units 36, 37 provided with the control levers 36*a*, 37*a*.

More specifically, the control lever units 36, 37 include respectively the control levers 36*a*, 37*a* and pairs of pressure reducing valves 36*b*, 36*b*; 37*b*, 37*b* for outputting pilot pressures corresponding to input amounts by which the control levers 36*a*, 37*a* are operated. When the control lever 36*a* of the control lever unit 36 is operated in a direction of arrow a in FIG. 4 (or in an opposite direction; this directional correspondence is similarly applied to the following description), a resulting pilot pressure is introduced to a driving sector 66*a* (or a driving sector 66*b*) of the left travel control valve 66 via a pilot line 79 (or a pilot line 80), whereby the left travel control valve 66 is switched to a shift position 66A on the upper side as viewed in FIG. 4 (or a shift position 66B on the lower side). Accordingly, the hydraulic fluid from the first hydraulic pump 62 is supplied to the left travel hydraulic motor 8L via the delivery line 74, the center bypass line 75, and the shift position 66A (or the shift position 66B on the lower side) of the left travel control valve 66, thereby driving the left travel hydraulic motor 8L in the forward direction (or in the reverse direction).

When the control lever 36*a* is operated to its neutral position shown in FIG. 4, the left travel control valve 66 is returned to its neutral position shown in FIG. 4 by the biasing forces of springs 66*c*, 66*d*, whereupon the left travel hydraulic motor 8L is stopped.

Similarly, when the control lever 37*a* of the control lever unit 37 is operated in a direction of arrow b in FIG. 4 (or in an opposite direction), a resulting pilot pressure is introduced to a driving sector 67*a* (or a driving sector 67*b*) of the right travel control valve 67 via a pilot line 81 (or a pilot line 82), whereby the right travel control valve 67 is switched to a shift position 67A on the upper side as viewed in FIG. 4

(or a shift position 67B on the lower side), thereby driving the right travel hydraulic motor 8R in the forward direction (or in the reverse direction). When the control lever 37*a* is operated to its neutral position, the right travel control valve 67 is returned to its neutral position by the biasing forces of springs 67*c*, 67*d*, whereupon the right travel hydraulic motor 8R is stopped.

A solenoid control valve 85 capable of being shifted in response to a drive signal St (described later) from a controller 84" is disposed in pilot introducing lines 83*a*, 83*b* for introducing the pilot pressure from the pilot pump 64 to the control lever units 36, 37. When the drive signal St inputted to a solenoid 85*a* is turned ON, the solenoid control valve 85 is switched to a communication position 85A on the left side as viewed in FIG. 6, whereupon the pilot pressure from the pilot pump 64 is introduced to the control lever units 36, 37 via the introducing lines 83*a*, 83*b*, thus enabling the left and right travel control valves 66, 67 to be operated respectively by the control levers 36*a*, 37*a*.

On the other hand, when the drive signal St is turned OFF, the solenoid control valve 85 is returned to a cutoff position 85B on the right side, as viewed in FIG. 6, by the restoring force of a spring 85*b*, whereupon the introducing lines 83*a*, 83*b* are cut off from each other and the introducing line 83*b* is communicated with a reservoir line 86*a* extending to a reservoir 86 to keep the pressure in the introducing line 83*b* at a reservoir pressure, thus disabling the operation of the left and right travel control valves 66, 67 by the control levers units 36, 37.

The crushing device control valve 65 is a center-bypass solenoid proportional valve having solenoid driving sectors 65*a*, 65*b* provided at opposite ends thereof. The solenoid driving sectors 65*a*, 65*b* include respective solenoids energized by drive signals Scr from the controller 84", and the crushing device control valve 65 is switched in response to an input of the drive signals Scr.

More specifically, when the drive signals Scr are given as signals corresponding to forward rotation of the crushing device 20 (or reverse rotation; this directional correspondence is similarly applied to the following description), for example, when the drive signals Scr inputted to the solenoid driving sectors 65*a*, 65*b* are turned respectively ON and OFF (or when the drive signals Scr inputted to the solenoid driving sectors 65*a*, 65*b* are turned respectively OFF and ON), the crushing device control valve 65 is switched to a shift position 65A on the upper side as viewed in FIG. 4 (or a shift position 65B on the lower side). Accordingly, the hydraulic fluid from the first hydraulic pump 62 is supplied to the crushing device hydraulic motor 21 via the delivery line 74, the center bypass line 75, and the shift position 65A (or the shift position 65B on the lower side) of the crushing device control valve 65, thereby driving the crushing device hydraulic motor 21 in the forward direction (or in the reverse direction).

When the drive signals Scr are given as signals corresponding to the stop of the crushing device 20, for example, when the drive signals Scr inputted to the solenoid driving sectors 65*a*, 65*b* are both turned OFF, the control valve 65 is returned to its neutral position shown in FIG. 4 by the biasing forces of springs 65*c*, 65*d*, thereby stopping the crushing device hydraulic motor 21.

The pump control valve 76 has the function of converting a flow rate into a pressure and comprises a piston 76*a* capable of selectively establishing and cutting off communication between the center bypass line 75 and a reservoir line 86*b* through a throttle portion 76*aa* thereof, springs 76*b*, 76*c* for biasing respectively opposite ends of the piston 76*a*, and a variable relief valve 76*d* which is connected at its upstream side to the delivery line 87 of the pilot pump 64 via a pilot introducing line 88*a* and a pilot introducing line 88*c* for introduction of the pilot pressure and at its downstream side to a reservoir line 86*c*, and which produces a relief pressure variably set by the spring 76*b*.

With such an arrangement, the pump control valve 76 functions as follows. The left travel control valve 66 and the crushing device control valve 65 are each a center bypass valve as described above, and the flow rate of the hydraulic fluid flowing through the center bypass line 75 is changed depending on respective amounts by which the control valves 66, 65 are operated (i.e., shift stroke amounts of their spools). When the control valves 66, 65 are in neutral positions, i.e., when demand flow rates of the control valves 66, 65 demanded for the first hydraulic pump 62 (namely flow rates demanded by the left travel hydraulic motor 8L and the crushing device hydraulic motor 21) are small, most of the hydraulic fluid delivered from the first hydraulic pump 62 is introduced, as an extra flow rate Qt1 (see FIG. 7 described later), to the pump control valve 76 via the center bypass line 75, whereby the hydraulic fluid is led out at a relatively large flow rate to the reservoir line 86*b* through the throttle portion 76*aa* of the piston 76*a*. Therefore, the piston 76*a* is moved to the right, as viewed in FIG. 4, to reduce the setting relief pressure of the relief valve 76*d* set by the spring 76*b*. As a result, a relatively low control pressure (negative control pressure) Pc1 is generated in a line 90 that is branched from the line 88*c* and is extended to a later-described first servo valve 131 for negative tilting control.

Conversely, when the control valves 66, 65 are operated into open states, i.e., when the demand flow rates demanded for the first hydraulic pump 62 are large, the extra flow rate Qt1 of the hydraulic fluid flowing through the center bypass line 75 is reduced corresponding to the flow rates of the hydraulic fluid flowing to the hydraulic motors 8L, 21. Therefore, the flow rate of the hydraulic fluid led out to the reservoir line 86*b* through the piston throttle portion 76*aa* becomes relatively small, whereby the piston 76*a* is moved to the left, as viewed in FIG. 4, to increase the setting relief pressure of the relief valve 76*d*. As a result, the control pressure Pc1 in the line 90 rises.

In this embodiment, as described later, a tilting angle of a swash plate 62A of the first hydraulic pump 62 is controlled in accordance with change of the control pressure (negative control pressure) Pc1 (details of this control being described later).

Relief valves 93, 94 are disposed respectively in lines 91, 92 branched from the delivery lines 74, 77 of the first and second hydraulic pumps 62, 63, and relief pressure values for limiting maximum values of delivery pressures P1, P2 of the first and second hydraulic pumps 62, 63 are set by the biasing forces of springs 93*a*, 94*a* associated respectively with the relief valves 93, 94.

The feeder control valve 68 is a solenoid selector valve having a solenoid driving sector 68*a*. The solenoid driving sector 68*a* is provided with a solenoid energized by a drive signal Sf from the controller 84", and the feeder control valve 68 is switched in response to an input of the drive signal Sf. More specifically, when the drive signal Sf is turned to an ON-signal for starting the operation of the feeder 15, the feeder control valve 68 is switched to a shift position 68A on the upper side as viewed in FIG. 5.

As a result, the hydraulic fluid introduced from the second hydraulic pump 63 via the delivery line 77, the center bypass line 78*a* and the center line 78*b* is supplied from a throttle means 68Aa provided in the shift position 68A to the feeder hydraulic motor 19 via a line 95 connected to the throttle means 68Aa, a pressure control valve 96 (described later in detail) disposed in the line 95, a port 68Ab provided in the shift position 68A, and a supply line 97 connected to the port 68Ab, thereby driving the feeder hydraulic motor 19. When the drive signal Sf is turned to an OFF-signal corresponding to the stop of the feeder 15, the feeder control valve 68 is returned to a cutoff position 69B shown in FIG. 5 by the biasing force of a spring 68*b*, whereby the feeder hydraulic motor 19 is stopped.

Similarly to the feeder control valve 68, the discharge conveyor control valve 69 has a solenoid driving sector 69*a* provided with a solenoid energized by a drive signal Scon from the controller 84". When the drive signal Scon is turned to an ON-signal for starting the operation of the discharge conveyor 40, the discharge conveyor control valve 69 is switched to a communication position 69A on the upper side as viewed in FIG. 5. As a result, the hydraulic fluid introduced via the center line 78*b* is supplied from a throttle means 69Aa provided in the shift position 69A to the discharge conveyor hydraulic motor 48 via a line 98, a pressure control valve 99 (described later in detail), a port 69Ab provided in the shift position 69A, and a supply line 100 connected to the port 69Ab, thereby driving the discharge conveyor hydraulic motor 48. When the drive signal Scon is turned to an OFF-signal corresponding to the stop of the discharge conveyor 40, the discharge conveyor control valve 69 is returned to a cutoff position 68B shown in FIG. 5 by the biasing force of a spring 69*b*, whereby the discharge conveyor hydraulic motor 48 is stopped.

Similarly to the feeder control valve 68 and the discharge conveyor control valve 69, the magnetic separating device control valve 70 has a solenoid driving sector 70*a* provided with a solenoid energized by a drive signal Sm from the controller 84". When the drive signal Sm is turned to an ON-signal, the magnetic separating device control valve 70 is switched to a communication position 70A on the upper side as viewed in FIG. 5. As a result, the hydraulic fluid is supplied to the magnetic separating device hydraulic motor 60 via a throttle means 70Aa, a line 101, a pressure control valve 102 (described later in detail), a port 70Ab, and a supply line 103, thereby driving the magnetic separating device hydraulic motor 60. When the drive signal Sm is turned to an OFF-signal, the magnetic separating device control valve 70 is returned to a cutoff position 70B by the biasing force of a spring 70*b*.

From the viewpoint of circuit protection, etc. in relation to the supply of the hydraulic fluid to the feeder hydraulic motor 19, the discharge conveyor hydraulic motor 48 and the magnetic separating device hydraulic motor 60, relief valves 197, 108 and 109 are disposed respectively in lines 104, 105 and 106 connecting the supply lines 97, 100 and 103 to the reservoir line 86*b*.

A description is now made of the functions of the pressure control valves 96, 99 and 102 disposed respectively in the lines 95, 98 and 101.

The port 68Ab in the shift position 68A of the feeder control valve 68, the port 69Ab in the shift position 69A of the discharge conveyor control valve 69, and the port 70Ab in the shift position 70A of the magnetic separating device control valve 70 are communicated respectively with load detecting ports 68Ac, 69Ac and 70Ac for detecting corresponding load pressures of the feeder hydraulic motor 19, the discharge conveyor hydraulic motor 48 and the magnetic separating device hydraulic motor 60. Additionally, the load detecting port 68Ac is connected to a load detecting line 110, the load detecting port 69Ac is connected to a load detecting line 111, and the load detecting port 70Ac is connected to a load detecting line 112.

The load detecting line 110 to which the load pressure of the feeder hydraulic motor 19 is introduced and the load detecting line 111 to which the load pressure of the discharge conveyor hydraulic motor 48 is introduced are in turn connected to a load detecting line 114 through a shuttle valve 113 so that the load pressure on the higher pressure side, which is selected by the shuttle valve 113, is introduced to the load detecting line 114. Further, the load detecting line 114 and the load detecting line 112 to which the load pressure of the magnetic separating device hydraulic motor 60 is introduced are connected to a maximum load detecting line 116 through a shuttle valve 115 so that the load pressure on the higher pressure side, which is selected by the shuttle valve 115, is introduced as a maximum load pressure to the maximum load detecting line 116.

Then, the maximum load pressure introduced to the maximum load detecting line 116 is transmitted to one sides of the corresponding pressure control valves 96, 99 and 102 via lines 117, 118, 119 and 120 which are connected to the maximum load detecting line 116. At this time, pressures in the lines 95, 98 and 101, i.e., pressures downstream of the throttle means 68Aa, 69Aa and 70Aa, are introduced to the other sides of the pressure control valves 96, 99 and 102.

With such an arrangement, the pressure control valves 96, 99 and 102 are operated depending on respective differential pressures between the pressures downstream of the throttle means 68Aa, 69Aa, 70Aa of the control valves 68, 69, 70 and the maximum load pressure among the feeder hydraulic motor 19, the discharge conveyor hydraulic motor 48 and the magnetic separating device hydraulic motor 60, thereby holding the differential pressures at certain values regardless of changes in the load pressures of those hydraulic motors 19, 48 and 60. In other words, the pressures downstream of the throttle means 68Aa, 69Aa and 70Aa are held higher than the maximum load pressure by values corresponding to respective setting pressures set by springs 96*a*, 99*a* and 102*a*.

A relief valve (unloading valve) 122 provided with a spring 122*a* is disposed in a bleed-off line 121 branched from both the center bypass line 78*a* connected to the delivery line 77 of the second hydraulic pump 63 and the center line 78*b*. The maximum load pressure is introduced to one side of the relief valve 122 via the maximum load detecting line 116 and a line 123 connected to the line 116, while a pressure in the bleed-off line 121 is introduced to the other side of the relief valve 122 via a port 122*b*. With such an arrangement, the relief valve 122 holds the pressure in the line 121 and the center line 78*b* higher than the maximum load pressure by a value corresponding to a setting pressure set by the spring 122*a*. Stated another way, the relief valve 122 introduces the hydraulic fluid in the line 121 to the reservoir 86 through a pump control valve 124 when the pressure in the line 121 and the center line 78*b* reaches a pressure obtained by adding the resilient force of the spring 122*a* to the pressure in the line 123 to which the maximum load pressure is introduced. As a result, load sensing control is realized such that the delivery pressure of the second hydraulic pump 63 is held higher than the maximum load pressure by a value corresponding to the setting pressure set by the spring 122*a*.

Incidentally, the relief pressure set by the spring 122*a* in that case is set to a value smaller than the setting relief pressures of the above-described relief valves 93, 94.

Further, in the bleed-off line 121 at a position downstream of the relief valve 122, the pump control valve 124 having the flow rate—pressure converting function similar to that of the above-mentioned pump control valve 76. The pump control valve 122 comprises a piston 124*a* capable of selectively establishing and cutting off communication between a reservoir line 86*e* connected to the reservoir line 86*d* and the line 121 through a throttle portion 124*aa* thereof, springs 124*b*, 124*c* for biasing respectively opposite ends of the piston 124*a*, and a variable relief valve 124*d* which is connected at its upstream side to the delivery line 87 of the pilot pump 64 via the pilot introducing line 88*a* and a pilot introducing line 88*b* for introduction of the pilot pressure and at its downstream side to the reservoir line 86*e*, and which produces a relief pressure variably set by the spring 124*b*.

With such an arrangement, during crushing work, the pump control valve 124 functions as follows. Because the most downstream end of the center line 78*b* is closed as mentioned above and the right travel control valve 67 is not operated during the crushing work as described later, the pressure of the hydraulic fluid flowing through the center line 78*b* changes depending on respective amounts by which the feeder control valve 68, the discharge conveyor control valve 69, and the magnetic separating device control valve 70 are operated (i.e., shift stroke amounts of their spools). When those control valves 68, 69 and 70 are in neutral positions, i.e., when demand flow rates of the control valves 68, 69 and 70 demanded for the second hydraulic pump 63 (namely flow rates demanded by the hydraulic motors 19, 48 and 60) are small, most of the hydraulic fluid delivered from the second hydraulic pump 63 is not introduced to the supply lines 97, 100 and 103 and is led out, as an extra flow rate Qt2 (see FIG. 7 described later), to the downstream side through the relief valve 122, followed by being introduced to the pump control valve 124. Therefore, the hydraulic fluid is led out at a relatively large flow rate to the reservoir line 86*e* through the throttle portion 124*aa* of the piston 124*a*. As a result, the piston 124*a* is moved to the right, as viewed in FIG. 5, to reduce the setting relief pressure of the relief valve 124*d* set by the spring 124*b*, whereby a relatively low control pressure (negative control pressure) Pc2 is generated in a line 125 that is branched from the pilot introducing line 88*b* and is extended to a later-described first servo valve 132 for the negative tilting control.

Conversely, when those control valves are operated into open states, i.e., when the flow rates demanded for the second hydraulic pump 63 are large, the extra flow rate Qt2 of the hydraulic fluid flowing to the bleed-off line 121 is reduced corresponding to the flow rates of the hydraulic fluid flowing to the hydraulic motors 19, 48 and 60. Therefore, the flow rate of the hydraulic fluid led out to the reservoir line 86*e* through the piston throttle portion 124*aa* becomes relatively small, whereby the piston 124*a* is moved to the left, as viewed in FIG. 5, to increase the setting relief pressure of the relief valve 124*d*. As a result, the control pressure Pc2 in the line 125 rises. In this embodiment, as described later, a tilting angle of a swash plate 63A of the second hydraulic pump 63 is controlled in accordance with change of the control pressure Pc2 (details of this control being described later).

The pressure compensating functions of keeping constant respective differential pressures across the throttle means 68Aa, 69Aa and 70Aa are achieved by the above-described two kinds of control, i.e., the control performed by the pressure control valves 96, 99 and 102 for the differences between the pressures downstream of the throttle means 68Aa, 69Aa, 70Aa and the maximum load pressure and the control performed by the relief valve 122 for the difference between the pressure in the bleed-off line 121 and the maximum load pressure. Consequently, regardless of changes in the load pressures of the hydraulic motors 19, 48 and 60, the hydraulic fluid can be supplied to the corresponding hydraulic motors at flow rates depending on respective opening degrees of the control valves 68, 69 and 70.

Thus, as a result of the above-described pressure compensating functions and the later-described tilting angle control of the swash plate 63A of the hydraulic pump 63 in accordance with an output of the control pressure Pc2 from the pump control valve 124, the differences between the delivery pressure of the second hydraulic pump 63 and the pressures downstream of the throttle means 68Aa, 69Aa and 70Aa are held constant (as described later in more detail).

In addition, a relief valve 126 is disposed between the line 123 to which the maximum load pressure is introduced and the reservoir line 86*e* to limit the maximum pressure in the line 123 to be not higher than the setting pressure of a spring 126*a* for the purpose of circuit protection. Stated another way, the relief valve 126 and the above-mentioned relief valve 122 constitute a system relief valve such that, when the pressure in the line 123 becomes higher than the pressure set by the spring 126*a*, the pressure in the line 123 lowers to the reservoir pressure under the action of the relief valve 126, whereupon the above-mentioned relief valve 122 is operated to come into a relief state.

The regulator units 71, 72 comprise respectively tilting actuators 129, 130, first servo valves 131, 132, and second servo valves 133, 134. These servo valves 131 to 134 control the pressures of the hydraulic fluids supplied from the pilot pump 64 and the first and second hydraulic pumps 62, 63 to act upon tilting actuators 129, 130, thereby controlling tilting (i.e., displacement) of each of the swash plates 62A, 63A of the first and second hydraulic pumps 62, 63.

The tilting actuators 129, 130 comprise respectively working pistons 129*c*, 130*c* having large-diameter pressure bearing portions 129*a*, 130*a* and small-diameter pressure bearing portions 129*b*, 130*b* formed at opposite ends thereof, and pressure bearing chambers 129*d*, 129*e*; 130*d*, 130*e* in which the pressure bearing portions 129*a*, 129*b*; 130*a*, 130*b* are positioned respectively. When the pressures in both the pressure bearing chambers 129*d*, 129*e*; 130*d*, 130*e* are equal to each other, the working piston 129*c*, 130*c* is moved to the right, as viewed in FIG. 6, due to the difference in pressure bearing area, thus resulting in larger tilting of the swash plate 62A, 63A and an increase of each pump delivery rate Q1, Q2. Also, when the pressure in the large-diameter side pressure bearing chamber 129*d*, 130*d* lowers, the working piston 129*c*, 130*c* is moved to the left as viewed in FIG. 6, thus resulting in smaller tilting of the swash plate 62A, 63A and a decrease of each pump delivery rate Q1, Q2. Additionally, the large-diameter side pressure bearing chambers 129*d*, 130*d* are connected via the first and second servo valves 131 to 134 to a line 135 communicating with the delivery line 87 of the pilot pump 64, and the small-diameter side pressure bearing chambers 129*e*, 130*e* are directly connected to the line 135.

Of the first servo valves 131, 132, the first servo valve 131 of the regulator unit 71 is, as described above, a servo valve for the negative tilting control, which is driven by the control pressure (negative control pressure) Pc1 from the pump control valve 76, and the first servo valve 132 of the regulator unit 72 is, as described above, a servo valve for the negative tilting control, which is driven by the control pressure Pc2 from the pump control valve 124. Both the first servo valves 131, 132 have the same structure.

More specifically, when the control pressure Pc1, Pc2 is high, a valve member 131*a*, 132*a* is moved to the right as viewed in FIG. 6 and a pilot pressure Pp1 from the pilot pump 64 is transmitted to the pressure bearing chamber 129*d*, 130*d* of the tilting actuator 129, 130 without being reduced, thus resulting in larger tilting of the swash plate 62A, 63A and an increase of the respective delivery rates Q1, Q2 of the first and second hydraulic pumps 62, 63. Then, as the control pressure Pc1, Pc2 lowers, the valve member 131*a*, 132*a* is moved to the left, as viewed in FIG. 6, by the force of a spring 131*b*, 132*b*. Therefore, the pilot pressure Pp1 from the pilot pump 64 is transmitted to the pressure bearing chamber 129*d*, 130*d* after being reduced, thereby reducing the respective delivery rates Q1, Q2 of the first and second hydraulic pumps 62, 63.

Thus, with the first servo valve 131 of the regulator unit 71, the so-called negative control is realized such that the tilting (delivery rate) of the swash plate 62A of the first hydraulic pump 62 is controlled, in combination with the above-described function of the pump control valve 76, so as to obtain the delivery rate Q1 corresponding to the flow rates demanded by the control valves 65, 66, more practically, to minimize the flow rate of the hydraulic fluid flowing in from the center bypass line 75 and passing through the pump control valve 76.

Also, with the first servo valve 132 of the regulator unit 72, the so-called negative control is realized such that the tilting (delivery rate) of the swash plate 63A of the second hydraulic pump 63 is controlled, in combination with the function of the pump control valve 124, so as to obtain the delivery rate Q2 corresponding to the flow rates demanded by the control valves 67, 68, 69 and 70, more practically, to minimize the flow rate of the hydraulic fluid flowing in from the center bypass line 78*a* and passing through the pump control valve 124.

Control characteristics of the pump delivery rates, which are realized by the pump control valves 76, 124 and the regulator units 71, 72 based on the above-described arrangement, will be described below with reference to FIGS. 7 and 8.

Figure 7:
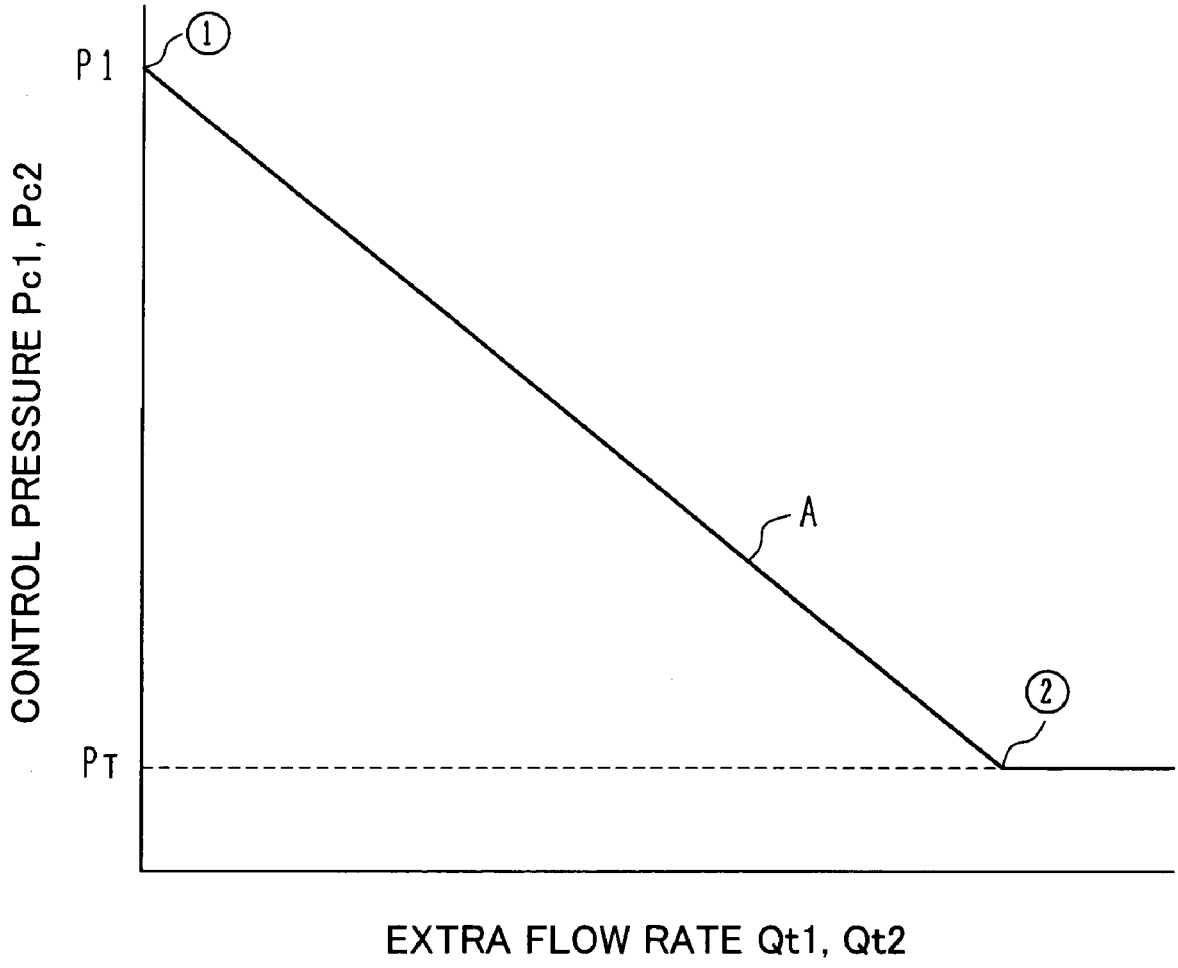
FIG. 7 is a graph representing the relationship between an extra flow rate of a hydraulic fluid delivered from a first hydraulic pump and introduced to a piston throttle portion of a pump control valve via a center bypass line or an extra flow rate of a hydraulic fluid delivered from a second hydraulic pump and introduced to a piston throttle portion of another pump control valve via a relief valve and a control pressure produced by the function of a variable relief valve of the pump control valve at the same time in one embodiment of the self-propelled crushing machine of the present invention.

FIG. 7 is a graph representing the relationship between the extra flow rate Qt1 of the hydraulic fluid delivered from the first hydraulic pump 62 and introduced to the piston throttle portion 76*aa* of the pump control valve 76 via the center bypass line 75 or the extra flow rate Qt2 of the hydraulic fluid delivered from the second hydraulic pump 63 and introduced to the piston throttle portion 124*aa* of the pump control valve 124 via the relief valve 122 and the control pressure Pc1, Pc2 produced by the function of the variable relief valve 76*d*, 124*d* of the pump control valve 76, 124 at the same time. Also, FIG. 8 is a graph representing the relationship between the control pressure Pc1, Pc2 and the pump delivery rate Q1, Q2 of the first or second hydraulic pump 62, 63.

Figure 8:
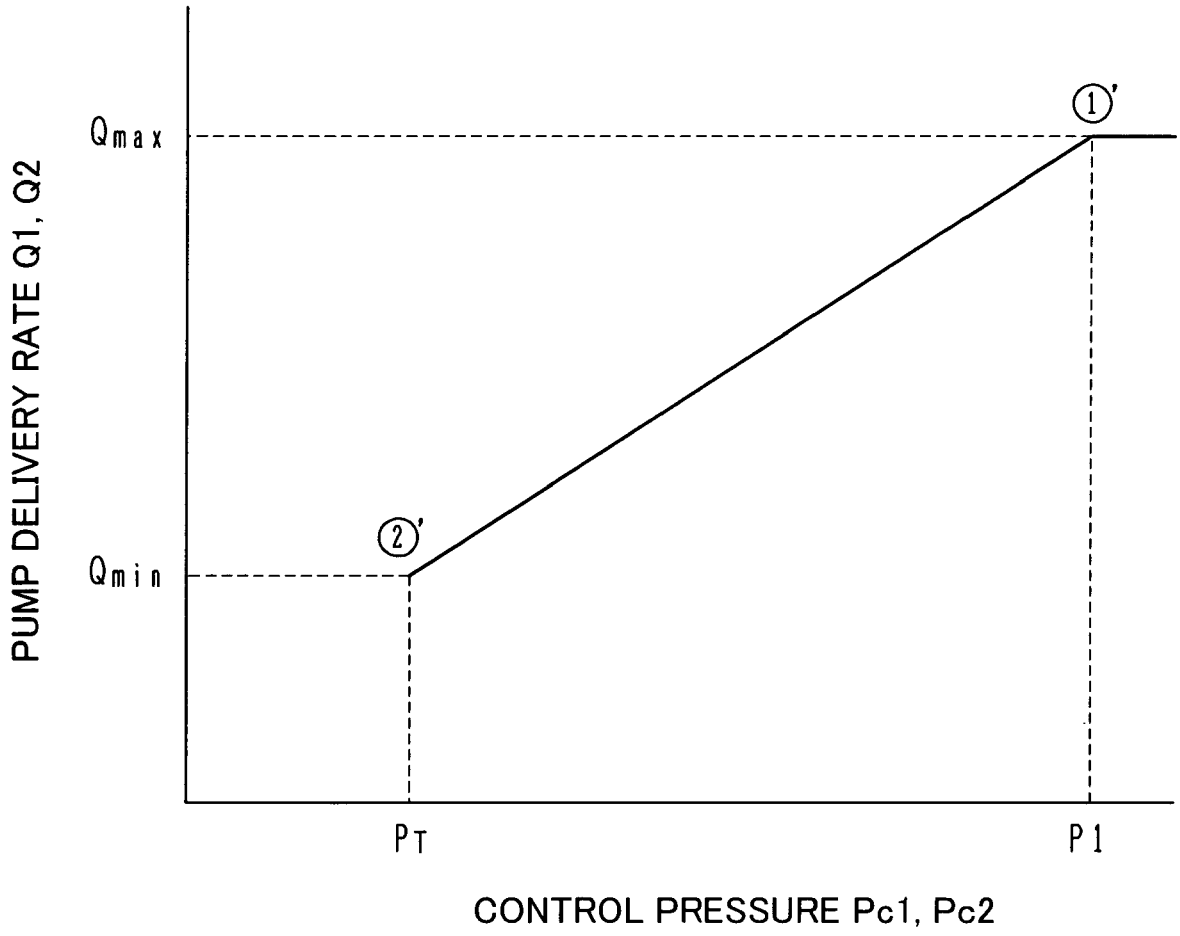
FIG. 8 is a graph representing the relationship between the control pressure and a pump delivery rate of the first or second hydraulic pump in one embodiment of the self-propelled crushing machine of the present invention.

As seen from the graphs of FIGS. 7 and 8, when the flow rates demanded by the control valves 65, 66 (or the control valves 67, 70, 69 and 68; this correspondence relation is similarly applied to the following description) are large and there is no extra flow rate Qt1 (or no extra flow rate Qt2) from the first hydraulic pump 62 (or the second hydraulic pump 63) to the pump control valve 76 (or the pump control valve 124), the control pressure Pc1 (or the control pressure Pc2) takes a maximum value P1 (indicated by a point ① in FIG. 7). Consequently, the pump delivery rate Q1 (or the pump delivery rate Q2) takes a maximum value Qmax as indicated by a point ①' in FIG. 8.

When the flow rates demanded by the control valves 65, 66 (or the control valves 67, 70, 69 and 68; this correspondence relation is similarly applied to the following description) are reduced and the extra flow rate Qt1 (or Qt2) from the first hydraulic pump 62 (or the second hydraulic pump 63) to the pump control valve 76 (or the pump control valve 124) increases, the control pressure Pc1 (or the control pressure Pc2) lowers substantially linearly from the maximum value P1 as indicated by a solid line A in FIG. 7. Consequently, as shown in FIG. 8, the pump delivery rate Q1 (or the pump delivery rate Q2) also decreases substantially linearly from the maximum value Qmax.

Then, when the extra flow rate Qt1 (or Qt2) further increases and the control pressure Pc1 (or Pc2) lowers to a reservoir pressure $P_T$ (indicated by a point ② in FIG. 7) with a further reduction of the flow rates demanded by the control valves 65, 66 (or the control valves 67, 70, 69 and 68) in FIG. 7, the pump delivery rate Q1 (or the pump delivery rate Q2) takes a minimum value Qmin as indicated by a point ②' in FIG. 8. After that, the variable relief valve 76*d*, 124*d* is held in a fully open state. Regardless of a further increase of the extra flow rate Qt1 (or Qt2), the control pressure Pc1 (or Pc2) is held at the reservoir pressure $P_T$ and the pump delivery rate Q1 (or Q2) is also held at the minimum value Qmin (indicated by the point ②' in FIG. 8).

As a result, the negative control for controlling the tilting of the swash plate 62A of the first hydraulic pump 62 so as to obtain the delivery rate Q1 corresponding to the flow rates demanded by the control valves 65, 66, and the negative control for controlling the tilting of the swash plate 63A of the second hydraulic pump 63 so as to obtain the delivery rate Q2 corresponding to the flow rates demanded by the control valves 67, 70, 69 and 68 can be realized as described above.

Returning to FIGS. 4 to 6, the second servo valves 133, 134 are each a servo valve for input torque limiting control and have the same structure. In other words, the second servo valves 133, 134 are operated by respective delivery pressures P1, P2 of the first and second hydraulic pumps 62, 63, and the delivery pressures P1, P2 are introduced respectively to pressure bearing chambers 133*b*, 133*c* of an operation driving sector 133*a* and pressure bearing chambers 134*c*, 134*b* of an operation driving sector 134*a* via delivery pressure detecting lines 136*a-c* and 137*a-c* which are branched from the delivery lines 74, 77 of the first and second hydraulic pumps 62, 63.

More specifically, when a force acting upon the operation driving sector 133*a*, 134*a* based on the sum P1+P2 of the delivery pressures of the first and second hydraulic pumps 62, 63 is smaller than a force acting upon a valve member 133*e*, 134*e* based on a resilient force set by a spring 133*d*, 134*d*, the valve member 133*e*, 134*e* is moved to the right as viewed in FIG. 6, whereupon the pilot pressure Pp1 introduced from the pilot pump 64 via the first servo valve 131, 132 is transmitted to the pressure bearing chamber 129*d*, 130*d* of the tilting actuator 129, 130 without being reduced, thus resulting in larger tilting of each of the swash plates 62A, 63A of the first and second hydraulic pumps 62, 63 and an increase of the respective delivery rates thereof.

Then, as the force acting based on the sum P1+P2 of the delivery pressures of the first and second hydraulic pumps 62, 63 increases beyond the force acting based on the setting value of the resilient force set by the spring 133*d*, 134*d*, the valve member 133*e*, 134*e* is moved to the left as viewed in FIG. 6, whereupon the pilot pressure Pp1 introduced from the pilot pump 64 via the first servo valve 131, 132 is transmitted to the pressure bearing chamber 129*d*, 130*d* of the tilting actuator 129, 130 after being reduced, thereby reducing the delivery rate of each of the first and second hydraulic pump 62, 63.

In this way, the so-called input torque limiting control (horsepower control) is realized in which the tilting of each swash plate 62A, 63A of the first and second hydraulic pumps 62, 63 is controlled such that, as the delivery pressures P1, P2 of the first and second hydraulic pumps 62, 63 rise, the maximum values Q1max, Q2max of the delivery rates Q1, Q2 of the first and second hydraulic pumps 62, 63 are limited to lower levels, and a total of the input torques of the first and second hydraulic pumps 62, 63 is limited to be not larger than the output torque of the engine 61. At that time, more particularly, the so-called total horsepower control is realized such that, depending on the sum of the delivery pressure P1 of the first hydraulic pump 62 and the delivery pressure P2 of the second hydraulic pump 63, a total of the input torques of the first and second hydraulic pumps 62, 63 is limited to be not larger than the output torque of the engine 61.

In this embodiment, the first hydraulic pump 62 and the second hydraulic pump 63 are both controlled in accordance with substantially the same characteristics. Stated another way, the relationship between the sum P1+P2 of the delivery pressures of the first and second hydraulic pumps 62, 63 and the maximum value Q1max of the delivery rate Q1 of the first hydraulic pump 62 resulting when the first hydraulic pump 62 is controlled by the second servo valve 133 of the regulator unit 71 and the relationship between the sum P1+P2 of the delivery pressures of the first and second hydraulic pumps 62, 63 and the maximum value Q2max of the delivery rate Q2 of the second hydraulic pump 63 resulting when the second hydraulic pump 63 is controlled by the second servo valve 134 of the regulator unit 72 are set substantially identical to each other (within a deviation width of, e.g., about 10%). Further, the maximum values Q1max, Q2max of the delivery rates Q1, Q2 of the first and second hydraulic pumps 62, 63 are limited to values substantially equal to each other (within a deviation width of, e.g., about 10%).

The control panel 73 includes a crusher start/stop switch 73*a* for starting and stopping the crushing device 20, a crusher forward/reverse rotation select dial 73*b* for selecting whether the crushing device 20 is operated in the forward or reverse direction, a feeder start/stop switch 73*c* for starting and stopping the feeder 15, a discharge conveyor start/stop switch 73*d* for starting and stopping the discharge conveyor 40, a magnetic separating device start/stop switch 73*e* for starting and stopping the magnetic separating device 55, and a mode select switch 73*f* for selecting one of a travel mode in which travel operation is performed and a crushing mode in which crushing work is performed.

When an operator manipulates any of those various switches and dial on the control panel 73, a resulting operation signal is inputted to the controller 84". In accordance with the operation signal from the control panel 73, the controller 84" produces corresponding one of the drive signals Scr, Sf, Scon, Sm and St for the solenoid driving sectors 65*a*, 65*b*, the solenoid driving sector 68*a*, the solenoid driving sector 69*a*, the solenoid driving sector 70*a* and the solenoid 85*a* of the crushing device control valve 65, the feeder control valve 68, the discharge conveyor control valve 69, the magnetic separating device control valve 70 and the solenoid control valve 85, and then outputs the produced drive signal to the corresponding solenoid.

More specifically, when the "travel mode" is selected by the mode select switch 73*f* of the control panel 73, the drive signal St for the solenoid control valve 85 is turned ON to switch the solenoid control valve 85 into the communication position 85A on the left side as viewed in FIG. 6, thus enabling the travel control valves 66, 67 to be operated respectively by the control levers 36*a*, 37*a*. When the "crushing mode" is selected by the mode select switch 73*f* of the control panel 73, the drive signal St for the solenoid control valve 85 is turned OFF to return the solenoid control valve 85 into the cutoff position 85B on the right side as viewed in FIG. 6, thus disabling the operation of the travel control valves 66, 67 respectively by the control levers 36*a*, 37*a*.

Also, when the crusher start/stop switch 73*a* is pushed to the "start" side in a state that the "forward rotation" (or the "reverse rotation"; this directional correspondence is similarly applied to the following description) is selected by the crusher forward/reverse rotation select dial 73*b* of the control panel 73, the drive signal Scr for the solenoid driving sector 65*a* (or the solenoid driving sector 65*b*) of the crushing device control valve 65 is turned ON and the drive signal Scr for the solenoid driving sector 65*b* (or the solenoid driving sector 65*a*) is turned OFF, whereby the crushing device control valve 65 is switched to the shift position 65A on the upper side as viewed in FIG. 4 (or the shift position 65B on the lower side). As a result, the hydraulic fluid from the first hydraulic pump 62 is supplied to the crushing device hydraulic motor 21 for driving it, thus causing the crushing device 20 to start operation in the forward direction (or in the reverse direction).

Then, when the crusher start/stop switch 73*a* is pushed to the "stop" side, the drive signals Scr for the solenoid driving sector 65*a* and the solenoid driving sector 65*b* of the crushing device control valve 65 are both turned OFF, whereby the crushing device control valve 65 is returned to its neutral position shown in FIG. 4. As a result, the crushing device hydraulic motor 21 is stopped and the crushing device 20 is also stopped.

Further, when the feeder start/stop switch 73*c* of the control panel 73 is pushed to the "start" side, the drive signal Sf for the solenoid driving sector 68*a* of the feeder control valve 68 is turned ON, whereby the feeder control valve 68 is switched to the shift position 68A on the upper side as viewed in FIG. 5. As a result, the hydraulic fluid from the second hydraulic pump 63 is supplied to the feeder hydraulic motor 19 for driving it, thus causing the feeder 15 to start operation. Then, when the feeder start/stop switch 73*c* of the control panel 73 is pushed to the "stop" side, the drive signal Sf for the solenoid driving sector 68*a* of the feeder control valve 68 is turned OFF, whereby the feeder control valve 68 is returned to its neutral position shown in FIG. 5. As a result, the feeder hydraulic motor 19 is stopped and the feeder 15 is also stopped.

Similarly, when the discharge conveyor start/stop switch 73*d* is pushed to the "start" side, the discharge conveyor control valve 69 is switched to the shift position 69A on the upper side as viewed in FIG. 5, whereby the discharge conveyor hydraulic motor 48 is driven to start operation of the discharge conveyor 40. When the discharge conveyor start/stop switch 73*d* is pushed to the "stop" side, the discharge conveyor control valve 69 is returned to its neutral position, whereby the discharge conveyor 40 is stopped.

Also, when the magnetic separating device start/stop switch 73*e* is pushed to the "start" side, the magnetic separating device control valve 70 is switched to the shift position 70A on the upper side as viewed in FIG. 5, whereby the magnetic separating device hydraulic motor 60 is driven to start operation of the magnetic separating device 55. When the magnetic separating device start/stop switch 73*e* is pushed to the "stop" side, the magnetic separating device control valve 70 is returned to its neutral position, whereby the magnetic separating device 55 is stopped.

Here, the most important feature of this embodiment is that the engine load status is detected by detecting the respective delivery pressures of the first and second hydraulic pumps 62, 63, and the revolution speed of the engine 61 is increased when an average value of those delivery pressures exceeds a predetermined threshold. This feature will be described in more detail below.

In FIGS. 4 to 6, numeral 138 denotes a fuel injector (governor) for injecting fuel to the engine 61, and 139 denotes a fuel injection control unit for controlling the amount of fuel injected from the fuel injector 138. Also, numerals 151, 152 denote pressure sensors. These pressure sensors 151, 152 are disposed respectively in a pressure introducing line 153 branched from the delivery line 74 of the first hydraulic pump 62 and a pressure introducing line 154 branched from the delivery line 77 of the second hydraulic pump 63 (or they may be disposed, as another example, respectively in the delivery pressure detecting lines 136*b*, 137*c* as indicated by two-dot-chain lines in FIG. 6). The pressure sensors 151, 152 output the detected respective delivery pressures P1, P2 of the first and second hydraulic pumps 62, 63 to the controller 84". After receiving the delivery pressures P1, P2, the controller 84" outputs a horsepower increasing signal Sen' corresponding to the inputted delivery pressures P1, P2 to the fuel injection control unit 139. In accordance with the inputted horsepower increasing signal Sen', the fuel injection control unit 139 performs horsepower increasing control to increase the amount of fuel injected from the fuel injector 138 to the engine 61.

Figure 9:
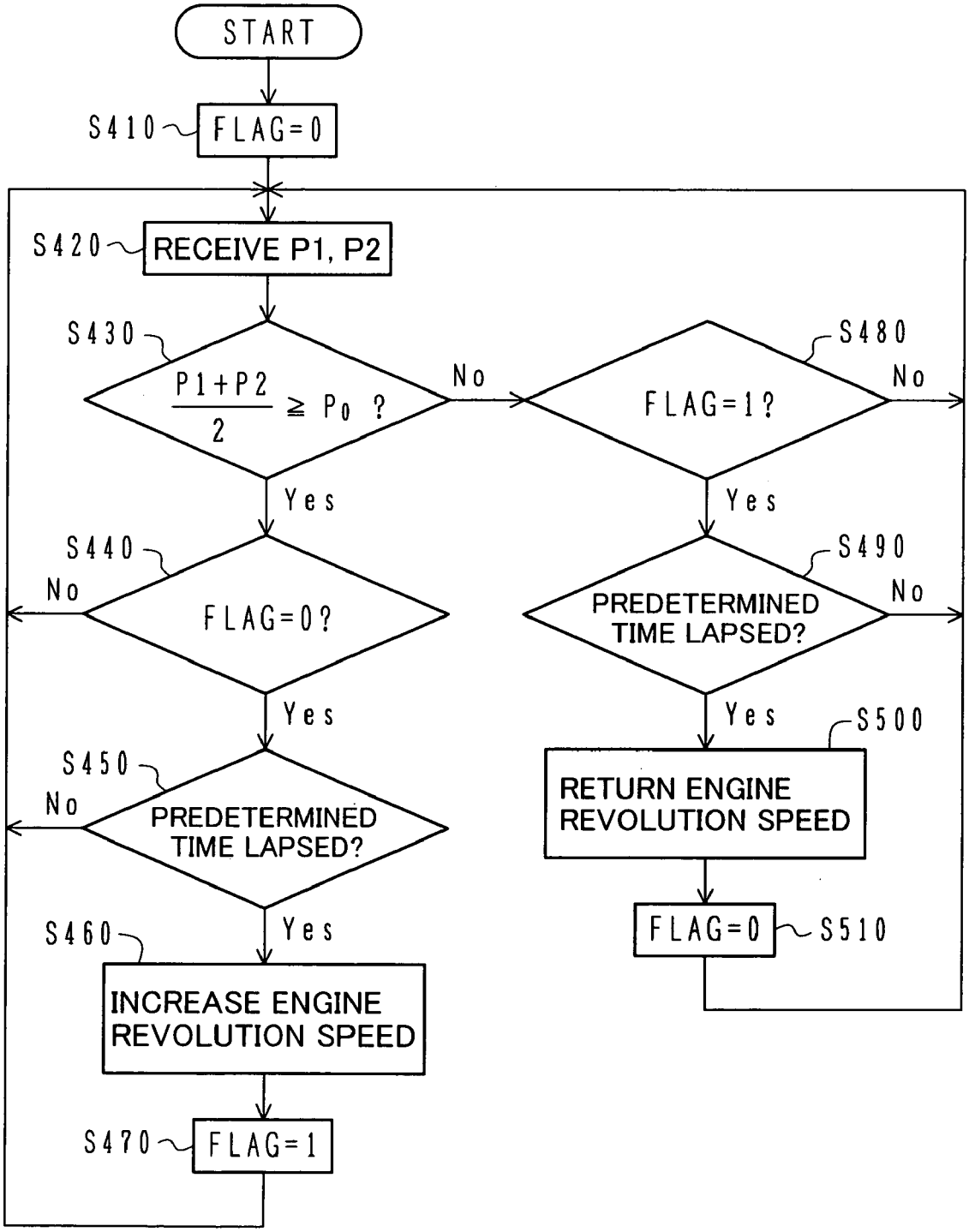
FIG. 9 is a flowchart showing control procedures related to engine horsepower increasing control in the functions of a controller constituting one embodiment of a self-propelled crushing machine of the present invention.

FIG. 9 is a flowchart showing control procedures related to that horsepower increasing control of the engine 61 in the functions of the controller 84". The controller 84" starts the flow shown in FIG. 9 when a power supply is turned on by, e.g., the operator, and it brings the flow into an end when the power supply is turned off.

Referring to FIG. 9, a flag indicating whether the horsepower increasing control of the engine 61 is performed by the controller 84" is first cleared in step 410 to 0 that indicates a state not under the control. Then, the flow proceeds to next step 420.

In step 420, the controller receives the delivery pressures P1, P2 of the first and second hydraulic pumps 62, 63, which are detected by the pressure sensors 151, 152, followed by proceeding to next step 430.

In step 430, after calculating an average value (P1+P2)/2 of the delivery pressures P1, P2 inputted in step 420, it is determined whether the average value is not smaller than a threshold $P_0$. This threshold $P_0$ is an average value of the delivery pressures P1, P2 of the first and second hydraulic pumps resulting when the load imposed on the engine 61 increases and the delivery rate Q1 of the first hydraulic pump 62 reduces (i.e., when the crushing efficiency starts to decline). The threshold $P_0$ is stored, for example, in the controller 84" in advance (alternatively, it may be entered and set from an external terminal as required). If the average value of the delivery pressures P1, P2 is not smaller than the threshold $P_0$, the determination is satisfied and the flow proceeds to next step 440.

In step 440, it is determined whether the above-mentioned flag is at 0 indicating the state in which the horsepower increasing control of the engine 61 is not performed. If the flag is at 1, the determination is not satisfied and the flow returns to step 420. On the other hand, if the flag is at 0, the determination is satisfied and the flow proceeds to next step 450.

In step 450, it is determined whether the state in which the average value (P1+P2)/2 of the delivery pressures P1, P2 is not smaller than the threshold $P_0$ has lapsed for a predetermined time. This predetermined time is stored, for example, in the controller 84" in advance (alternatively, it may be entered and set from an external terminal as required). If the predetermined time has not lapsed, the determination is not satisfied and the flow returns to step 420. On the other hand, if the predetermined time has lapsed, the determination is satisfied and the flow proceeds to next step 460.

In step 460, the controller 84" outputs the horsepower increasing signal Sen' to the fuel injection control unit 139, thus causing the fuel injection control unit 139 to increase the amount of fuel injected from the fuel injector 138 to the engine 61. As a result, the revolution speed of the engine 61 is increased.

In next step 470, the flat is set to 1 indicating the state in which the horsepower increasing control of the engine 61 is performed. Then, the flow returns to step 420.

Meanwhile, if it is determined in step 430 that the average value of the delivery pressures P1, P2 is smaller than the threshold $P_0$, the determination is not satisfied and the flow proceeds to step 480.

In step 480, it is determined whether the above-mentioned flag is at 1 indicating the state in which the horsepower increasing control of the engine 61 is performed. If the flag is at 0, the determination is not satisfied and the flow returns to step 420. On the other hand, if the flag is at 1, the determination is satisfied and the flow proceeds to next step 490.

In step 490, it is determined whether the state in which the average value (P1+P2)/2 of the delivery pressures P1, P2 is smaller than the threshold $P_0$ has lapsed for a predetermined time. This predetermined time is stored, for example, in the controller 84" in advance (alternatively, it may be entered and set from an external terminal as required). If the predetermined time has not lapsed, the determination is not satisfied and the flow returns to step 420. On the other hand, if the predetermined time has lapsed, the determination is satisfied and the flow proceeds to next step 500.

In step 500, the controller 84" turns OFF the horsepower increasing signal Sen' outputted to the fuel injection control unit 139, whereupon the fuel injection control unit 139 controls the amount of fuel injected from the fuel injector 138 to the engine 61 to be returned to the original amount. As a result, the revolution speed of the engine 61 is returned to the same speed as that before it has been increased.

In the above description, the feeder 15, the discharge conveyor 40 and the magnetic separating device 55 each constitute at least one auxiliary for performing work related to the crushing work performed by the crushing device set forth in claims. The feeder hydraulic motor 19, the discharge conveyor hydraulic motor 48, and the magnetic separating device hydraulic motor 60 constitute auxiliary hydraulic actuators for driving respective auxiliaries. The first hydraulic pump 62 constitutes at least one hydraulic pump for driving the crushing device hydraulic motor, and also constitutes a first hydraulic pump for driving the crushing device hydraulic motor. The second hydraulic pump 63 constitutes a second hydraulic pump for driving the auxiliary hydraulic actuator.

Also, the pressure sensor 151 constitutes crushing device load detecting means for detecting the load status of the crushing device. The pressure sensor 151 and the delivery pressure detecting lines 136*a-c* constitute first delivery pressure detecting means for detecting the delivery pressure of the first hydraulic pump. The delivery pressure detecting lines 137*a-c* and the pressure sensor 152 constitute second delivery pressure detecting means for detecting the delivery pressure of the second hydraulic pump. Further, the controller 84" constitutes control means for executing control to increase the revolution speed of the prime mover in accordance with a detected signal from the crushing device load detecting means. The controller 84" and the regulator units 71, 72 constitute control means for controlling the delivery rates of the first hydraulic pump and the second hydraulic pump in accordance with a detected signal from the first delivery pressure detecting means and a detected signal from the second delivery pressure detecting means such that a total of input torques of the first hydraulic pump and the second hydraulic pump is held not larger than an output torque of the prime mover, and for executing control to increase the revolution speed of the prime mover in accordance with both the detected signals from the first delivery pressure detecting means and the second delivery pressure detecting means.

Next, the operation of the thus-constructed one embodiment of the self-propelled crushing machine of the present invention will be described below.

In the self-propelled crushing machine having the above-described arrangement, when starting the crushing work, the operator first selects the "crushing mode" by the mode select switch 73*f* of the control panel 37 to disable the travel operation, and then pushes the magnetic separating device start/stop switch 73*e*, the discharge conveyor start/stop switch 73*d*, the crusher start/stop switch 73*a*, and the feeder start/stop switch 73*c* to the "start" side successively.

With such manipulation, the drive signal Sm outputted from the controller 84 to the solenoid driving sector 70*a* of the magnetic separating device control valve 70 is turned ON, and the magnetic separating device control valve 70 is switched to the shift position 70A on the upper side as viewed in FIG. 5. Also, the drive signal Scon outputted from the controller 84 to the solenoid driving sector 69*a* of the discharge conveyor control valve 69 is turned ON, and the discharge conveyor control valve 69 is switched to the shift position 69A on the upper side as viewed in FIG. 5. Further, the drive signal Scr outputted from the controller 84 to the solenoid driving sector 65*a* of the crushing device control valve 65 is turned ON and the drive signal Scr outputted to the solenoid driving sector 65*b* thereof is turned OFF, whereby the crushing control valve 65 is switched to the shift position 65A on the upper side as viewed in FIG. 4. In addition, the drive signal Sf outputted to the solenoid driving sector 68*a* of the feeder control valve 68 is turned ON, and the feeder control valve 68 is switched to the shift position 68A on the upper side as viewed in FIG. 5.

As a result, the hydraulic fluid from the second hydraulic pump 63 is introduced to the center bypass line 78*a* and the center line 78*b*, and then supplied to the magnetic separating device hydraulic motor 60, the discharge conveyor hydraulic motor 48 and the feeder hydraulic motor 19, thereby starting respective operations of the magnetic separating device 55, the discharge conveyor 40, and the feeder 15. On the other hand, the hydraulic fluid from the first hydraulic pump 62 is supplied to the crushing device hydraulic motor 21, thereby causing the crushing device 20 to start operation in the forward direction.

Then, when target materials to be crushed are loaded into the hopper 12 by using, e.g., a hydraulic excavator, the target materials received in the hopper 12 are carried by the feeder 15. At this time, the materials (such as accompanying debris) smaller than the gaps between the comb teeth of the comb-like plates 17 are guided onto the discharge conveyor 40 through the chute 14 after passing the gaps of the comb teeth, while the materials larger than the gaps are carried to the crushing device 20. The target materials carried to the crushing device 20 are crushed by the fixed teeth and the moving teeth into a predetermined grain size and then dropped onto the discharge conveyor 40 disposed under the crushing device 20. The crushed materials, the accompanying debris, etc. having been guided onto the discharge conveyor 40 are carried rearward (to the right as viewed in FIG. 1). After foreign matters, such as iron reinforcing rods, have been attracted and removed by the magnetic separating device 55 during the carrying on the discharge conveyor 40, the crushed materials and so on are finally discharged to the outside of the machine.

In the crushing work performed through the foregoing procedures, the controller 84" starts the engine horsepower increasing control shown in the flow of FIG. 9, as described above, from the point in time when the power supply of the controller 84 is turned on by the operator.

More specifically, after setting the flag to 0 in step 410, the controller receives in step 420 the delivery pressures P1, P2 of the first and second hydraulic pumps 62, 63, which are outputted from the pressure sensors 151, 152, and determines in step 430 whether the average value of the delivery pressures P1, P2 is not smaller than the threshold $P_0$. Here, when the load imposed on the engine 61 is an ordinary load value, the average value of the first and second hydraulic pump delivery pressures P1, P2 is smaller than the threshold $P_0$, and therefore the determination in step 430 is not satisfied. Further, because of the flag being at 0, the determination in next step 480 is also not satisfied, and hence the flow returns to step 420. In this way, during the crushing work performed under the ordinary engine load, the flow of step 420→step 430→step 480→step 420 is repeated.

Assuming now the case that the load pressure of the crushing device hydraulic motor 21 is increased during the crushing work due to, e.g., excessive supply of the target materials (materials to be crushed) and the load imposed on the engine 61 is also increased, the average value of the delivery pressures P1, P2 of the first and second hydraulic pumps 62, 63 exceeds the threshold $P_0$ and the determination in step 430 is satisfied. At this time, because of the flag being at 0, the determination in next step 440 is also satisfied, and the flow proceeds to step 450. Then, the flow of step 450 step→420→step 450 is repeated until a predetermined time is lapsed. If the state in which the average value of the delivery pressures P1, P2 is not smaller than the threshold $P_0$ continues for the predetermined time, the determination in step 450 is satisfied, and the flow proceeds to step 460 where the controller 84" outputs the horsepower increasing signal Sen' to the fuel injection control unit 139. As a result, the fuel injection control unit 139 increases the amount of fuel injected from the fuel injector 138 to the engine 61, whereby the revolution speed of the engine 61 is increased. Then, the flag is set to 1 in next step 470.

With the engine horsepower increasing control executed by the controller 84" in such a way, the crushing work is performed in the state in which the revolution seed of the engine 61 has increased, while repeating the flow of step 420→step 440→step 420. When the average value of the delivery pressures P1, P2 becomes smaller than the threshold $P_0$ with the continued crushing work, the determination in step 430 is not satisfied, and the flow proceeds to step 480. At this time, because of the flag being set to 1, the determination in step 480 is satisfied, and the flow proceeds to step 490. Then, the flow of step 490→step 420→step 430 step→480→step 490 is repeated until the state in which the average value of the delivery pressures P1, P2 is smaller than the threshold $P_0$ continues for a predetermined time. After the lapse of the predetermined time, the determination in step 490 is satisfied, and the flow proceeds to next step 500. In step 500, the controller 84" turns OFF the horsepower increasing signal Sen' outputted to the fuel injection control unit 139. As a result, the amount of fuel injected from the fuel injector 138 to the engine 61 is returned to the original amount and the revolution speed of the engine 61 is returned to the original speed. The flag is then reset to 0 in next step 510.

With one embodiment of the self-propelled crushing machine of the present invention which has the above-described arrangement and operation, the total horsepower control is performed such that the horsepower of the engine 61 is distributed to the first and second hydraulic pumps 62, 63 depending on the difference between their loads, and that the engine horsepower can be effectively utilized to perform the crushing work with high efficiency. In this connection, in the case that the load pressure of the crushing device hydraulic motor 21 is so increased during the crushing work due to, e.g., excessive supply of the target materials (materials to be crushed) as not to follow the increased load pressure even with the total horsepower control for increasing the engine horsepower distributed to the side of the first hydraulic pump 62, and that the rotational speed of the crushing device hydraulic motor 21 is reduced because of deficiency of the engine horsepower, the overload condition of the engine 61 is detected by the pressure sensors 151, 152 upon detecting the respective delivery pressures P1, P2 of the first and second hydraulic pumps 62, 63, and the controller 84" outputs the horsepower increasing signal Sen' to the fuel injection control unit 139, thereby increasing the amount of fuel injected from the fuel injector 138 to the engine 61 and increasing the revolution speed of the engine 61. As a result, by increasing the revolution speed of the engine 61 and hence the engine horsepower in the engine overload condition (i.e., the overload condition of the crushing device 20), it is possible to prevent a lowering of the rotational speed of the crushing device hydraulic motor 21 and to prevent a reduction in the crushing efficiency of the self-propelled crushing machine.

Figure 10:
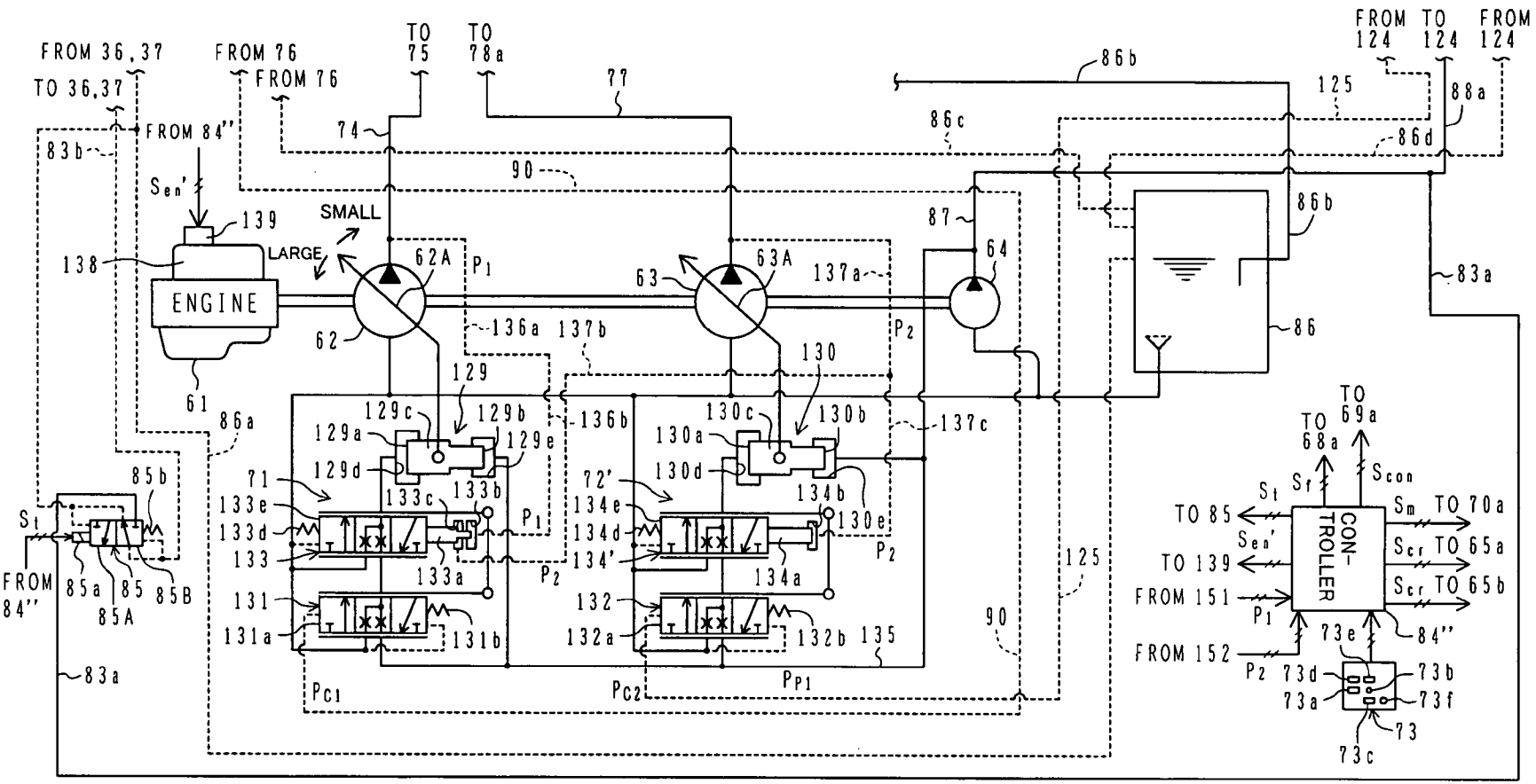
FIG. 10 is a hydraulic circuit diagram showing an arrangement around the first and second hydraulic pumps in the overall arrangement of the hydraulic drive system provided in a first modification of one embodiment of the self-propelled crushing machine of the present invention.

While, in the above-described one embodiment, the first and second hydraulic pumps 62, 63 are subjected to the total horsepower control depending on not only their own delivery pressures P1, P2, but also both of the delivery pressures P1, P2, the present invention is not limited to such design and the total horsepower control may not be executed. For example, the arrangement may be modified as shown in FIG. 10. More specifically, the delivery pressures P1, P2 of the first and second hydraulic pumps 62, 63 are both introduced to the first servo valve 133 via the delivery pressure detecting lines 136*a*, 137*a* and 137*b*, whereas only the delivery pressure P2 of the second hydraulic pump 63 is introduced to a second servo valve 134' via the delivery pressure detecting lines 137*a* and 137*c*. Thereby, the first hydraulic pump 62 executes the tilting control depending on both the delivery pressures P1, P2, and the second hydraulic pump 63 executes the tilting control depending on only its own delivery pressures P2. In that modification, regulators 71, 72' constitute control means for controlling the delivery rates of the first hydraulic pump and the second hydraulic pump.

The present invention is also applicable to a self-propelled crushing machine executing the so-called speed sensing control in which the input torques of the first and second hydraulic pumps 62, 63 are controlled in accordance with an increase or decrease of an engine revolution speed N. Such a second modification will be described in detail below.

Figure 11:
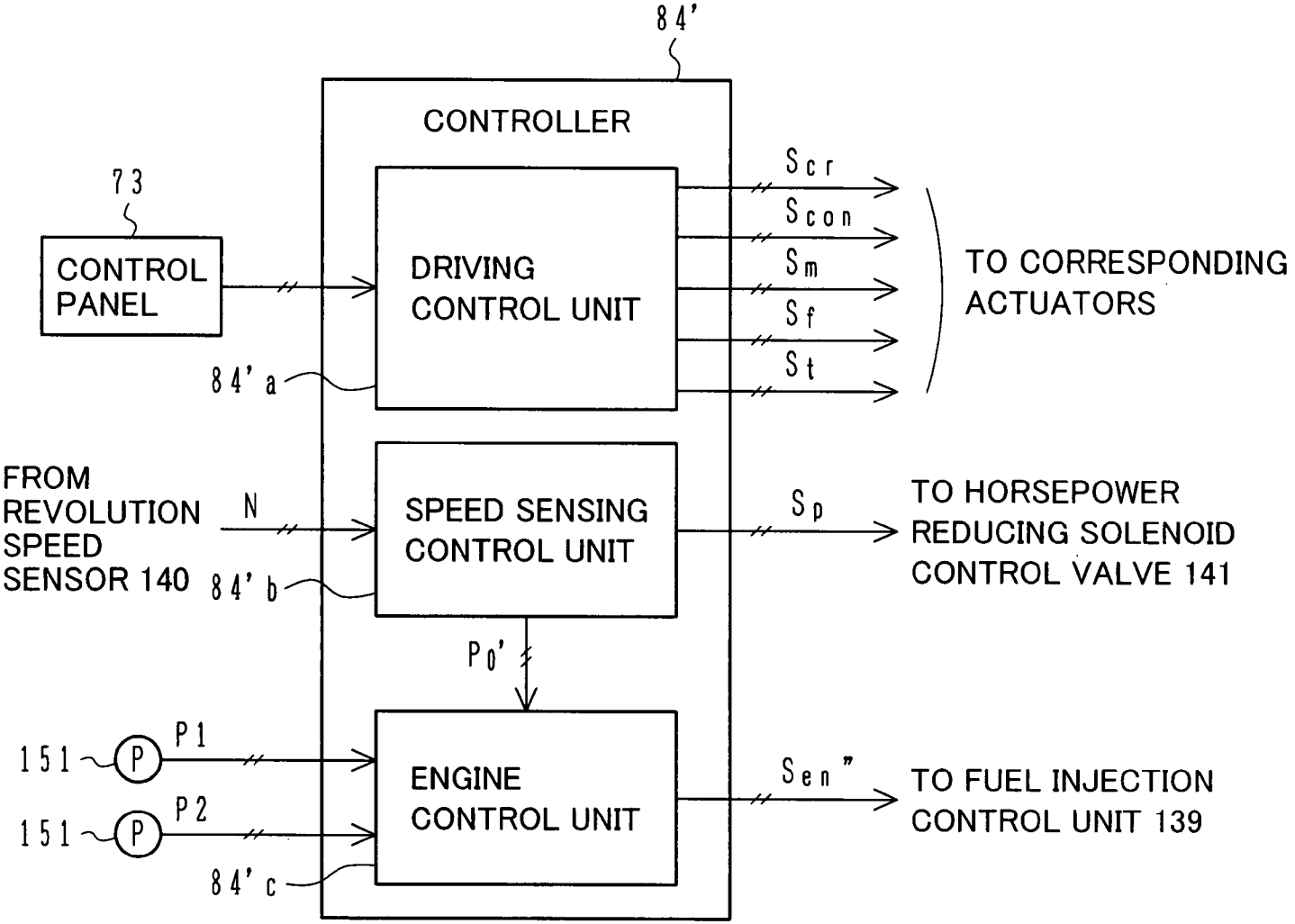
FIG. 11 is a functional block diagram showing the functions of a controller constituting a second modification of one embodiment of the self-propelled crushing machine of the present invention.

FIG. 11 is a functional block diagram showing the functions of a controller 84' including the speed sensing control function. In FIG. 11, the controller 84' comprises a driving control unit 84'*a*, a speed sensing control unit 84'*b*, and an engine control unit 84'*c*. When various operation signals are inputted from the control panel 73, the driving control unit 84'*a* produces the drive signals Scr, Scon, Sm, Sf and St in accordance with the inputted operation signals, and then outputs the produced operation signals to the corresponding solenoids.

Figure 12:
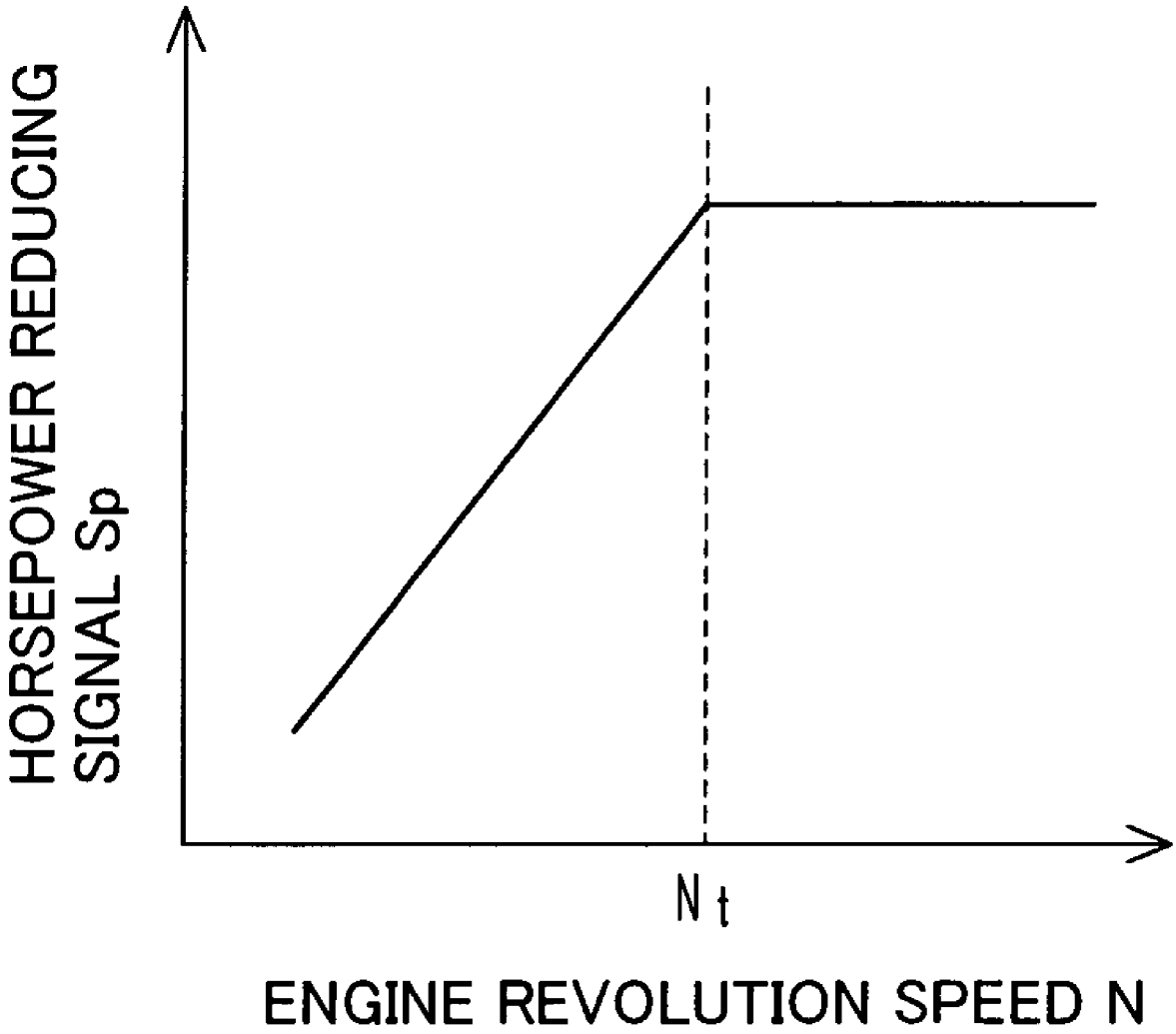
FIG. 12 is a graph representing the relationship between an engine revolution speed and a horsepower reducing signal outputted from a speed sensing control unit in the controller constituting the second modification of one embodiment of the self-propelled crushing machine of the present invention.

The speed sensing control unit 84'*b* receives the revolution speed N of the engine 61 from a revolution speed sensor 140, and then outputs a horsepower reducing signal Sp depending on the engine revolution speed N to a solenoid 141*a* of a horsepower reducing solenoid control valve 141 described later. FIG. 12 is a graph representing the relationship between the engine revolution speed N and the horsepower reducing signal Sp outputted from the speed sensing control unit 84'*b* in that process. As seen from FIG. 12, the speed sensing control unit 84'*b* outputs the horsepower reducing signal Sp at a constant output (e.g., a constant current value) when the engine revolution speed N is not lower than a target engine revolution speed Nt. When the engine revolution speed N is lower than the target engine revolution speed Nt, the output of the horsepower reducing signal Sp is reduced in a nearly proportional relation as the engine revolution speed N decreases. The target engine revolution speed Nt is stored, for example, in the controller 84' in advance (alternatively, it may be entered and set from an external terminal as required).

Figure 13:
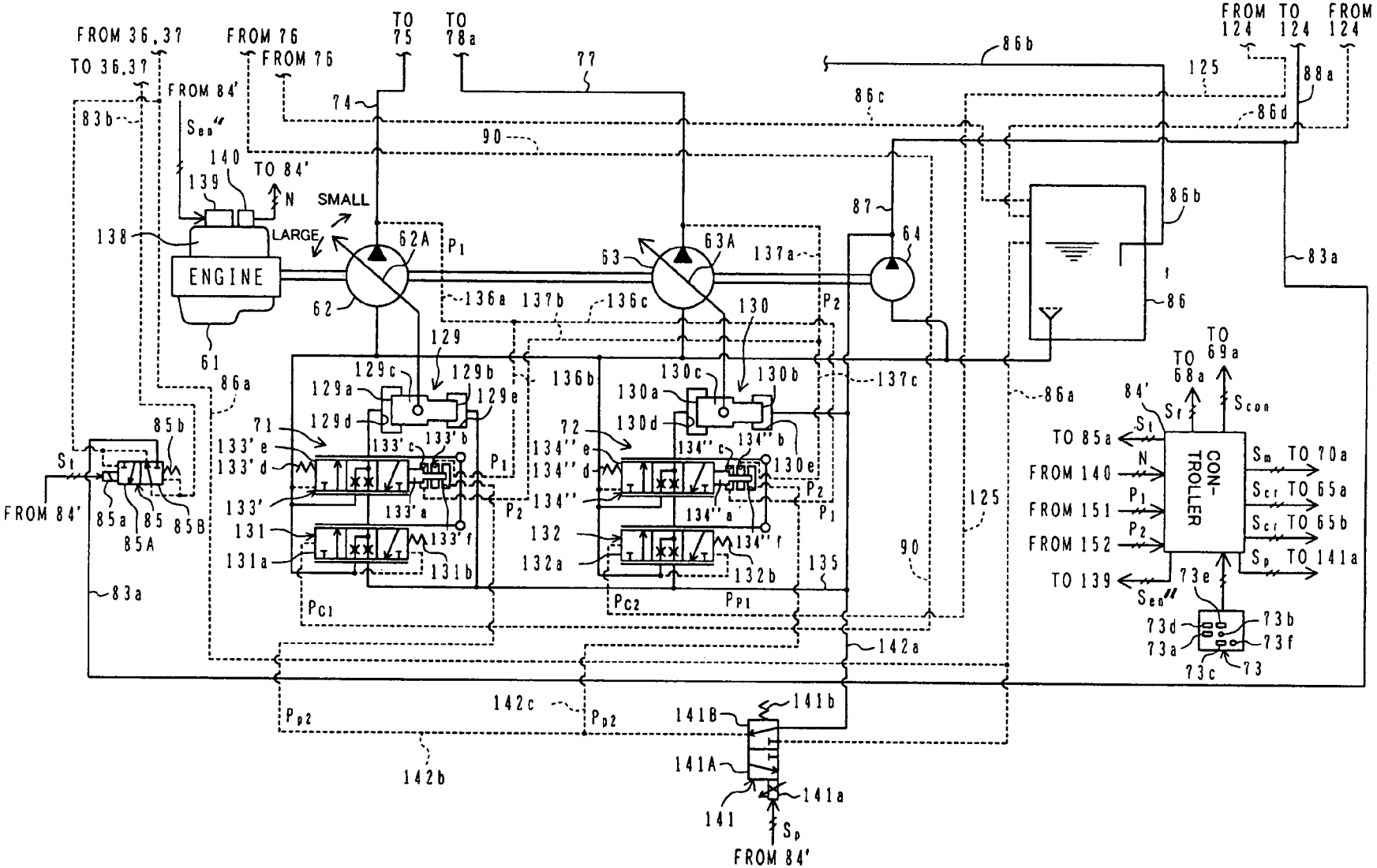
FIG. 13 is a hydraulic circuit diagram showing an arrangement around the first and second hydraulic pumps in the overall arrangement of the hydraulic drive system provided in the second modification of one embodiment of the self-propelled crushing machine of the present invention.

FIG. 13 is a hydraulic circuit diagram showing an arrangement around the first and second hydraulic pumps 62, 63 in the hydraulic drive system provided in this second modification.

In FIG. 13, numeral 141 denotes a horsepower reducing solenoid control valve. The horsepower reducing solenoid control valve 141 is a proportional solenoid valve. More specifically, when the load imposed on the engine 61 is small and the engine revolution speed N is not lower than the target engine revolution speed Nt, the horsepower reducing signal Sp at a certain level is outputted from the speed sensing control unit 84'*b* of the controller 84' to a solenoid 141*a* of the horsepower reducing solenoid control valve 141, whereby the horsepower reducing solenoid control valve 141 is switched to a cutoff position 141A on the lower side as viewed in FIG. 13. In this state, introducing lines 142*b*, 142*c* are communicated with the reservoir 86, and a pilot pressure (horsepower reducing pilot pressure Pp2) introduced to pressure bearing chambers 133'*f*, 134"*f* of operation driving sectors 133'*a*, 134"*a* via the introducing lines 142*b*, 142*c* is given as the reservoir pressure. Accordingly, valve members 133'*e*, 134"*e* of the second servo valves 133', 134" are moved to the right, as viewed in FIG. 13, to raise respective pressures in the pressure bearing chambers 129*d*, 130*d* of the tilting actuators 129, 130, thereby moving the working pistons 129*c*, 130*c* to the right as viewed in FIG. 13. This results in larger tilting of each of the swash plates 62A, 63A to increase the pump delivery rates Q1, Q2. Thus, when the load imposed on the engine 61 is small and the engine revolution speed N is not lower than the target engine revolution speed Nt, the input torques of the first and second pumps 62, 63 are increased.

Figure 14A:
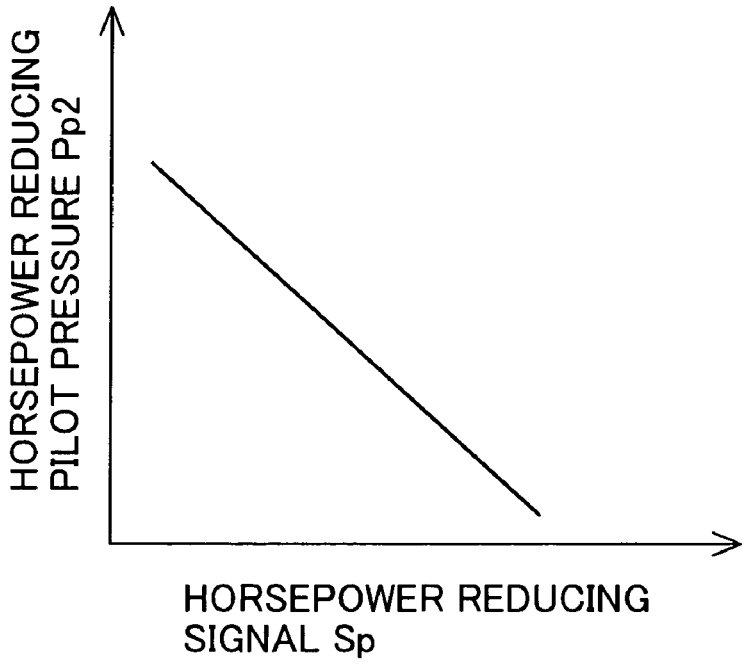
FIG. 14 is a set of graphs representing the relationship between an output of the horsepower reducing signal and a horsepower reducing pilot pressure in an introducing line and the relationship between the horsepower reducing pilot pressure and an input torque of each of the first and second hydraulic pumps in the second modification of one embodiment of the self-propelled crushing machine of the present invention.
Figure 14B:
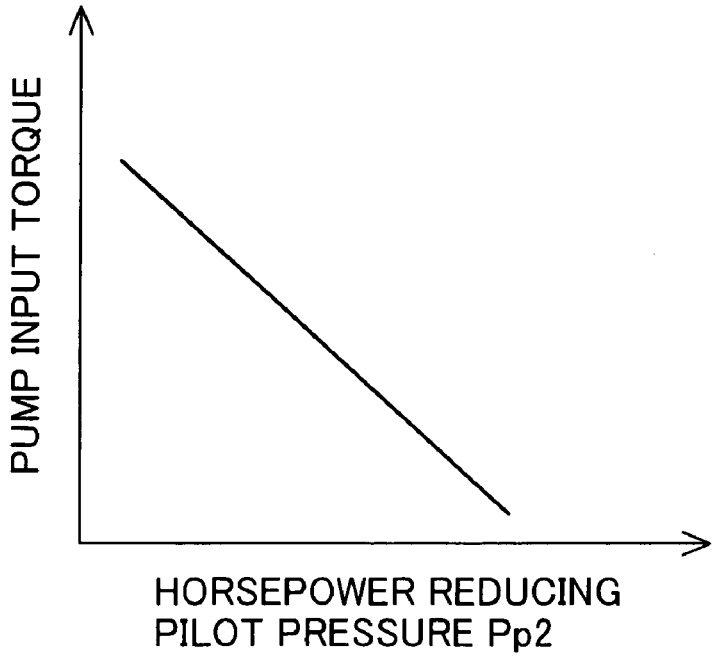

On the other hand, when the load imposed on the engine 61 is increased and the engine revolution speed N becomes lower than the target engine revolution speed Nt, a magnitude of the horsepower reducing signal Sp inputted to the solenoid 141*a* of the horsepower reducing solenoid control valve 141 from the speed sensing control unit 84'*b* is reduced in a nearly proportional relation to the decrease of the engine revolution speed N, whereby the horsepower reducing solenoid control valve 141 is switched to a communication position 141B on the upper side as viewed in FIG. 13. In this state, a degree of communication opening between an introducing line 142*a* and the introducing lines 142*b*, 142*c* is enlarged as the magnitude of the horsepower reducing signal Sp inputted to the valve 141 reduces. Correspondingly, the pilot pressure is introduced from the introducing line 142*a* to the introducing lines 142*b*, 142*c*, and the pilot pressure (horsepower reducing pilot pressure Pp2) in the introducing lines 142*b*, 142*c* rises gradually. FIG. 14(*a*) is a graph representing the relationship between the magnitude of the horsepower reducing signal Sp and the horsepower reducing pilot pressure Pp2 in the introducing lines 142*b*, 142*c* in this second modification. As seen from FIG. 14(*a*), as the magnitude of the horsepower reducing signal Sp reduces, the horsepower reducing pilot pressure Pp2 rises in a nearly inverse proportional relation. The thus-produced horsepower reducing pilot pressure Pp2 is introduced to the pressure bearing chambers 133'*f*, 134"*f* of the operation driving sectors 133'*a*, 134"*a* via the introducing lines 142*b*, 142*c*. Accordingly, the valve members 133'*e*, 134"*e* of the second servo valves 133', 134" are moved to the left, as viewed in FIG. 13, to lower respective pressures in the pressure bearing chambers 129*d*, 130*d* of the tilting actuators, thereby moving the working pistons 129*c*, 130*c* to the left as viewed in FIG. 13. This results in smaller tilting of each of the swash plates 62A, 63A and a decrease of the pump delivery rates Q1, Q2. Thus, when the load imposed on the engine 61 is increased and the engine revolution speed N becomes lower than the target engine revolution speed Nt, the input torques of the first and second hydraulic pumps 62, 63 are reduced. FIG. 14(*b*) is a graph representing the relationship between the horsepower reducing pilot pressure Pp2 and the input torque of each of the first and second hydraulic pumps 62, 63 in this second modification. As seen from FIG. 14(*b*), as the horsepower reducing pilot pressure Pp2 rises, the input torque of each of the first and second hydraulic pumps 62, 63 is reduced in a nearly inverse proportional relation.

Figure 15A:
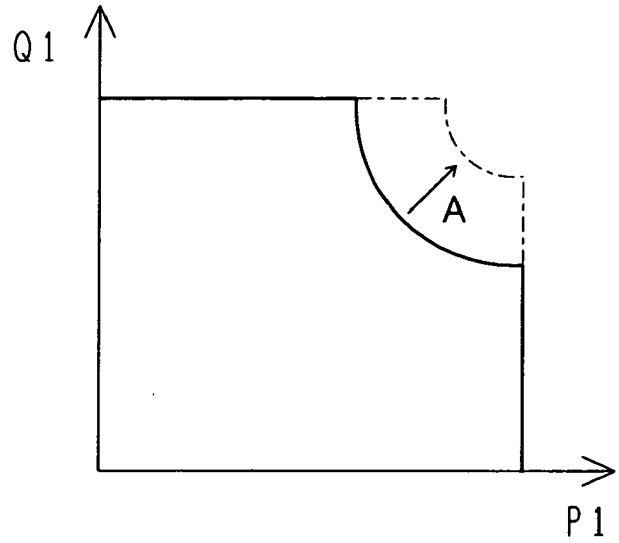
FIG. 15 is a set of graphs representing respectively a shift of a characteristic of the first hydraulic pump toward the higher torque side, a shift of a characteristic of the second hydraulic pump toward the lower torque side, and a variation of a threshold, which are caused by speed sensing control in the second modification of one embodiment of the self-propelled crushing machine of the present invention.
Figure 15B:
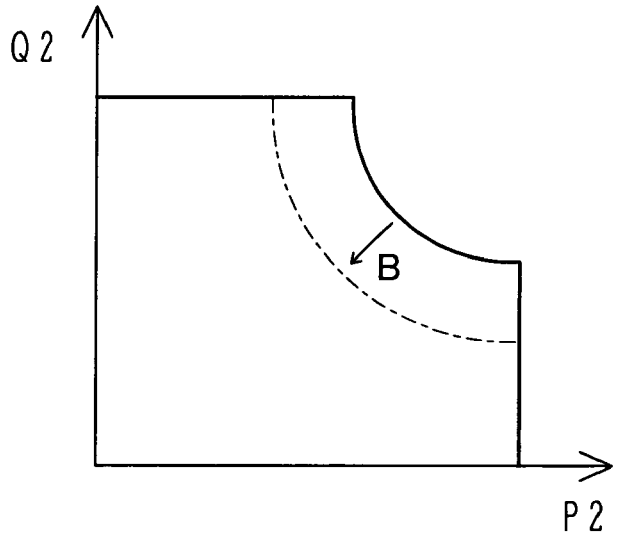
Figure 15C:
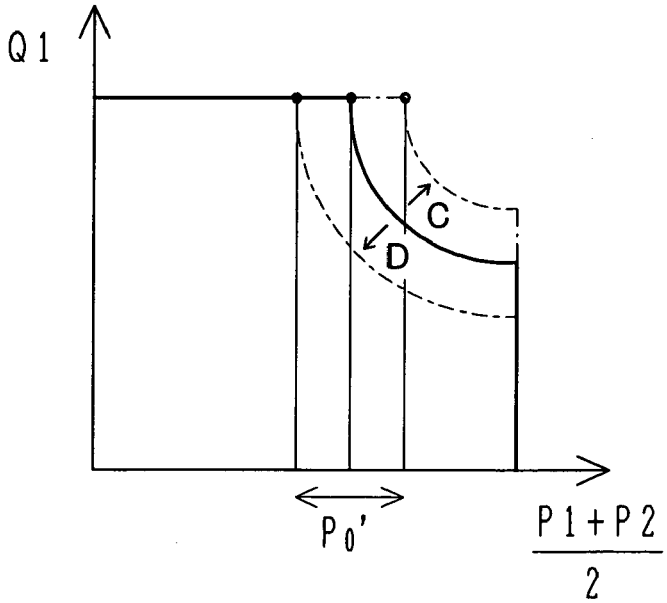

With the arrangement described above, when the load imposed on, e.g., the first hydraulic pump 62 is increased and the engine revolution speed N is reduced because of an overload condition of the engine 61, a characteristic of the first hydraulic pump 62 having a relatively large load is shifted to the higher torque side as indicated by an arrow A in FIG. 15(*a*) and at the same time a characteristic of the second hydraulic pump 63 having a relatively small load is shifted to the lower torque side as indicated by an arrow B in FIG. 15(*b*), thereby enabling the horsepower of the engine 61 to be effectively utilized. Further, a total of the input torques of the first and second hydraulic pumps 62, 63 is held smaller than the output torque of the engine 61 to reduce the load imposed on the engine 61. As a result, the speed sensing control to prevent engine stalling can be realized.

With the speed sensing control described above, the average value ((P1+P2)/2) of the delivery pressures P1, P2 of the first and second hydraulic pumps 62, 63 resulting when the delivery rate Q1 of the first hydraulic pump 62 is reduced (i.e., when the crushing efficiency starts to decline) varies as indicated by an arrow C or D in FIG. 15(*c*). In this modification, the speed sensing control unit 84'*b* outputs the average value of the varying delivery pressures P1, P2, as the threshold $P_0'$, to the engine control unit 84'*c* described below (see FIG. 11).

Figure 16:
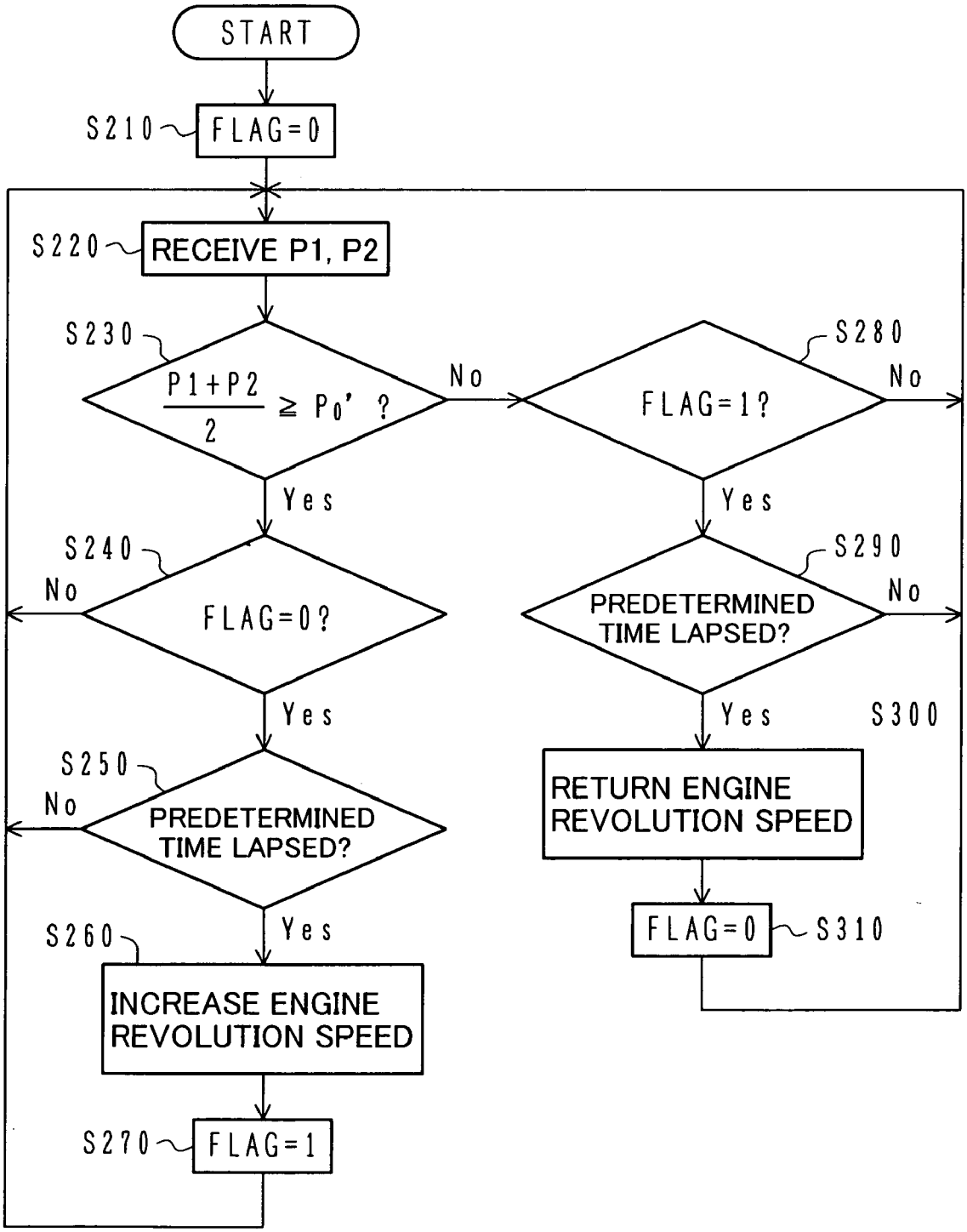
FIG. 16 is a flowchart showing control procedures related to engine horsepower increasing control in the functions of a controller constituting the second modification of one embodiment of the self-propelled crushing machine of the present invention.

As shown in FIG. 11, the engine control unit 84'*c* to which the threshold $P_0'$ is inputted from the speed sensing control unit 84'*b* also receives the delivery pressures P1, P2 of the first and second hydraulic pumps 62, 63 outputted from the pressure sensors 151, 152, and then outputs a horsepower increasing signal Sen" to the fuel injection control unit 139 when the average value of the delivery pressures P1, P2 is larger than the threshold $P_0'$. FIG. 16 is a flowchart showing control procedures related to engine horsepower increasing control executed by the engine control unit 84'*c* of the controller 84' in this second modification.

The control procedures of the horsepower increasing control executed by the engine control unit 84'*c*, shown in FIG. 16, are substantially the same as those shown in FIG. 9 representing the above-described one embodiment except that the threshold $P_0$ used in step 430 in the flowchart of FIG. 9 is replaced with the threshold $P_0'$, and hence a description thereof is omitted here.

In this modification, the controller 84' constitutes control means for executing control to increase the revolution speed of the prime mover in accordance with a detected signal from the crushing device load detecting means.

With this modification, as described above, when the average value of the delivery pressures P1, P2 of the first and second hydraulic pumps 62, 63 detected by the pressure sensors 151, 152 is larger than the threshold $P_0'$ varying under the speed sensing control, the revolution speed of the engine 61 is increased to increase the engine horsepower. Accordingly, as with the above-described one embodiment of the present invention, it is possible to prevent a reduction of the crushing efficiency when the load of the crushing device is increased and the engine comes into an overload condition.

Another embodiment of the self-propelled crushing machine of the present invention will be described below with reference to FIGS. 17 to 25. In this embodiment, the present invention is applied to a self-propelled crushing machine including a shredder-type crushing device. A hydraulic drive system of this self-propelled crushing machine includes three variable displacement hydraulic pumps, i.e., two hydraulic pumps for supplying a hydraulic fluid to a hydraulic motor for the crushing device and one hydraulic pump for supplying a hydraulic fluid to a hydraulic motor for auxiliaries.

Figure 17:
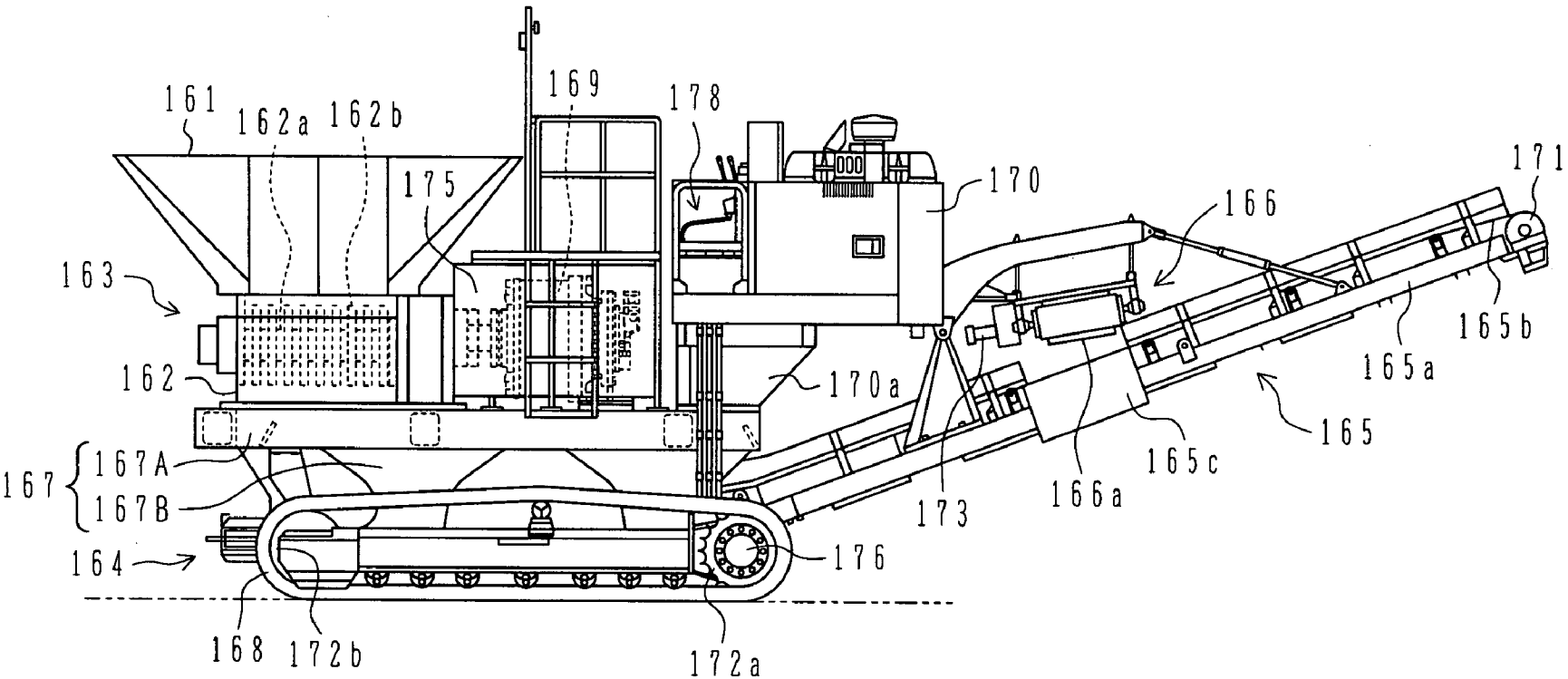
FIG. 17 is a side view showing an overall structure of another embodiment of the self-propelled crushing machine of the present invention.
Figure 18:
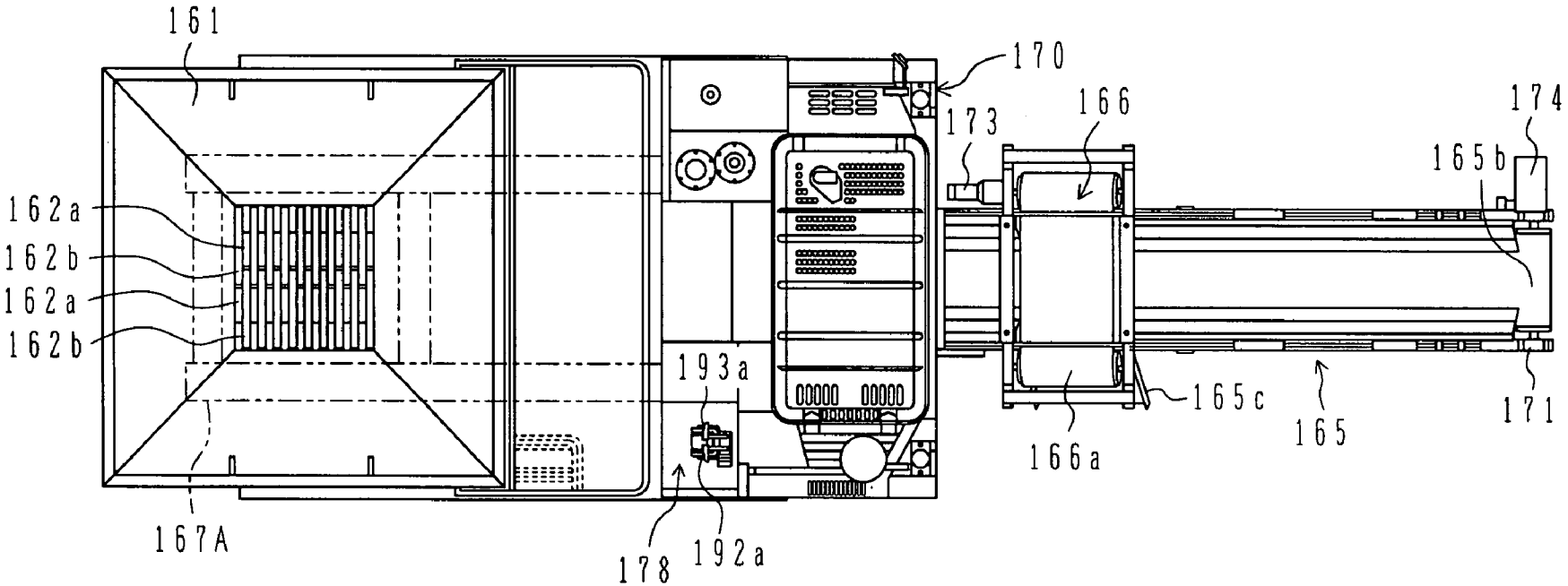
FIG. 18 is a plan view showing the overall structure of another embodiment of the self-propelled crushing machine of the present invention.

FIG. 17 is a side view showing an overall structure of another embodiment of the self-propelled crushing machine of the present invention, and FIG. 18 is a plan view of the self-propelled crushing machine shown in FIG. 17.

In FIGS. 17 and 18, numeral 161 denotes a hopper for receiving target materials to be crushed, which are loaded by using a working appliance, e.g., a bucket of a hydraulic excavator. Numeral 162 denotes a shearing-type crushing device (twin-shaft shredder in this embodiment) for crushing the target materials received in the hopper 161 into a predetermined size and discharging the crushed materials downward. Numeral 163 denotes a crushing machine body on which the hopper 161 and the crushing device 162 are mounted, and 164 denotes a travel body disposed under the crushing machine body 163. Numeral 165 denotes a discharge conveyor for receiving the crushed materials, which have been crushed by the crushing device 162 and discharged downward, and then carrying the crushed materials to the rear side of the self-traveled crushing machine (to the right as viewed in FIGS. 17 and 18) for delivery to the outside of the machine. Numeral 166 denotes a magnetic separating device disposed above the discharge conveyor 165 and magnetically attracting and removing magnetic substances (such as iron reinforcing rods) contained in the crushed materials under carrying on the discharge conveyor 165.

The travel body 164 comprises a body frame 167 and left and right crawler belts 168 serving as travel means. The body frame 167 is constructed by a substantially rectangular frame, for example, and comprises a crushing device mounting section 167A on which the crushing device 162, the hopper 161, a power unit 170 (described later), etc. are mounted, and a track frame section 167B for connecting the crushing device mounting section 167A and the left and right crawler belts 168. The crawler belts 168 are entrained between a drive wheel 172*a* and a driven wheel (idler) 172*b*, and are given with driving forces from left and right travel hydraulic motors 176, 177 (only the left travel hydraulic motor 176 being shown in FIG. 17), which are disposed on the side of the drive wheel 172*a*, so that the self-propelled crushing machine travels.

As shown in FIGS. 17 and 18, the crushing device 162 is mounted at a front-side (left-side as viewed in FIGS. 17 and 18) end portion of the body frame's crushing device mounting section 167A in the longitudinal direction thereof, and the hopper 161 is disposed above the crushing device 162. The crushing device 162 is a twin-shaft shearing machine (called a shredder or a shearing-type crushing device) and has two rotary shafts (not shown) arranged parallel to each other, over which cutters (rotating teeth) 162*b* are mounted in the form of comb teeth at predetermined intervals with a spacer 162*a* interposed between two adjacent cutters such that the cutters 162 on both sides mesh with each other. By rotating those rotary shafts in opposite directions, the target materials supplied from the hopper 161 are bitten between the opposing cutters 162*b* and 162*b* and shorn into small fragments, whereby the target materials are crushed into the predetermined size. On that occasion, driving forces are applied to the rotary shafts such that torque of a variable displacement hydraulic motor 169 for the crushing device, which is included in a driving unit 175 disposed on the body frame's crushing device mounting section 167A at a position behind the crushing device 162 (i.e., in an intermediate portion of the body frame's crushing device mounting section 167A in the longitudinal direction thereof), is distributed through a gear mechanism (not shown) and then supplied to respective drive shafts.

The discharge conveyor 165 comprises a drive wheel 171 supported on a frame 165*a* and driven by a discharge conveyor hydraulic motor 174, a driven wheel (idler, not shown), and a conveyor belt 165*b* entrained over the drive wheel 171 and the driven wheel. The conveyor belt 165*b* is driven to run in a circulating manner, thereby carrying the crushed materials having dropped onto the conveyor belt 165*b* from the crushing device 162 and discharging them from the belt end on the delivery side (right side as viewed in FIGS. 17 and 18).

The magnetic separating device 166 has a magnetic separating device belt 166*a* that is disposed above the conveyor belt 165*b* in a substantially perpendicular relation to the conveyor belt 165*b* and is driven by a magnetic separating device hydraulic motor 173 to run round a magnetic force generating means (not shown). Magnetic forces generated from the magnetic force generating means act upon the crushed materials through the magnetic separating device belt 166*a* to attract the magnetic substances onto the magnetic separating device belt 166*a*. The attracted magnetic substances are carried in a direction substantially perpendicular to the conveyor belt 165*b* and then dropped laterally of the conveyor belt 165*b* through a chute 165*c* provided on the frame 165*a* of the discharge conveyor 165.

Above a rear-side (right-side as viewed in FIGS. 17 and 18) end portion of the body frame's crushing device mounting section 167A in the longitudinal direction thereof, a power unit 170 is mounted through a power unit mounting member 170*a*. The power unit 170 incorporates therein, e.g., first to third hydraulic pumps 179A-C (not shown, see FIG. 19 described later) for delivering a hydraulic fluid to hydraulic actuators, such as left and right travel hydraulic motors 176, 177, a crushing device hydraulic motor 169, a discharge conveyor hydraulic motor 174, and a magnetic separating device hydraulic motor 173; a pilot pump 185 (see FIG. 19); an engine 181 (see FIG. 19) as a prime mover for driving those hydraulic pumps 179A-C, 185; and control valve units 180A-C (see FIG. 19) including a plurality of control valves (described later) which control respective flows of the hydraulic fluids supplied from the hydraulic pumps 179A-C, 185 to the hydraulic actuators.

On the front side (left side as viewed in FIGS. 17 and 18) of the power unit 170, there is a cab 178 in which an operator operates the machine. The operator standing in the cab 178 can monitor crushing situations performed by the crushing device 162 to some extent during the crushing work.

Here, the crushing device 162, the discharge conveyor 165, the magnetic separating device 166, and the travel body 164 constitute driven members that are driven by a hydraulic drive system provided in the self-propelled crushing machine of this embodiment. A detailed arrangement of the hydraulic drive system will be described in sequence below.

(a) Overall Arrangement

Figure 19:
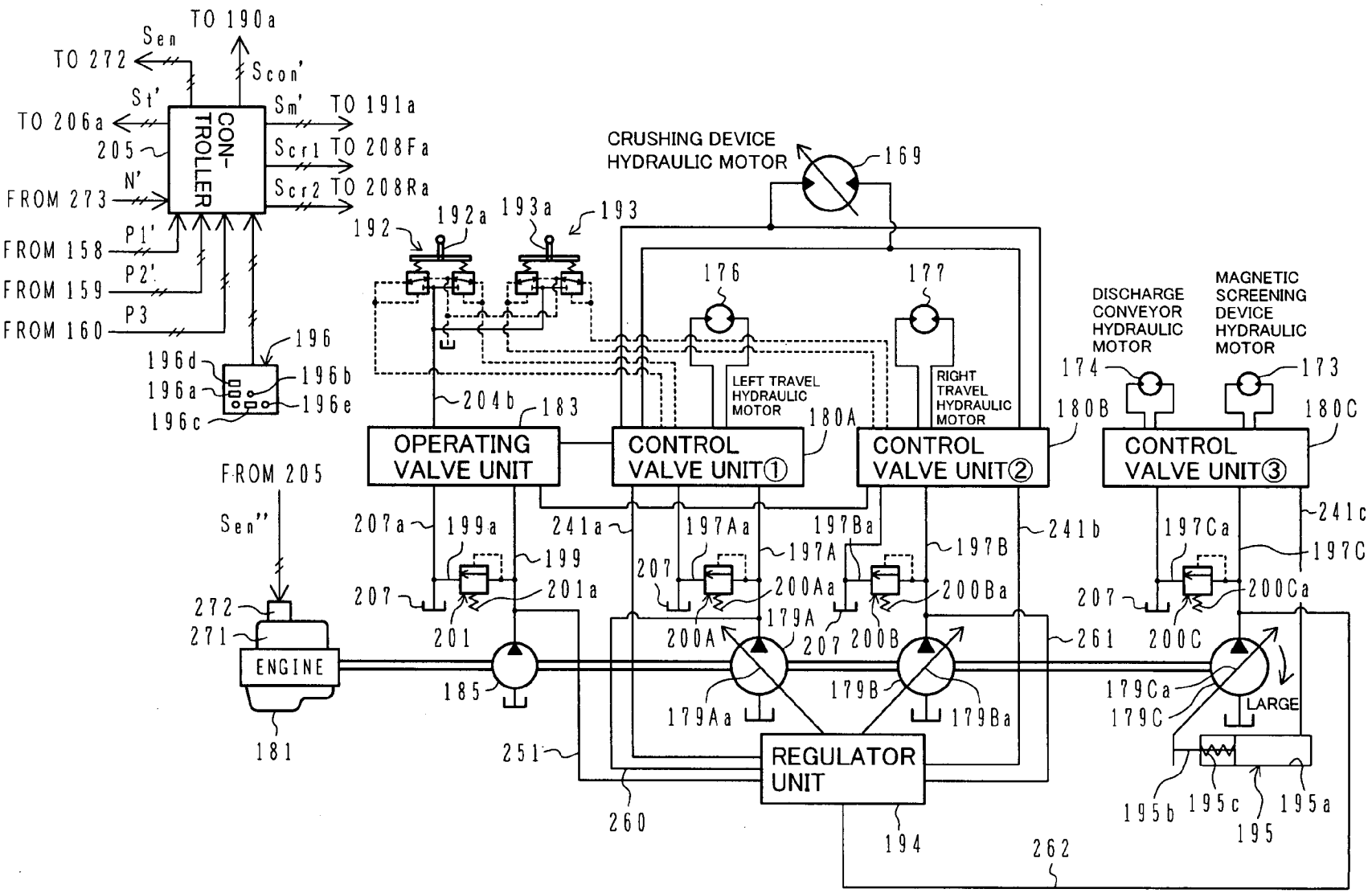
FIG. 19 is a hydraulic circuit diagram showing an overall schematic arrangement of a hydraulic drive system provided in another embodiment of the self-propelled crushing machine of the present invention.

FIG. 19 is a hydraulic circuit diagram showing an overall schematic arrangement of the hydraulic drive system provided in another embodiment of the self-propelled crushing machine of the present invention.

In FIG. 19, numeral 181 denotes an engine. Numerals 179A-C denote the first to third variable displacement hydraulic pumps driven by the engine 181, and 185 denotes the fixed displacement pilot pump driven likewise by the engine 181. Numerals 169, 173, 174, 176 and 177 denote the above-mentioned hydraulic motors that are supplied with the hydraulic fluids delivered from the first to third hydraulic pumps 179A-C. Numerals 180A, 180B and 180C denote respectively the first, second and third control valve units that incorporate control valves 186L, 186R, 187, 188, 190 and 191 (described later in detail) for controlling respective flows (directions and flow rates or only flow rates) of the hydraulic fluids supplied from the first to third hydraulic pumps 179A-C to the hydraulic motors 169, 173, 174, 176 and 177. Numerals 192*a*, 193*a* denote left and right travel control levers (see FIG. 18) disposed in the cab 178 and switching respectively the left travel control valve 187 (described later) in the first control valve unit 180A and the right travel control valve 188 (described later) in the second control valve unit 180B. Numeral 194 denotes pump control means, e.g., a regulator unit, for adjusting delivery rates of the first and second hydraulic pumps 179A, 179B, and 195 denotes pump control means, e.g., a regulator unit, for the third hydraulic pump 179C. Numeral 196 denotes a control panel, which is disposed in the crushing machine body 163 (e.g., in the cab 178) and which enables the operator to enter, e.g., instructions for starting and stopping operations of the crushing device 162, the discharge conveyor 165, and the magnetic separating device 166.

Relief valves 200A, 200B, 200C and 201 are disposed respectively in lines 197Aa, 197Ba, 197Ca and 199*a* branched from delivery lines 197A, 197B, 197C and 199 of the first to third hydraulic pumps 179A-C and the pilot pump 185. Relief pressure values for limiting respective maximum values of delivery pressures P1', P2', P3' and Pp' of the first to third hydraulic pumps 179A-C and the pilot pump 185 are set by the biasing forces of springs 200Aa, 200Ba, 200Ca and 201*a* provided in association with those relief valves.

The five hydraulic motors 169, 173, 174, 176 and 177 are constituted, as mentioned above, as the crushing device hydraulic motor 169 for generating a driving force to operate the crushing device 162, the magnetic separating device hydraulic motor 173 for generating a driving force to operate the magnetic separating device 166, the discharge conveyor hydraulic motor 174 for generating a driving force to operate the discharge conveyor 165, and left and right travel hydraulic motors 176, 177 for generating driving forces transmitted to the left and right crawler belts 168.

(b) First Control Valve Unit and Operating Valve Unit

Figure 20:
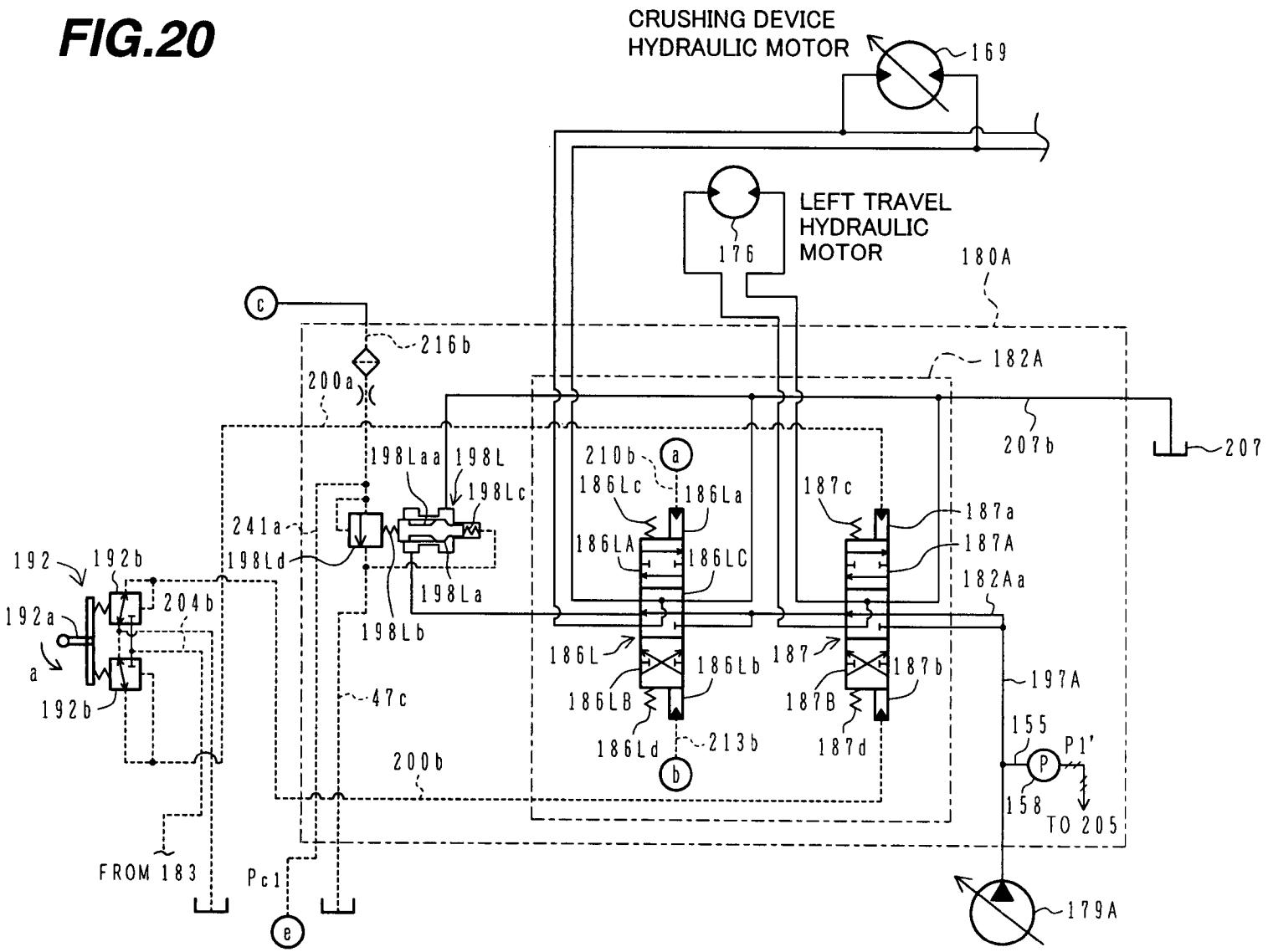
FIG. 20 is a hydraulic circuit diagram showing a detailed arrangement of a first control valve unit constituting the hydraulic drive system provided in another embodiment of the self-propelled crushing machine of the present invention.

FIG. 20 is a hydraulic circuit diagram showing a detailed arrangement of the first control valve unit 180A. In FIG. 20, a first crushing-device control valve 186L connected to the crushing device hydraulic motor 169 and the left travel control valve 187 connected to the left travel hydraulic motor 176 are three-position selector valves of hydraulic pilot type capable of controlling the directions and flow rates of the hydraulic fluids supplied to the corresponding hydraulic motors 169, 176.

In this connection, the hydraulic fluid delivered from the first hydraulic pump 179A is introduced to the left travel control valve 187 and the first crushing-device control valve 186L, from which the hydraulic fluid is supplied to the left travel hydraulic motor 176 and the crushing device hydraulic motor 169. Those control valves 187, 186L are included in a first valve group 182A having a center bypass line 182Aa connected to the delivery line 197A of the first hydraulic pump 179A, and are disposed on the center bypass line 182Aa in the order of the left travel control valve 187 and the first crushing-device control valve 186L from the upstream side. The first valve group 182A is constructed as one valve block including the twin control valves 187, 186L. Additionally, a pump control valve 198L (described later in detail) is disposed at the most downstream of the center bypass line 182Aa.

The left travel control valve 187 is operated by a pilot pressure that is generated from the pilot pump 185 and then reduced to a predetermined pressure by a control lever unit 192 provided with the control lever 192*a*. More specifically, the control lever unit 192 includes the control lever 192*a* and a pair of pressure reducing valves 192*b*, 192*b* for outputting a pilot pressure corresponding to an input amount by which the control lever 192*a* is operated. When the control lever 192*a* of the control lever unit 192 is operated in a direction of arrow a in FIG. 20 (or in an opposite direction; this directional correspondence is similarly applied to the following description), a resulting pilot pressure is introduced to a driving sector 187*a* (or 187*b*) of the left travel control valve 187 via a pilot line 200*a* (or 200*b*), whereby the left travel control valve 187 is switched to a shift position 187A on the upper side as viewed in FIG. 20 (or a shift position 187B on the lower side). Accordingly, the hydraulic fluid from the first hydraulic pump 179A is supplied to the left travel hydraulic motor 176 via the delivery line 197A, the center bypass line 182Aa, and the shift position 187A (or the shift position 187B on the lower side) of the left travel control valve 187, thereby driving the left travel hydraulic motor 176 in the forward direction (or in the reverse direction).

When the control lever 192*a* is operated to its neutral position shown in FIG. 20, the left travel control valve 187 is returned to its neutral position shown in FIG. 20 by the biasing forces of springs 187*c*, 187*d*, whereupon the left travel hydraulic motor 176 is stopped.

Figure 21:
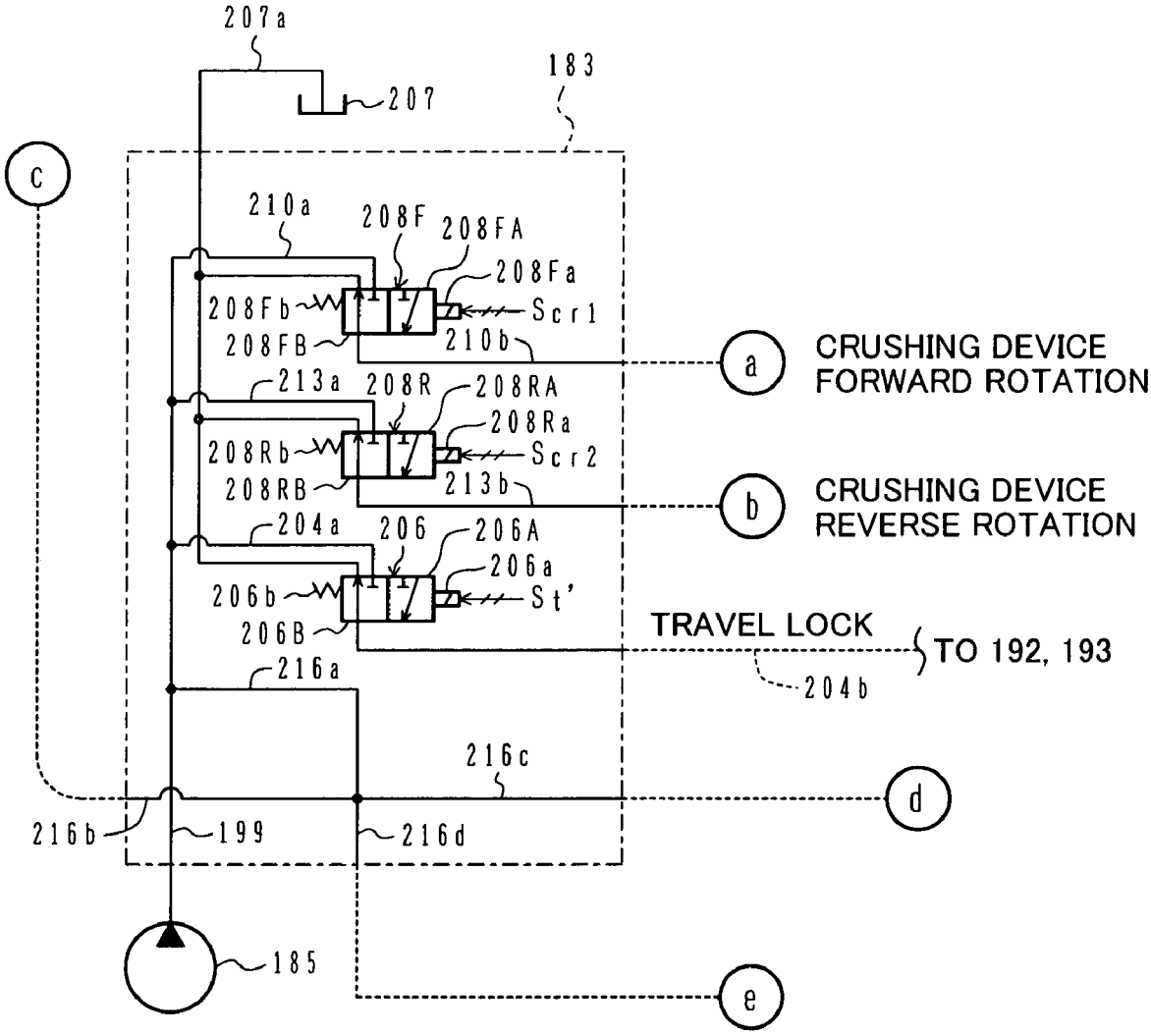
FIG. 21 is a hydraulic circuit diagram showing a detailed arrangement of an operating valve unit constituting the hydraulic drive system provided in another embodiment of the self-propelled crushing machine of the present invention.

FIG. 21 is a hydraulic circuit diagram showing a detailed arrangement of the operating valve unit 183. In FIG. 21, numeral 199 denotes a delivery line of the pilot pump 185. A travel lock solenoid control valve 206, a crushing device forward-rotation solenoid control valve 208F, and a crushing device reverse-rotation solenoid control valve 208R are connected to the delivery line 199 in parallel to each other.

The travel lock solenoid control valve 206 is incorporated in the operating valve unit 183, and is disposed in pilot introducing lines 204*a*, 204*b* for introducing the pilot pressure from the pilot pump 185 to the control lever unit 192. It is switched by a drive signal St' (described later) outputted from a controller 205 (see FIG. 19).

More specifically, the travel lock solenoid control valve 206 is switched to a communication position 206A on the right side, as viewed in FIG. 21, when the drive signal St inputted to its solenoid 206*a* is turned ON, whereupon the pilot pressure from the pilot pump 185 is introduced to the control lever unit 192 via the introducing lines 204*a*, 204*b*, thus enabling the left travel control valve 187 to be operated by the control lever 192 as described above. On the other hand, when the drive signal St is turned OFF, the travel lock solenoid control valve 206 is returned to a cutoff position 206B on the left side, as viewed in FIG. 21, by the restoring force of a spring 206*b*, whereupon the introducing line 204*a* and the introducing line 204*b* are cut off from each other. Concurrently, the introducing line 204*b* is communicated with a reservoir line 207*a* led to a reservoir 207 so that the pressure in the introducing line 204*b* becomes equal to a reservoir pressure, thus disabling the above-described operation of the left travel control valve 187 by the control lever unit 192.

Returning to FIG. 20, the first crushing-device control valve 186L is operated by a pilot pressure that is generated from the pilot pump 185 and then reduced to a predetermined pressure by the crushing device forward-rotation solenoid control valve 208F and the crushing device reverse-rotation solenoid control valve 208R both disposed in the operating valve unit 183.

The crushing device forward-rotation solenoid control valve 208F and the crushing device reverse-rotation solenoid control valve 208R, shown in FIG. 21, include respectively solenoids 208Fa, 208Ra driven by drive signals Scr1, Scr2 outputted from the controller 205. The first crushing-device control valve 186L is switched in response to inputs of the drive signals Scr1, Scr2.

More specifically, when the drive signal Scr1 is turned ON and the drive signal Scr2 is turned OFF, the crushing device forward-rotation solenoid control valve 208F is switched to a communication position 208FA on the right side as viewed in FIG. 21, and the crushing device reverse-rotation solenoid control valve 208R is returned to a cutoff position 208RB on the left side, as viewed in FIG. 21, by the restoring force of a spring 208Rb. Accordingly, the pilot pressure from the pilot pump 185 is introduced to a driving sector 186La of the first crushing-device control valve 186L via introducing lines 210*a*, 210*b*, while an introducing line 213*b* is communicated with the reservoir line 207*a* to be held at the reservoir pressure. The first crushing-device control valve 186L is hence switched to a shift position 186LA on the upper side as viewed in FIG. 20. As a result, the hydraulic fluid from the first hydraulic pump 179A is supplied to the crushing device hydraulic motor 169 via the delivery line 197A, the center bypass line 182Aa, and the shift position 186LA of the first crushing-device control valve 186L, thereby driving the crushing device hydraulic motor 169 in the forward direction.

Likewise, when the drive signal Scr1 is turned OFF and the drive signal Scr2 is turned ON, the crushing device forward-rotation solenoid control valve 208F is returned to a cutoff position 208FB on the left side, as viewed in FIG. 21, by the restoring force of a spring 208Fb, and the crushing device reverse-rotation solenoid control valve 208R is switched to a communication position 208RA on the right side as viewed in FIG. 21. Accordingly, the pilot pressure is introduced to a driving sector 186Lb of the first crushing-device control valve via introducing lines 213*a*, 213*b*, while the introducing line 210*b* is held at the reservoir pressure. The first crushing-device control valve 186L is hence switched to a shift position 186LB on the lower side as viewed in FIG. 20. As a result, the hydraulic fluid from the first hydraulic pump 179A is supplied to the crushing device hydraulic motor 169 via the shift position 186LB of the first crushing-device control valve 186L, thereby driving the crushing device hydraulic motor 169 in the reverse direction.

When the drive signals Scr1, Scr2 are both turned OFF, the crushing device forward-rotation solenoid control valve 208F and the crushing device reverse-rotation solenoid control valve 208R are returned to the cutoff positions 208FB, 208RB on the left side, as viewed in FIG. 21, by the restoring forces of the springs 208Fb, 208Rb, and the first crushing-device control valve 186L is returned to its neutral position 186LC shown in FIG. 20 by the restoring forces of springs 186Lc, 186Ld. As a result, the hydraulic fluid from the first hydraulic pump 179A is cut off to stop the crushing device hydraulic motor 169.

The pump control valve 198L has the function of converting a flow rate into a pressure and comprises a piston 198La capable of selectively establishing and cutting off communication between the center bypass line 182Aa and a reservoir line 207*b* through a throttle portion 198Laa thereof, springs 198Lb, 198Lc for biasing respectively opposite ends of the piston 198La, and a variable relief valve 198Ld which is connected at its upstream side to the delivery line 199 of the pilot pump 185 via a pilot introducing line 216*a* and a pilot introducing line 216*b* for introduction of the pilot pressure and at its downstream side to a reservoir line 47*c*, and which produces a relief pressure variably set by the spring 198Lb.

With such an arrangement, the pump control valve 198L functions as follows. The left travel control valve 187 and the first crushing-device control valve 186L are each a center bypass valve as described above, and the flow rate of the hydraulic fluid flowing through the center bypass line 182Aa is changed depending on respective amounts by which the control valves 187, 186L are operated (i.e., shift stroke amounts of their spools). When the control valves 187, 186L are in neutral positions, i.e., when demand flow rates of the control valves 187, 186L demanded for the first hydraulic pump 179A (namely flow rates demanded by the left travel hydraulic motor 176 and the crushing device hydraulic motor 169) are small, most of the hydraulic fluid delivered from the first hydraulic pump 179A is introduced, as an extra flow rate, to the pump control valve 198L via the center bypass line 182Aa, whereby the hydraulic fluid is led out at a relatively large flow rate to the reservoir line 207*b* through the throttle portion 198Laa of the piston 198La. Therefore, the piston 198La is moved to the right, as viewed in FIG. 20, to reduce the setting relief pressure of the relief valve 198Ld set by the spring 198Lb. As a result, a relatively low control pressure (negative control pressure) Pc1 is generated in a line 241*a* that is branched from the line 216*b* and is extended to a later-described first servo valve 255 for the negative tilting control.

Conversely, when the control valves 187, 186L are operated into open states, i.e., when the demand flow rates demanded for the first hydraulic pump 179A are large, the extra flow rate of the hydraulic fluid flowing through the center bypass line 182Aa is reduced corresponding to the flow rates of the hydraulic fluid flowing to the hydraulic motors 176, 169. Therefore, the flow rate of the hydraulic fluid led out to the reservoir line 207*b* through the piston throttle portion 198Laa becomes relatively small, whereby the piston 198La is moved to the left, as viewed in FIG. 20, to increase the setting relief pressure of the relief valve 198Ld. As a result, the control pressure Pc1 in the line 241*a* rises.

In this embodiment, as described later, a tilting angle of a swash plate 179Aa of the first hydraulic pump 179A is controlled in accordance with change of the control pressure (negative control pressure) Pc1 (details of this control being described later).

(c) Second Control Valve

Figure 22:
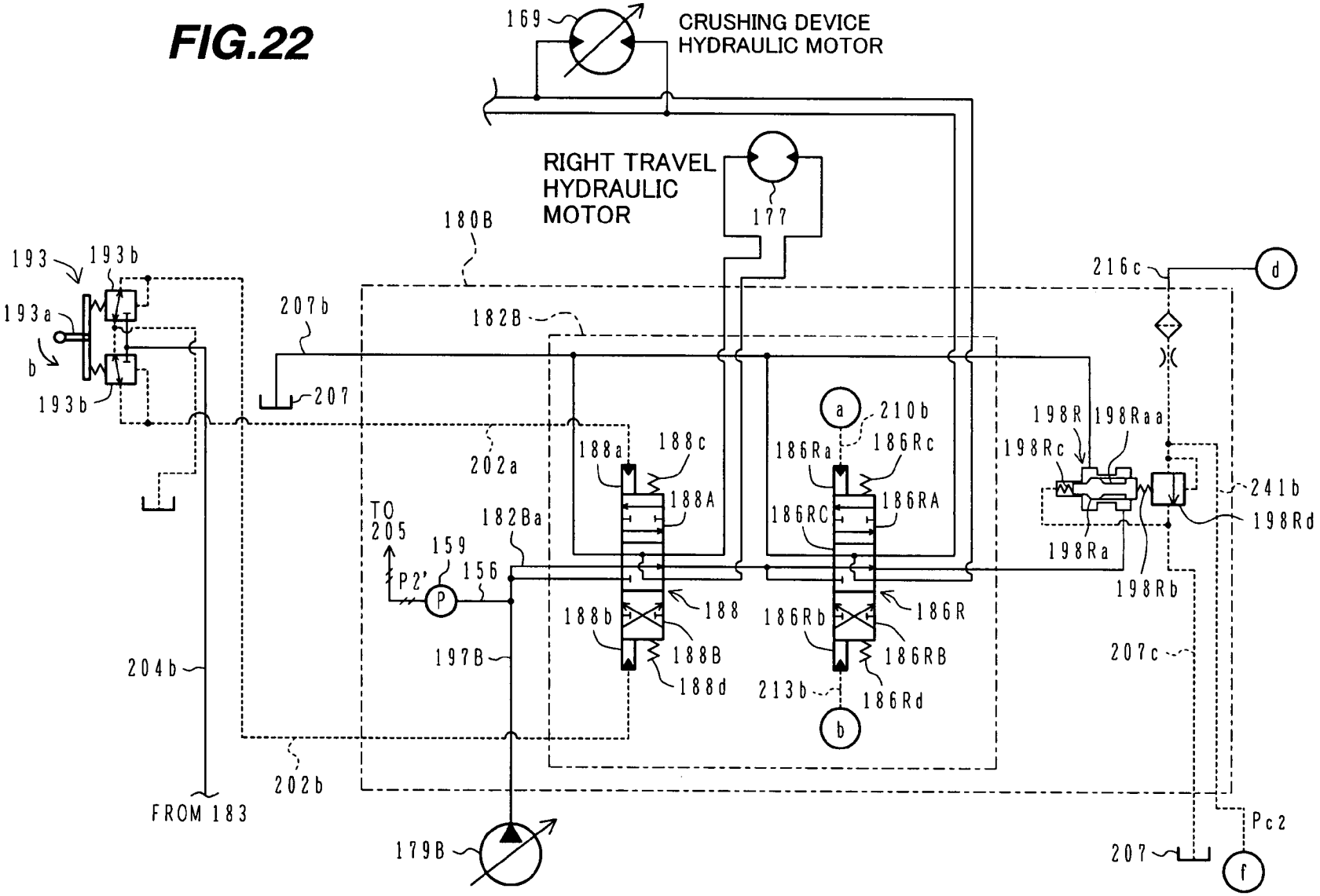
FIG. 22 is a hydraulic circuit diagram showing a detailed arrangement of a second control valve unit constituting the hydraulic drive system provided in another embodiment of the self-propelled crushing machine of the present invention.

FIG. 22 is a hydraulic circuit diagram showing a detailed arrangement of the second control valve unit 180B. In FIG. 22, the second control valve unit 180B has substantially the same structure as that of the first control valve unit 180A described above. Numeral 186R denotes a second crushing-device control valve, and 188 denotes the right travel control valve. Those control valves supply the hydraulic fluid delivered from the second hydraulic pump 179B to the right travel hydraulic motor 177 and the crushing device hydraulic motor 169, respectively. The control valves 188, 186R are included in a second valve group 182B having a center bypass line 182Ba connected to the delivery line 197B of the second hydraulic pump 179B, and are disposed on the center bypass line 182Ba in the order of the right travel control valve 188 and the second crushing-device control valve 186R from the upstream side. Like the first valve group 182A including the first control valve unit 180A, the second valve group 182B is constructed as one valve block. Further, the right travel control valve 188 is constructed by a valve having the same flow control characteristic as that of the left travel control valve 187 in the first valve group 182A (e.g., by a valve having the same structure), and the second crushing-device control valve 186R is constructed by a valve having the same flow control characteristic as that of the first crushing-device control valve 186L in the first valve group 182A (e.g., by a valve having the same structure). Hence, the valve block constituting the second valve group 182B and the valve block constituting the first valve group 182A have the same structure. Additionally, a pump control valve 198R having similar structure and functions to those of the above-mentioned pump control valve 198L is disposed at the most downstream of the center bypass line 182Ba.

As in the case of the left travel control valve 187, the right travel control valve 188 is operated by a pilot pressure that is generated with a control lever unit 193. More specifically, when a control lever 193*a* is operated in a direction of arrow b in FIG. 22 (or in an opposite direction; this directional correspondence is similarly applied to the following description), a resulting pilot pressure is introduced to a driving sector 188*a* (or 188*b*) of the right travel control valve 188 via a pilot line 202*a* (or 202*b*), whereby the right travel control valve 188 is switched to a shift position 188A on the upper side as viewed in FIG. 22 (or a shift position 188B on the lower side). Accordingly, the hydraulic fluid from the second hydraulic pump 179B is supplied to the right travel hydraulic motor 177 via the shift position 188A (or the shift position 188B on the lower side) of the right travel control valve 188, thereby driving the right travel hydraulic motor 177 in the forward direction (or in the reverse direction). When the control lever 193*a* is operated to its neutral position shown in FIG. 22, the right travel control valve 188 is returned to its neutral position shown in FIG. 22 by the biasing forces of springs 188*c*, 188*d*, whereupon the right travel hydraulic motor 177 is stopped.

Similarly to the operating lever unit 192 described above, the pilot pressure for the operating lever unit 193 is supplied from the pilot pump 185 through the travel lock solenoid control valve 206. As in the case of the operating lever unit 192, therefore, the operating lever unit 193 is able to perform the above-described operation of the right travel control valve 188 when the drive signal St' inputted to the solenoid 206*a* of the travel lock solenoid control valve 206 is turned ON. Then, the above-described operation of the right travel control valve 188 by the operating lever unit 193 is disabled when the drive signal St' is turned OFF.

Similarly to the first crushing-device control valve 186L described above, the second crushing-device control valve 186R is operated by a pilot pressure that is generated from the pilot pump 185 and then reduced to a predetermined pressure by the crushing device forward-rotation solenoid control valve 208F and the crushing device reverse-rotation solenoid control valve 208R both disposed in the operating valve unit 183.

More specifically, when the drive signal Scr1 from the controller 205 is turned ON and the drive signal Scr2 from the same is turned OFF, the pilot pressure from the pilot pump 185 is introduced to a driving sector 186Ra of the second crushing-device control valve 186R via introducing lines 210*a*, 210*b*, while the introducing line 213*b* is communicated with the reservoir line 207*a* to be held at the reservoir pressure. The second crushing-device control valve 186R is hence switched to a shift position 186RA on the upper side as viewed in FIG. 22. As a result, the hydraulic fluid from the second hydraulic pump 179B is supplied to the crushing device hydraulic motor 169 via the shift position 186RA of the second crushing-device control valve 186R, thereby driving the crushing device hydraulic motor 169 in the forward direction.

Likewise, when the drive signal Scr1 is turned OFF and the drive signal Scr2 is turned ON, the pilot pressure is introduced to a driving sector 186Rb of the second crushing-device control valve via introducing lines 213*a*, 213*b*, while the introducing line 210*b* is held at the reservoir pressure. The second crushing-device control valve 186R is hence switched to a shift position 186RB on the lower side as viewed in FIG. 22. As a result, the hydraulic fluid from the second hydraulic pump 179B is supplied to the crushing device hydraulic motor 169 via the shift position 186RB of the second crushing-device control valve 186R, thereby driving the crushing device hydraulic motor 169 in the reverse direction.

When the drive signals Scr1, Scr2 are both turned OFF, the second crushing-device control valve 186R is returned to its neutral position 186RC shown in FIG. 22 by the restoring forces of springs 186Rc, 186Rd, and the crushing device hydraulic motor 169 is stopped.

As seen from the above description, the first crushing-device control valve 186L and the second crushing-device control valve 186R operate in the same manner in response to the drive signals Scr1, Scr2 applied to the solenoid control valves 208F, 208R such that, when the drive signal Scr1 is ON and the drive signal Scr2 is OFF, the hydraulic fluids from the first hydraulic pump 179A and the second hydraulic pump 179B are supplied to the crushing device hydraulic motor 169 in a joined way.

The pump control valve 198R has similar arrangement and functions to those of the pump control valve 198L. More specifically, when demand flow rates of the control valves 188, 186R demanded for the second hydraulic pump 179B (namely flow rates demanded by the right travel hydraulic motor 177 and the crushing device hydraulic motor 169) are small, the hydraulic fluid is led out at a relatively large flow rate to the reservoir line 207*b* through a throttle portion 198Raa of a piston 198Ra. Therefore, the piston 198Ra is moved to the left, as viewed in FIG. 22, to reduce the setting relief pressure of the relief valve 198Rd set by the spring 198Rb. As a result, a relatively low control pressure (negative control pressure) Pc2 is generated in a line 241*b* that is branched from the line 216*c* and is extended to a later-described second servo valve 256 for the negative tilting control. When the control valves 188, 186R are operated and the demand flow rates demanded for the second hydraulic pump 179B are large, the piston 198Ra is moved to the right, as viewed in FIG. 22, to increase the setting relief pressure of the relief valve 198Rd. As a result, the control pressure Pc2 in the line 241*b* rises. Then, similarly to the first hydraulic pump 179A, a tilting angle of a swash plate 179Ba of the second hydraulic pump 179B is controlled in accordance with change of the control pressure (negative control pressure) Pc2 (details of this control being described later).

(d) Regulator Unit

Figure 23:
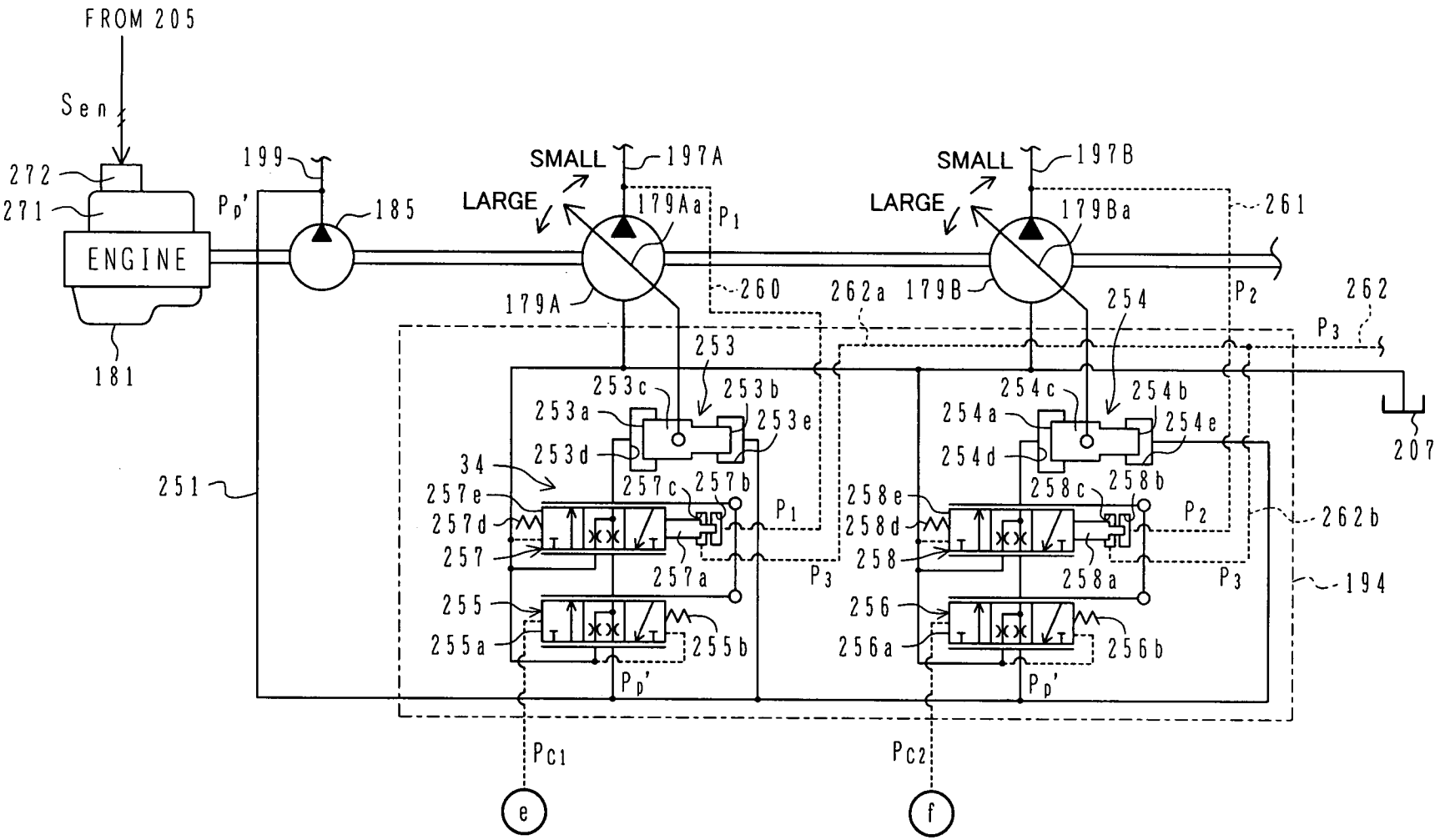
FIG. 23 is a hydraulic circuit diagram showing a detailed structure of a regulator unit constituting the hydraulic drive system provided in another embodiment of the self-propelled crushing machine of the present invention.

FIG. 23 is a hydraulic circuit diagram showing a detailed structure of the regulator unit 194. In FIG. 23, the regulator unit 194 comprises tilting actuators 253, 254, first servo valves 255, 256, a second servo valve 257, and a second servo valve 258 having the same structure as the former second servo valve 257. These servo valves 255, 256, 257 and 258 control the pressures of the hydraulic fluids supplied from the pilot pump 185 and the first, second and third hydraulic pumps 179A, 179B, 179C to act upon the tilting actuators 253, 254, thereby controlling tilting (i.e., displacement) of each of the swash plates 179Aa, 179Ba of the first and second hydraulic pumps 179A, 179B.

The tilting actuators 253, 254 comprise respectively working pistons 253*c*, 254*c* having large-diameter pressure bearing portions 253*a*, 254*a* and small-diameter pressure bearing portions 253*b*, 254*b* formed at opposite ends thereof, and pressure bearing chambers 253*d*, 253*e*; 254*d*, 254*e* in which the pressure bearing portions 253*a*, 253*b*; 254*a*, 254*b* are positioned respectively. When the pressures in both the pressure bearing chambers 253*d*, 253*e*; 254*d*, 254*e* are equal to each other, the working piston 253*c*, 254*c* is moved to the right, as viewed in FIG. 23, due to the difference in pressure bearing area, thus resulting in larger tilting of the swash plate 179Aa, 179Ba and an increase of each pump delivery rate. Also, when the pressure in the large-diameter side pressure bearing chamber 253*d*, 254*d* lowers, the working piston 253*c*, 254*c* is moved to the left as viewed in FIG. 23, thus resulting in smaller tilting of the swash plate 179Aa, 179Ba and a decrease of each pump delivery rate. Additionally, the large-diameter side pressure bearing chambers 253*d*, 254*d* are connected via the first servo valves 255, 256 to a line 251 communicating with the delivery line 199 of the pilot pump 185, and the small-diameter side pressure bearing chambers 253*e*, 254*e* are directly connected to the line 251.

When the control pressure Pc1, Pc2 from the pump control valve 198L, 198R is high, a valve member 255*a*, 256*a* of the first servo valve 255, 256 is moved to the right as viewed in FIG. 23, thus resulting in larger tilting of the swash plate 179Aa, 179Ba and an increase of the delivery rate of each of the first and second hydraulic pumps 179A, 179B. Then, as the control pressure Pc1, Pc2 lowers, the valve member 255*a*, 256*a* is moved to the left, as viewed in FIG. 23, by the force of a spring 255*b*, 256*b*, thereby reducing the delivery rate of each of the first and second hydraulic pumps 179A, 179B. Thus, in the first servo valves 255, 256, the negative control is realized such that the tilting (delivery rate) of each swash plate 179Aa, 179Ba of the first and second hydraulic pumps 179A, 179B is controlled, in combination with the functions of the pump control valves 198L, 198R, so as to obtain the delivery rates corresponding to the flow rates demanded by the control valves 186L, 186R, 187 and 188.

The second servo valves 257, 258 are each a servo valve for the input torque limiting control and have the same structure.

The second servo valve 257 is a valve operated by respective delivery pressures P1, P3 of the first and third hydraulic pumps 179A, 179C. The delivery pressures P1, P3 are introduced respectively to pressure bearing chambers 257*b*, 257*c* of an operation driving sector 257*a* via delivery pressure detecting lines 260, 262 and 262*a*, which are branched from the delivery lines 197A, 197C of the first and third hydraulic pumps 179A, 179C.

More specifically, when the force acting upon the operation driving sector 257*a* based on the sum P1+P3 of the delivery pressures of the first and third hydraulic pumps 179A, 179C is smaller than the force acting upon a valve member 257*e* based on the resilient force set by a spring 257*d*, the valve member 257*e* is moved to the right as viewed in FIG. 23, whereupon the pilot pressure Pp' introduced from the pilot pump 185 through the first servo valve 255 is transmitted to the pressure bearing chamber 253*d* of the tilting actuator 253 without being reduced. This results in larger tilting of the swash plate 179Aa of the first hydraulic pump 179A and an increase of the delivery rate thereof. As the force based on the sum P1+P3 of the delivery pressures of the first and third hydraulic pumps 179A, 179C increases over the setting value of the resilient force set by the spring 257*d*, the valve member 257*e* is moved to the left as viewed in FIG. 23, whereupon the pilot pressure Pp' introduced from the pilot pump 185 through the first servo valve 255 is transmitted to the pressure bearing chamber 253*d* after being reduced. As a result, the delivery rate of the first hydraulic pump 179A is reduced.

On the other hand, the second servo valve 258 is a valve operating by respective delivery pressures P2, P3 of the second and third hydraulic pumps 179B, 179C. The delivery pressures P2, P3 are introduced respectively to pressure bearing chambers 258*b*, 258*c* of an operation driving sector 258*a* via delivery pressure detecting lines 261, 262 and 262*b*, which are branched from the delivery lines 197B, 197C of the second and third hydraulic pumps 179B, 179C.

More specifically, as in the case of the second servo valve 257, when the force acting upon the operation driving sector 258*a* based on the sum P2+P3 of the delivery pressures of the second and third hydraulic pumps 179B, 179C is smaller than the force acting upon a valve member 258*e* based on the resilient force set by a spring 258*d*, the valve member 258*e* is moved to the right as viewed in FIG. 23, whereupon the pilot pressure Pp' is transmitted to the pressure bearing chamber 254*d* of the tilting actuator 254 without being reduced. This results in larger tilting of the swash plate 179Ba of the second hydraulic pump 179B and an increase of the delivery rate thereof. As the force based on the sum P2+P3 of the delivery pressures of the second and third hydraulic pumps 179B, 179C increases over the setting value of the resilient force set by the spring 258*d*, the valve member 258*e* is moved to the left as viewed in FIG. 23, whereupon the pilot pressure Pp' is transmitted to the pressure bearing chamber 254*d* after being reduced. As a result, the delivery rate of the second hydraulic pump 179B is reduced.

In this way, the so-called input torque limiting control (horsepower control) is realized in which the tilting of each swash plate 179Aa, 179Ba of the first and second hydraulic pumps 179A, 179B is controlled such that, as the delivery pressures P1, P2 and P3 of the first to third hydraulic pumps 179A-C rise, the maximum values of the delivery rates of the first and second hydraulic pumps 179A, 179B are limited to lower levels, and a total of the input torques of the first to third hydraulic pumps 179A-C is limited to be not larger than the output torque of the engine 181. At that time, more particularly, the so-called total horsepower control is realized such that a total of the input torques of the first to third hydraulic pumps 179A-C is limited to be not larger than the output torque of the engine 181 depending on the sum of the delivery pressure P1 of the first hydraulic pump 179A and the delivery pressure P3 of the third hydraulic pump 179C on the side of the first hydraulic pump 179A and depending on the sum of the delivery pressure P2 of the second hydraulic pump 179B and the delivery pressure P3 of the third hydraulic pump 179C on the side of the second hydraulic pump 179B.

(f) Third Control Valve

Figure 24:
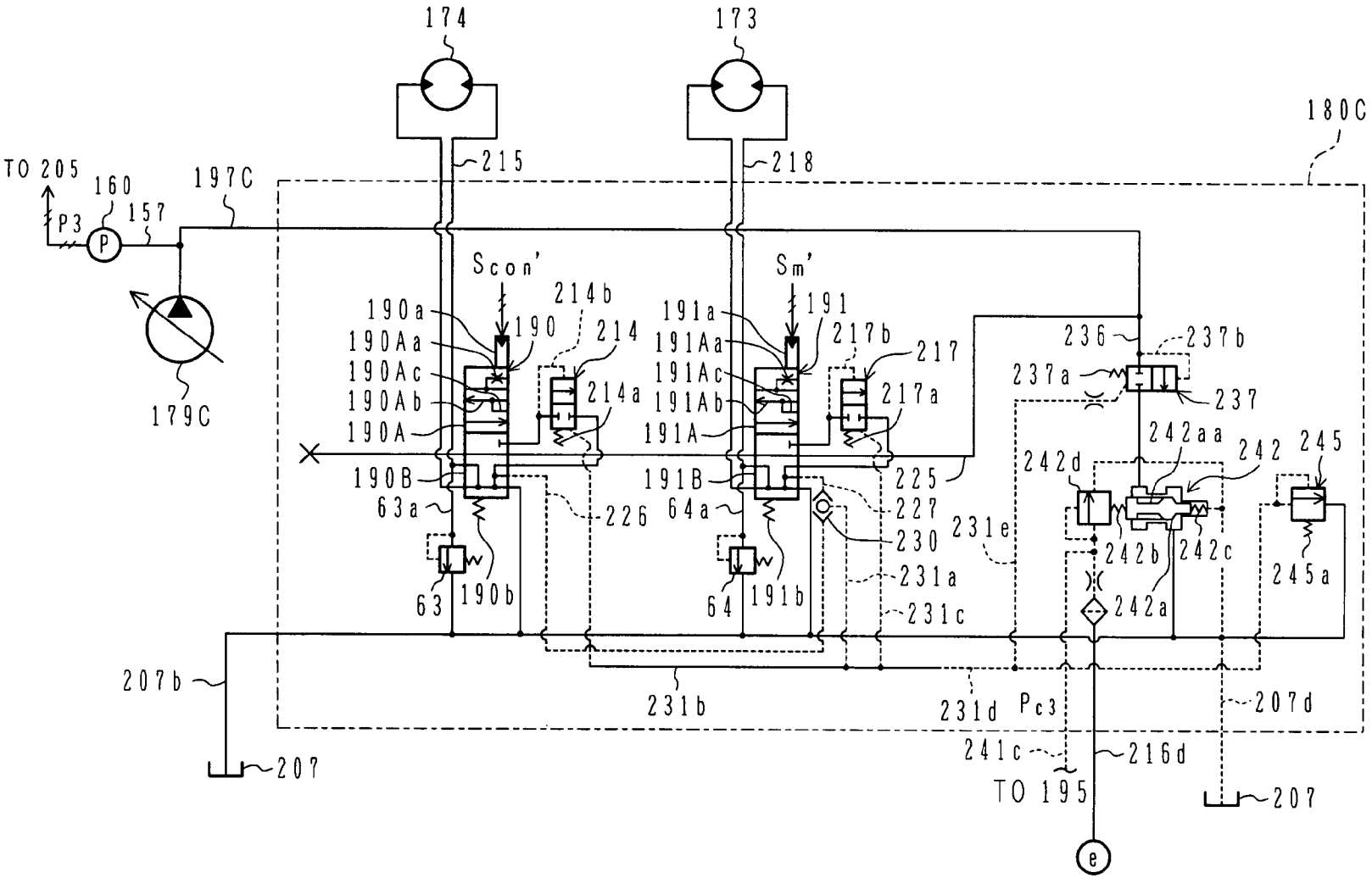
FIG. 24 is a hydraulic circuit diagram showing a detailed arrangement of a third control valve unit constituting the hydraulic drive system provided in another embodiment of the self-propelled crushing machine of the present invention.

FIG. 24 is a hydraulic circuit diagram showing a detailed arrangement of the third control valve unit 180C. In FIG. 24, numeral 190 denotes a discharge conveyor control valve, and 191 denotes a magnetic separating device control valve.

Those control valves 190, 191 are disposed on a center line 225 connected to the delivery line 197C of the third hydraulic pump 179C in the order of the magnetic separating device control valve 191 and the discharge conveyor control valve 190 from the upstream side. Additionally, the center line 225 is closed downstream of the discharge conveyor control valve 190 disposed at the most downstream.

The discharge conveyor control valve 190 is a solenoid selector valve having a solenoid driving sector 190*a*. The solenoid driving sector 190*a* is provided with a solenoid energized by a drive signal Scon' from the controller 205, and the discharge conveyor control valve 190 is switched in response to an input of the drive signal Scon'.

More specifically, when the drive signal Scon' is turned to an ON-signal for starting the operation of the discharge conveyor 165, the discharge conveyor control valve 190 is switched to a shift position 190A on the upper side as viewed in FIG. 24. Accordingly, the hydraulic fluid introduced from the third hydraulic pump 179C via the delivery line 197C and the center line 225 is supplied to the discharge conveyor hydraulic motor 174 from a throttle means 190Aa provided in the shift position 190A via a line 214*b* connected to the throttle means 190Aa, a pressure control valve 214 (described later in detail) disposed in the line 214*b*, a port 190Ab provided in the shift position 190A, and a supply line 215 connected to the port 190Ab, thereby driving the discharge conveyor hydraulic motor 174.

When the drive signal Scon' is turned OFF, the discharge conveyor control valve 190 is returned to a cutoff position 190B shown in FIG. 24 by the biasing force of a spring 190b, whereby the discharge conveyor hydraulic motor 174 is stopped.

Similarly to the discharge conveyor control valve 190 described above, the magnetic separating device control valve 191 is a solenoid selector valve having a solenoid driving sector 191*a*, and it is switched in response to an input of a drive signal Sm' to the solenoid driving sector 191*a* from the controller 205. More specifically, referring to FIG. 24, when the drive signal Sm' inputted to the solenoid driving sector 191*a* from the controller 205 is turned ON, the magnetic separating device control valve 191 is switched to a communication position 191A on the upper side as viewed in FIG. 24. As a result, the hydraulic fluid from the third hydraulic pump 179C is supplied to the magnetic separating device hydraulic motor 173 from a throttle means 191Aa provided in the shift position 191A via a line 217*b*, a pressure control valve 217 (described later in detail), a port 191Ab, and a supply line 218, thereby driving the magnetic separating device hydraulic motor 173. When the drive signal Sm' is turned OFF, the magnetic separating device control valve 191 is returned to a cutoff position 191B by the biasing force of a spring 191*b*, whereby the magnetic separating device hydraulic motor 173 is stopped.

A description is now made of the functions of the pressure control valves 214, 217 disposed respectively in the lines 214*b*, 217*b*.

The port 190Ab in the shift position 190A of the discharge conveyor control valve 190 and the port 191Ab in the shift position 191A of the magnetic separating device control valve 191 are communicated respectively with a load detecting port 190Ac and a load detecting port 191Ac for detecting corresponding load pressures of the discharge conveyor hydraulic motor 174 and the magnetic separating device hydraulic motor 173. Additionally, the load detecting port 190Ac is connected to a load detecting line 226, and the load detecting port 191Ac is connected to a load detecting line 227.

The load detecting line 226 to which-the load pressure of the discharge conveyor hydraulic motor 174 is introduced and the load detecting line 227 to which the load pressure of the magnetic separating device hydraulic motor 173 is introduced are connected to a maximum load detecting line 231*a* through a shuttle valve 230 so that the load pressure on the higher pressure side, which is selected by the shuttle valve 230, is introduced as a maximum load pressure to the maximum load detecting line 231*a*.

Then, the maximum load pressure introduced to the maximum load detecting line 231*a* is transmitted to one sides of the corresponding pressure control valves 214, 217 via lines 231*b*, 231*c* which are connected to the maximum load detecting line 231*a*. At this time, pressures in the lines 214*b*, 217*b*, i.e., pressures downstream of the throttle means 190Aa, 191Aa, are introduced to the other sides of the pressure control valves 214, 217.

With such an arrangement, the pressure control valves 214, 217 are operated depending on respective differential pressures between the pressures downstream of the throttle means 190Aa, 191Aa of the control valves 190, 191 and the maximum load pressure of the discharge conveyor hydraulic motor 174 and the magnetic separating device hydraulic motor 173, thereby holding the differential pressures at certain values regardless of changes in the load pressures of those hydraulic motors 174, 173. In other words, the pressures downstream of the throttle means 190Aa, 191Aa are held higher than the maximum load pressure by values corresponding to respective setting pressures set by springs 214*a*, 217*a*.

A relief valve (unloading valve) 237 provided with a spring 237*a* is disposed in a bleed-off line 236 branched from the delivery line 197C of the third hydraulic pump 179C. The maximum load pressure is introduced to one side of the relief valve 237 via the maximum load detecting line 231*a* and lines 231*d*, 231*e* connected to the line 231*a*, while a pressure in the bleed-off line 236 is introduced to the other side of the relief valve 237 via a port 237*b*. With such an arrangement, the relief valve 237 holds the pressure in the line 236 and the center line 225 higher than the maximum load pressure by a value corresponding to a setting pressure set by the spring 237*a*. Stated another way, the relief valve 237 introduces the hydraulic fluid in the line 236 to the reservoir 207 through a pump control valve 242 (described later) when the pressure in the line 236 and the center line 225 reaches a pressure obtained by adding the resilient force of the spring 237*a* to the pressure in the line 231*e* to which the maximum load pressure is introduced. As a result, load sensing control is realized such that the delivery pressure of the third hydraulic pump 179C is held higher than the maximum load pressure by a value corresponding to the setting pressure set by the spring 237*a*.

The pressure compensating functions of keeping constant respective differential pressures across the throttle means 190Aa, 191Aa are achieved by the above-described two kinds of control, i.e., the control performed by the pressure control valves 214, 217 for the differences between the pressures downstream of the throttle means 190Aa, 191Aa and the maximum load pressure and the control performed by the relief valve 237 for the difference between the pressure in the bleed-off line 236 and the maximum load pressure. Consequently, regardless of changes in the load pressures of the hydraulic motors 174, 173, the hydraulic fluids can be supplied to the corresponding hydraulic motors at flow rates depending on respective opening degrees of the control valves 190, 191.

Further, in the bleed-off line 236 at a position downstream of the relief valve 237, the pump control valve 242 having the flow rate—pressure converting function similar to those of the above-mentioned pump control valves 198L, 198R. The pump control valve 242 comprises a piston 224*a* having a throttle portion 242*aa*, springs 242*b*, 242*c* for biasing respectively opposite ends of the piston 242*a*, and a variable relief valve 242*d* which is connected at its upstream side to the delivery line 199 of the pilot pump 185 via the pilot introducing lines 216*a*, 216*d* for introduction of the pilot pressure and at its downstream side to the reservoir line 207*d*, and which produces a relief pressure variably set by the spring 242*b*.

With such an arrangement, during crushing work, the pump control valve 242 functions as follows. Because the most downstream end of the center line 225 is closed as mentioned above, the pressure of the hydraulic fluid flowing through the center line 225 changes depending on respective amounts by which the discharge conveyor control valve 190 and the magnetic separating device control valve 191 are operated (i.e., shift stroke amounts of their spools). When those control valves 190, 191 are in neutral positions, i.e., when demand flow rates of the control valves 190, 191 demanded for the third hydraulic pump 179C (namely flow rates demanded by the hydraulic motors 174, 173) are small, most of the hydraulic fluid delivered from the third hydraulic pump 179C is not introduced to the supply lines 215, 218 and is led out, as an extra flow rate, to the downstream side through the relief valve 237, followed by being introduced to the pump control valve 242. Therefore, the hydraulic fluid is led out at a relatively large flow rate to the reservoir line 207*d* through the throttle portion 242*aa* of the piston 242*a*. As a result, the piston 242*a* is moved to the right, as viewed in FIG. 24, to reduce the setting relief pressure of the relief valve 242*d* set by the spring 242*b*, whereby a relatively low control pressure (negative control pressure) Pc3 is generated in a line 241*c* (see also FIG. 19) that is branched from the line 216*d* and is extended to the regulator 195 for the negative tilting control regarding the third hydraulic pump.

Conversely, when those control valves are operated into open states, i.e., when the flow rates demanded for the third hydraulic pump 179C are large, the extra flow rate of the hydraulic fluid flowing to the bleed-off line 236 is reduced corresponding to the flow rates of the hydraulic fluid flowing to the hydraulic motors 174, 173. Therefore, the flow rate of the hydraulic fluid led out to the reservoir line 207*d* through the piston throttle portion 242*aa* becomes relatively small, whereby the piston 242*a* is moved to the left, as viewed in FIG. 24, to increase the setting relief pressure of the relief valve 242*d*. As a result, the negative control pressure Pc3 in the line 241*c* rises. In this embodiment, as described later, a tilting angle of a swash plate 179Ca of the third hydraulic pump 179C is controlled in accordance with change of the negative control pressure Pc3 (details of this control being described later).

In addition, a relief valve 245 is disposed between the line 231*d* to which the maximum load pressure is introduced and the reservoir line 207*b*, thereby to limit the maximum pressure in the lines 231*a-e* to be not higher than the setting pressure of a spring 245*a* for the purpose of circuit protection. Stated another way, the relief valve 245 and the above-mentioned relief valve 237 constitute a system relief valve such that, when the pressure in the lines 231*a-e* becomes higher than the pressure set by the spring 245*a*, the pressure in the line 231*a-e* lowers to the reservoir pressure with the action of the relief valve 245, whereupon the above-mentioned relief valve 237 is operated to come into a relief state.

(g) Regulator Unit for Third Hydraulic Pump

Returning to FIG. 19, the regulator 195 comprises a hydraulic chamber 195*a*, a piston 195*b*, and a spring 195*c*. When the control pressure PC3 introduced to the hydraulic chamber 195*a* via the line 241*c* is high, the piston 195*b* is moved to the left, as viewed in FIG. 19, against the biasing force of the spring 195*c*, thus resulting in larger tilting of the swash plate 179Ca of the third hydraulic pump 179C and an increase of the delivery rate of the third hydraulic pump 179C. On the other hand, as the control pressure PC3 lowers, the piston 195*b* is moved to the right, as viewed in FIG. 19, by the force of the spring 195*c*, whereby the delivery rate of the third hydraulic pump 179C is reduced.

Thus, with the regulator 195, the so-called negative control is realized such that the tilting (delivery rate) of the swash plate 179Ca of the third hydraulic pump 179C is controlled, in combination with the above-described function of the pump control valve 242, so as to obtain the delivery rate corresponding to the flow rates demanded by the control valves 190, 191, more practically, to minimize the flow rate of the hydraulic fluid passing through the pump control valve 242.

(e) Control Panel

In FIG. 19, the control panel 196 includes a shredder start/stop switch 196*a* for starting and stopping the crushing device 162, a shredder forward/reverse rotation select dial 196*b* for selecting whether the crushing device 162 is operated in the forward or reverse direction, a conveyor start/stop switch 196*c* for starting and stopping the discharge conveyor 165, a magnetic separating device start/stop switch 196*d* for starting and stopping the magnetic separating device 166, and a mode select switch 196*e* for selecting one of a travel mode in which travel operation is performed and a crushing mode in which crushing work is performed.

When the operator manipulates any of those various switches and dial on the control panel 196, a resulting operation signal is inputted to the controller 205. In accordance with the operation signal from the control panel 196, the controller 205 produces corresponding one of the drive signals Scon', Sm', St', Scr1 and Scr2 for the solenoid driving sector 190*a*, the solenoid driving sector 191*a*, the solenoid 206*a*, the solenoid 208Fa and the solenoid 208Ra of the discharge conveyor control valve 190, the magnetic separating device control valve 191, the travel lock solenoid control valve 206, the crushing device forward-rotation solenoid control valve 208F, and the crushing device reverse-rotation solenoid control valve 208R, and then outputs the produced drive signal to the corresponding solenoid.

More specifically, when the "travel mode" is selected by the mode select switch 196*e* of the control panel 196, the drive signal St' for the travel lock solenoid control valve 206 is turned ON to switch the travel lock solenoid control valve 206 into the communication position 206A on the right side as viewed in FIG. 21, thus enabling the travel control valves 187, 188 to be operated respectively by the control levers 192*a*, 193*a*. When the "crushing mode" is selected by the mode select switch 196*e* of the control panel 106, the drive signal St' for the travel lock solenoid control valve 206 is turned OFF to return the travel lock solenoid control valve 206 into the cutoff position 206B on the left side as viewed in FIG. 21, thus disabling the operation of the travel control valves 187, 188 respectively by the control levers 192*a*, 193*a*.

Also, when the shredder start/stop switch 196*a* is pushed to the "start" side in a state that the "forward rotation" (or the "reverse rotation"; this directional correspondence is similarly applied to the following description) is selected by the shredder forward/reverse rotation select dial 196*b* of the control panel 196, the drive signal Scr1 (or the drive signal Scr2) for the solenoid 208Fa of the crushing device forward-rotation solenoid control valve 208F (or the solenoid 208Ra of the crushing device reverse-rotation solenoid control valve 208R) is turned ON and the drive signal Scr2 (or the drive signal Scr1) for the solenoid 208Ra of the crushing device reverse-rotation solenoid control valve 208R (or the solenoid 208Fa of the crushing device forward-rotation solenoid control valve 208F) is turned OFF, whereby the first and second crushing device control valves 186L, 186R are switched to the shift positions 186LA, 186RA on the upper side as viewed in FIGS. 20 and 22 (or the shift positions 186LB, 186RB on the lower side). As a result, the hydraulic fluids from the first and second hydraulic pumps 179A, 179B are supplied to the crushing device hydraulic motor 169 in a joined way for driving it, thus causing the crushing device 162 to start operation in the forward direction (or in the reverse direction).

Then, when the shredder start/stop switch 196*a* is pushed to the "stop" side, the drive signals Scr1, Scr2 are both turned OFF, whereby the first and second crushing-device control valves 186L, 186R are returned to their neutral positions shown in FIGS. 20 and 22. As a result, the crushing device hydraulic motor 169 is stopped and the crushing device 162 is also stopped.

Further, when the conveyor start/stop switch 196*c* of the control panel 196 is pushed to the "start" side, the drive signal Scon' for the solenoid driving sector 190*a* of the discharge conveyor control valve 190 is turned ON, whereby the discharge conveyor control valve 190 is switched to the communication position 190A on the upper side as viewed in FIG. 24. As a result, the hydraulic fluid from the third hydraulic pump 179C is supplied to the discharge conveyor hydraulic motor 174 for driving it, thus causing the discharge conveyor 165 to start operation. Then, when the conveyor start/stop switch 196*c* of the control panel 196 is pushed to the "stop" side, the drive signal Scon' for the solenoid driving sector 190*a* of the discharge conveyor control valve 190 is turned OFF, whereby the discharge conveyor control valve 190 is returned to the cutoff position 190B shown in FIG. 24. As a result, the discharge conveyor hydraulic motor 174 is stopped and the discharge conveyor 165 is also stopped.

Similarly, when the magnetic separating device start/stop switch 196*d* is pushed to the "start" side, the magnetic separating device control valve 191 is switched to the communication position 191A on the upper side as viewed in FIG. 24, whereby the magnetic separating device hydraulic motor 173 is driven to start operation of the magnetic separating device 166. When the magnetic separating device start/stop switch 196*d* is pushed to the "stop" side, the magnetic separating device control valve 191 is returned to the cutoff position, whereby the magnetic separating device 166 is stopped.

Here, as in the above-described one embodiment, this embodiment is also featured by the horsepower increasing control that the engine load status is detected by detecting the respective delivery pressures of the first to third hydraulic pumps 179A, 179B and 179C, and the revolution speed of the engine 181 is increased when an average value of those delivery pressures exceeds a predetermined threshold. This feature will be described below in more detail.

In FIGS. 19, 20, 22 and 24, numeral 271 denotes a fuel injector (governor) for injecting fuel to the engine 181, and 272 denotes a fuel injection control unit for controlling the amount of fuel injected from the fuel injector 271. Also, numerals 158, 159 and 160 denote pressure sensors. The pressure sensor 158 is disposed in a pressure introducing line 155 branched from the delivery line 197A of the first hydraulic pump 179A, the pressure sensor 159 is disposed in a pressure introducing line 156 branched from the delivery line 197B of the second hydraulic pump 179B, and the pressure sensor 160 is disposed in a pressure introducing line 157 branched from the delivery line 197C of the third hydraulic pump 179C. These pressure sensors 158, 159 and 160 output the detected respective delivery pressures P1', P2' and P3 of the first to third hydraulic pumps 179A, 179B and 179C to the controller 205. After receiving the delivery pressures P1', P2' and P3, the controller 205 outputs a horsepower increasing signal Sen corresponding to the inputted delivery pressures P1', P2' and P3 to the fuel injection control unit 271. In accordance with the inputted horsepower increasing signal Sen, the fuel injection control unit 271 performs horsepower increasing control to increase the amount of fuel injected from the fuel injector 271 to the engine 181.

Figure 25:
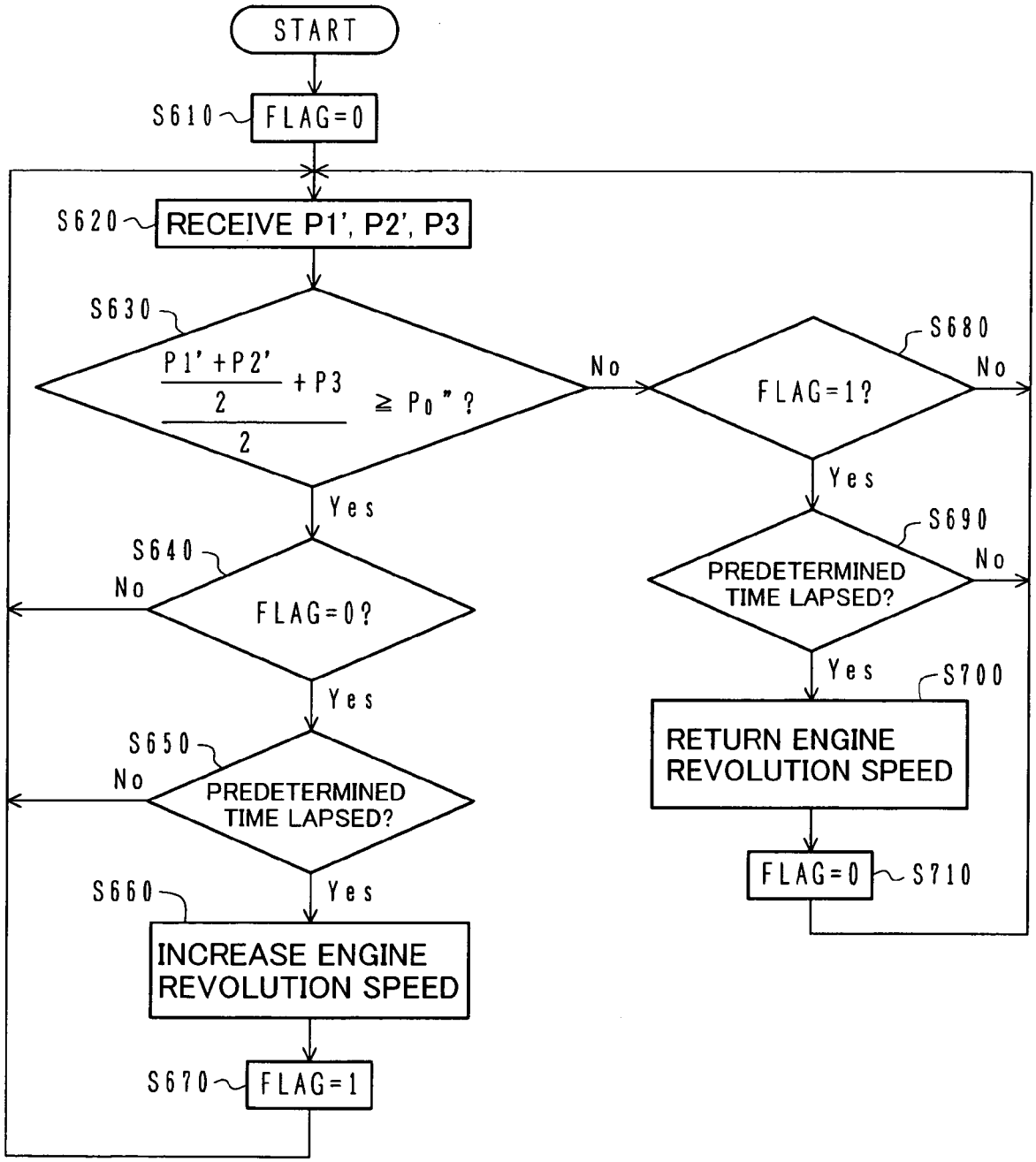
FIG. 25 is a flowchart showing control procedures related to engine horsepower increasing control in the functions of a controller constituting another embodiment of the self-propelled crushing machine of the present invention.

FIG. 25 is a flowchart showing control procedures related to that horsepower increasing control of the engine 181 in the functions of the controller 205, the flowchart corresponding to FIG. 9 representing the above-described one embodiment of the present invention. The controller 205 starts the flow shown in FIG. 25 when a power supply is turned on by, e.g., the operator, and it brings the flow into an end when the power supply is turned off.

Referring to FIG. 25, a flag indicating whether the horsepower increasing control of the engine 181 is performed by the controller 205 is first cleared in step 610 to 0 that indicates a state not under the control. In next step 620, the controller receives the delivery pressures P1', P2' and P3 of the first to third hydraulic pumps 179A, 179B and 179C, which are detected by the pressure sensors 158, 159 and 160, followed by proceeding to next step 630.

In step 630, it is determined whether a value of $\{((P1'+P2')/2)+P3\}/2$ is not smaller than a threshold $P_0''$. This threshold $P_0''$ is an average value obtained from an average value of the delivery pressures P1', P2' of the first and second hydraulic pumps 179A, 179B and the delivery pressure P3 of the third hydraulic pump 179C resulting when the load imposed on the engine 181 increases and the delivery rates of the first and second hydraulic pumps 179A, 179B reduces (i.e., when the crushing efficiency starts to decline). The threshold $P_0''$ is stored, for example, in the controller 205 in advance (alternatively, it may be entered and set from an external terminal as required). If the value of $\{((P1'+P2')/2)+P3\}/2$ is not smaller than the threshold $P_0''$, the determination is satisfied and the flow proceeds to next step 640.

In step 640, it is determined whether the above-mentioned flag is at 0 indicating the state in which the horsepower increasing control of the engine 181 is not performed. If the flag is at 1, the determination is not satisfied and the flow returns to step 620. On the other hand, if the flag is at 0, the determination is satisfied and the flow proceeds to next step 650.

In step 650, it is determined whether the state in which the value of $\{((P1'+P2')/2)+P3\}/2$ is not smaller than the threshold $P_0''$ has lapsed for a predetermined time. If the predetermined time has not lapsed, the determination is not satisfied and the flow returns to step 620. On the other hand, if the predetermined time has lapsed, the determination is satisfied and the flow proceeds to next step 660.

In step 660, the controller 205 outputs the horsepower increasing signal Sen to the fuel injection control unit 272, thus causing the fuel injection control unit 272 to increase the amount of fuel injected from the fuel injector 271 to the engine 181. As a result, the revolution speed of the engine 181 is increased. The flat is set to 1 in next step 670, following which the flow returns to step 620.

Meanwhile, if it is determined in step 630 that the value of $\{((P1'+P2')/2)+P3\}/2$ is smaller than the threshold $P_0''$, the determination is not satisfied and the flow proceeds to step 680. In step 680, it is determined whether the above-mentioned flag is at 1. If the flag is at 0, the determination is not satisfied and the flow returns to step 620. On the other hand, if the flag is at 1, the determination is satisfied and the flow proceeds to next step 690.

In step 690, it is determined whether the state in which the value of {((P1'+P2')/2)+P3}/2 is smaller than the threshold $P_0$" has lapsed for a predetermined time. If the predetermined time has not lapsed, the determination is not satisfied and the flow returns to step 620. On the other hand, if the predetermined time has lapsed, the determination is satisfied and the flow proceeds to next step 700.

In step 700, the controller 205 turns OFF the horsepower increasing signal Sen outputted to the fuel injection control unit 272, whereupon the fuel injection control unit 272 controls the amount of fuel injected from the fuel injector 271 to the engine 181 to be returned to the original amount. As a result, the revolution speed of the engine 181 is returned to the same speed as that before it has been increased. The flat is reset to 0 in next step 710, following which the flow returns to step 620.

In the above description, the discharge conveyor 165 and the magnetic separating device 166 each constitute at least one auxiliary for performing work related to the crushing work performed by the crushing device set forth in claims. The discharge conveyor hydraulic motor 174 and the magnetic separating device hydraulic motor 173 constitute auxiliary hydraulic actuators for driving respective auxiliaries. The first hydraulic pump 179A and the second hydraulic pump 179B each constitute at least one hydraulic pump for driving the crushing device hydraulic motor, and also constitute a first hydraulic pump, set forth in claim 3, comprising two variable displacement hydraulic pumps performing the tilting control in sync with each other. The third hydraulic pump 179C constitutes a second hydraulic pump for driving the auxiliary hydraulic actuator.

Also, the pressure sensors 158, 159 and the delivery pressure detecting lines 260, 261 constitute first delivery pressure detecting means for detecting the delivery pressure of the first hydraulic pump. The pressure sensor 160 and the delivery pressure detecting lines 262, 262*a* and 262*b* constitute second delivery pressure detecting means for detecting the delivery pressure of the second hydraulic pump. Further, the controller 205 constitutes control means for executing control to increase the revolution speed of the prime mover. The controller 205 and the regulator unit 194 constitute control means for controlling the delivery rates of the first hydraulic pump and the second hydraulic pump in accordance with a detected signal from the first delivery pressure detecting means and a detected signal from the second delivery pressure detecting means such that a total of input torques of the first hydraulic pump and the second hydraulic pump is held not larger than an output torque of the prime mover, and for executing control to increase the revolution speed of the prime mover in accordance with both the detected signals from the first delivery pressure detecting means and the second delivery pressure detecting means.

Next, the operation of the thus-constructed another embodiment of the self-propelled crushing machine of the present invention will be described below.

In the self-propelled crushing machine having the above-described arrangement, when starting the crushing work, the operator first selects the "crushing mode" by the mode select switch 196*e* of the control panel 196 to disable the travel operation, and then pushes the magnetic separating device start/stop switch 196*d*, the conveyor start/stop switch 196*c*, and the shredder start/stop switch 196*a* to the "start" side successively, while selecting the "forward rotation" by the shredder forward/reverse rotation select dial 196*b*.

With such manipulation, the drive signal Sm' outputted from the controller 205 to the solenoid driving sector 191*a* of the magnetic separating device control valve 191 is turned ON, and the magnetic separating device control valve 191 is switched to the communication position 191A on the upper side as viewed in FIG. 24. Also, the drive signal Scon' outputted from the controller 205 to the solenoid driving sector 190*a* of the conveyor control valve 190 is turned ON, and the discharge conveyor control valve 190 is switched to the communication position 190A on the upper side as viewed in FIG. 24. Further, the drive signal Scr1 outputted from the controller 205 to the solenoid driving sectors 186La, 186Ra of the first and second crushing-device control valves 186L, 186R is turned ON and the drive signal Scr2 outputted to the solenoid driving sectors 186Lb, 186Rb thereof is turned OFF, whereby the first and second crushing-device control valves 186L, 186R are switched to the shift positions 186LA, 186RA on the upper side as viewed in FIGS. 20 and 22.

As a result, the hydraulic fluid from the third hydraulic pump 179C is supplied to the magnetic separating device hydraulic motor 173 and the discharge conveyor hydraulic motor 174, thereby starting respective operations of the magnetic separating device 166 and the discharge conveyor 165. On the other hand, the hydraulic fluids from the first and second hydraulic pumps 179A, 179B are supplied to the crushing device hydraulic motor 169, thereby causing the crushing device 162 to start operation in the forward direction.

Then, when target materials to be crushed are loaded into the hopper 161 by using, e.g., a bucket of a hydraulic excavator, the loaded target materials are guided to the crushing device 162 where the target materials are crushed into a predetermined size. The crushed materials are dropped, through a space under the crushing device 162, onto the discharge conveyor 165 and carried therewith. During the carrying, magnetic substances (such as iron reinforcing rods mixed in concrete construction wastes) are removed by the magnetic separating device 166 so that the sizes of the crushed materials become substantially uniform. Finally, the crushed materials are discharged from the rear portion of the self-propelled crushing machine (from the right end as viewed in FIG. 17).

In the crushing work performed through the foregoing procedures, the controller 205 starts the engine horsepower increasing control shown in the flow of FIG. 25, as described above, from the point in time when the power supply of the controller 205 is turned on by the operator.

More specifically, after setting the flag to 0 in step 610, the controller receives in step 620 the delivery pressures P1', P2' and P3 of the first to third hydraulic pumps 179A, 179B and 179C, which are outputted from the pressure sensors 158, 159 and 160, and determines in step 630 whether the value of {((P1'+P2')/2)+P3}/2 is not smaller than the threshold $P_0$". Here, when the load of the crushing device hydraulic motor 169 is an ordinary load value, the value of {((P1'+P2')/2)+P3}/2 is smaller than the threshold $P_0$', and therefore the determination in step 630 is not satisfied. Further, because of the flag being at 0, the determination in next step 680 is also not satisfied, and hence the flow returns to step 620. In this way, during the crushing work performed under the ordinary engine load, the flow of step 620→step 630→step 680→step 620 is repeated.

Assuming now the case that the load pressure of the crushing device hydraulic motor 169 is increased during the crushing work due to, e.g., excessive supply of the target materials (materials to be crushed), the value of {((P1'+P2')/

2)+P3}/2 exceeds the threshold $P_0$" and the determination in step 630 is satisfied. At this time, because of the flag being at 0, the determination in next step 640 is also satisfied, and the flow proceeds to step 650. Then, the flow of step 650→step 620→step 650 is repeated until a predetermined time is lapsed. If the state in which the value of {((P1'+P2')/2)+P3}/2 is not smaller than the threshold $P_0$" continues for the predetermined time, the determination in step 650 is satisfied, and the flow proceeds to step 660 where the controller 205 outputs the horsepower increasing signal Sen to the fuel injection control unit 272. As a result, the fuel injection control unit 272 increases the amount of fuel injected from the fuel injector 271 to the engine 181, whereby the revolution speed of the engine 181 is increased. Then, the flag is set to 1 in next step 670.

With the engine horsepower increasing control executed by the controller 205 in such a way to increase the revolution speed of the engine 181, the process of crushing the target materials by the crushing device 162 proceeds and the load pressure of the crushing device hydraulic motor 169 lowers. Correspondingly, the value of {((P1'+P2')/2)+P3}/2 becomes smaller than the threshold $P_0$". Therefore, the determination in step 630 is not satisfied, and the flow proceeds to step 620→step 630→step 680. At this time, because of the flag being set to 1, the determination in step 680 is satisfied, and the flow proceeds to step 690. Then, the flow of step 690→step 620→step 630→step 680→step 690 is repeated until the state in which the value of {((P1'+P2')/2)+P3}/2 is smaller than the threshold $P_0$" continues for a predetermined time. After the lapse of the predetermined time, the determination in step 690 is satisfied, and the flow proceeds to next step 700. In step 700, the controller 205 turns OFF the horsepower increasing signal Sen outputted to the fuel injection control unit 272. As a result, the amount of fuel injected from the fuel injector 271 to the engine 181 is returned to the original amount and the revolution speed of the engine 181 is returned to the original speed. The flag is then reset to 0 in next step 710.

With another embodiment of the self-propelled crushing machine of the present invention which has the above-described arrangement and operation, when the overload condition of the engine 181 is detected by the pressure sensors 158, 159 and 160 upon detecting the respective delivery pressures P1', P2' and P3 of the first and third hydraulic pumps 179A, 179B and 179C, the controller 205 increases the revolution speed of the engine 181. Hence, as in the above-described one embodiment, by increasing the horsepower of the engine 181 when the load of the crushing device is increased and the engine comes into the overload condition, it is possible to prevent a reduction of the crushing efficiency.

While, in the above-described one and another embodiments of the self-propelled crushing machine of the present invention, the delivery pressures of the first and second (and third) hydraulic pumps are detected by using the pressure sensors, and the engine horsepower increasing control is performed is executed when the overload condition of the engine is detected, the present invention is not limited to such design. For example, the engine horsepower may be increased through the steps of detecting the revolution speed of the engine and determining the engine being in the overload condition when the revolution speed of the engine is lower than a predetermined value.

INDUSTRIAL APPLICABILITY

According to the present invention, when a heavy load is imposed on the crushing device and the load pressure of the crushing device hydraulic motor is increased during the crushing work due to, e.g., excessive supply of the target materials (materials to be crushed), the crushing device load detecting means detects such an overload condition, and the control means increases the revolution speed of the prime mover, thereby increasing the horsepower of the prime mover. Thus, by increasing the horsepower of the prime mover in the overload condition of the crushing device, a reduction of the crushing efficiency can be prevented which is caused by a lowering of the rotational speed of the crushing device hydraulic motor.

The invention claimed is:

1. A self-propelled crushing machine for crushing target materials to be crushed, wherein the machine comprises:

a crushing device;

a hydraulic drive system including a crushing device hydraulic motor for driving said crushing device, at least one first hydraulic pump for driving said crushing device hydraulic motor, and a prime mover for driving said first hydraulic pump;

crushing device load detecting means for detecting a load condition of said crushing device; and first control means for executing control to increase a revolution speed of said prime mover in accordance with a detected signal from said crushing device load detecting means;

wherein the machine further comprises at least one auxiliary for performing work related to crushing work performed by said crushing device; and wherein said hydraulic drive system includes an auxiliary hydraulic actuator for driving said auxiliary, and a second hydraulic pump for driving said auxiliary hydraulic actuator, said prime mover driving said first hydraulic pump and said second hydraulic pump;

said crushing device load detecting means includes first delivery pressure detecting means for detecting a delivery pressure of said first hydraulic pump, and second delivery pressure detecting means for detecting a delivery pressure of said second hydraulic pump; and said first control means controls the delivery rates of said first hydraulic pump and said second hydraulic pump in accordance with a detected signal from said first delivery pressure detecting means and a detected signal from said second delivery pressure detecting means such that a total of input torques of said first hydraulic pump and said second hydraulic pump is held not larger than an output torque of said prime mover, and executes the control to increase the revolution speed of said prime mover in accordance with the detected signals from said first delivery pressure detecting means and said second delivery pressure detecting means.

2. A self-propelled crushing machine according to claim 1, wherein said first control means executes said control based on the detected signals from said first delivery pressure detecting means and said second delivery pressure detecting means to increase the revolution speed of said prime mover when the average value of the delivery pressures of the first and second hydraulic pumps is not smaller than a predetermined threshold and this state has lapsed for a predetermined time, and then to return the revolution speed of said prime mover to the original one before increase when the average value of the delivery pressures of the first and second hydraulic pumps is smaller than said predetermined threshold and this state has lapsed for a predetermined time.

3. A self-propelled crushing machine according to claim 1, wherein said first hydraulic pump comprises two variable displacement hydraulic pumps performing tilting control in sync with each other.

4. A self-propelled crushing machine according to claim 1, wherein the machine further comprises revolution speed sensor means for detecting a revolution speed of said prime mover, and second control means for executing control to reduce the input torques of said first and second hydraulic pumps based on a detected signal from said revolution speed sensor means when the revolution speed of the prime mover becomes lower than a predetermined target revolution speed (Nt).

5. A self-propelled crushing machine for crushing target materials to be crushed, wherein the machine comprises:

a crushing device;

a hydraulic drive system including a crushing device hydraulic motor for driving said crushing device, at least one first hydraulic pump for driving said crushing device hydraulic motor, and a prime mover for driving said first hydraulic pump;

crushing device load detecting means for detecting a load condition of said crushing device; and first control means for executing control to increase a revolution speed of said prime mover in accordance with a detected signal from said crushing device load detecting means;

wherein the machine further comprises at least one auxiliary for performing work related to crushing work performed by said crushing device; and wherein said hydraulic drive system includes an auxiliary hydraulic actuator for driving said auxiliary, and a second hydraulic pump for driving said auxiliary hydraulic actuator, said prime mover driving said first hydraulic pump and said second hydraulic pump;

said crushing device load detecting means includes first delivery pressure detecting means for detecting a delivery pressure of said first hydraulic pump, and second delivery pressure detecting means for detecting a delivery pressure of said second hydraulic pump; and said first control means controls the delivery rates of said first hydraulic pump and said second hydraulic pump in accordance with a detected signal from said first delivery pressure detecting means and a detected signal from said second delivery pressure detecting means such that a total of input torques of said first hydraulic pump and said second hydraulic pump is held not larger than an output torque of said prime mover, and executes the control to increase the revolution speed of said prime mover in accordance with the detected signals from said first delivery pressure detecting means and said second delivery pressure detecting means.

6. A self-propelled crushing machine according to claim 5, wherein said first hydraulic pump comprises two variable displacement hydraulic pumps performing tilting control in sync with each other.

7. A self-propelled crushing machine according to claim 5, wherein the machine further comprises revolution speed sensor means for detecting a revolution speed of said prime mover, and second control means for executing control to reduce the input torques of said first and second hydraulic pumps based on a detected signal from said revolution speed sensor means when the revolution speed of the prime mover becomes lower than a predetermined target revolution speed (Nt).

* * * * *